US006345408B1

(12) United States Patent
Nagai et al.

(10) Patent No.: US 6,345,408 B1
(45) Date of Patent: Feb. 12, 2002

(54) ELECTRIC VACUUM CLEANER AND NOZZLE UNIT THEREFOR

(75) Inventors: Kiyomu Nagai; Genji Kosaka; Nobuharu Hikida, all of Nara; Mikio Yagi, Osaka; Shigenori Hato, Kishiwada; Taichi Tamura, Higashiosaka; Teruhisa Inoue, Osaka; Kei Ohta, Yao; Masaru Shindou, Yao, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/357,818

(22) Filed: Jul. 20, 1999

(30) Foreign Application Priority Data

| | | |
|---|---|---|
| Jul. 28, 1998 | (JP) | 10-212676 |
| Jul. 29, 1998 | (JP) | 10-213975 |
| Oct. 29, 1998 | (JP) | 10-308704 |
| Nov. 30, 1998 | (JP) | 10-338617 |
| Feb. 8, 1999 | (JP) | 11-030148 |

(51) Int. Cl.[7] ..... A47L 5/34

(52) U.S. Cl. ..... 15/361; 15/369; 15/383; 15/411; 15/415.1; 285/7

(58) Field of Search ..... 15/415.1, 361, 15/411, 383; 285/7

(56) References Cited

U.S. PATENT DOCUMENTS

| | | | | |
|---|---|---|---|---|
| 1,104,148 A | * | 7/1914 | Spencer | 15/411 |
| 1,115,989 A | * | 11/1914 | Thurman | 285/7 |
| 1,838,481 A | * | 12/1931 | Gudka | 15/411 X |
| 2,074,042 A | * | 3/1937 | Bank | 285/7 |
| 2,170,963 A | * | 8/1939 | Dahl | 285/7 |
| 2,245,151 A | * | 6/1941 | Martinet | 285/7 |
| 3,013,294 A | * | 12/1961 | Ostrom | 15/410 X |
| 4,336,628 A | * | 6/1982 | Bradshaw et al. | 15/415.1 |
| 4,564,972 A | * | 1/1986 | Varin | 15/15.1 X |
| 4,577,366 A | * | 3/1986 | Miller et al. | 15/415.1 X |
| 5,083,340 A | | 1/1992 | Takahashi et al. | |
| 5,191,673 A | | 3/1993 | Damizet | |
| 5,471,707 A | * | 12/1995 | Kang | 15/415.1 X |
| 5,497,532 A | | 3/1996 | Glatz | |
| 5,548,867 A | | 8/1996 | Hwang | |
| 5,802,666 A | * | 9/1998 | Jung | 15/387 |
| 6,065,183 A | * | 5/2000 | Hammeken et al. | 15/411 |

FOREIGN PATENT DOCUMENTS

| | | | |
|---|---|---|---|
| DE | 3529777 | | 2/1987 |
| DK | 77870 | * | 7/1954 |
| EP | 0582090 | | 2/1994 |
| EP | 0688529 | | 12/1995 |
| GB | 2199487 | * | 7/1988 |
| GB | 2310369 | | 8/1997 |
| JP | 8275910 | | 10/1996 |
| JP | 8 289861 | | 11/1996 |
| JP | 10 328096 | | 12/1998 |
| TW | 341113 | | 9/1997 |

* cited by examiner

*Primary Examiner*—Chris K. Moore

(57) ABSTRACT

A nozzle unit for an electric vacuum cleaner has a body case 32 with a nozzle 34*a* open toward a surface to be cleaned, a first pipe 35 coupled to the body case 32 so as to be rotatable in the direction J1, and a second pipe 36 coupled to the first pipe 35 so as to be rotatable in the direction J2. A first and a second air flow passage, formed inside the first and second pipes 35 and 36 respectively, are arranged substantially in a straight line as seen in a side view. The first pipe 35 has a sliding portion 35*a* that has an arc-shaped cross section and that slides along the inner surface of the body case 32, and this sliding portion 35*a* is arranged inside the body case 32, which is substantially rectangular, as seen in a plan view.

21 Claims, 42 Drawing Sheets

ELECTRIC VACUUM CLEANER AND NOZZLE UNIT THEREFOR

BACKGROUND OF THE INVENTION

1. Field of the Invention

The present invention relates to an electric vacuum cleaner and to a nozzle unit for an electric vacuum cleaner.

2. Description of the Prior Art

A conventional electric vacuum cleaner has a structure as shown in FIG. 48. A nozzle unit 8 having a nozzle (not shown) formed in its bottom surface is coupled to an extension pipe 6. The extension pipe 6 is coupled through a coupling member 2 to a flexible hose 3. The hose is coupled to the body 9 of the electric vacuum cleaner. The flow of air sucked in through the nozzle flows through the extension pipe 6, the coupling member 2, and the hose 3, and then reaches the body 9 of the electric vacuum cleaner, thereby achieving suction of dust.

The coupling member 2 has a handle 1 formed integrally therewith, which is held by the user during cleaning. The coupling member 2 also has an operation switch 10, which is used during cleaning to control a rotary brush (not shown) provided in the nozzle unit 8 and to control the body 9 of the electric vacuum cleaner.

The nozzle unit 8 is shown in more detail in FIG. 49. The nozzle unit 8 has a body case 32, of which a coupling portion 32a supports a first pipe 35 in such a way that the first pipe 35 is rotatable in the direction indicated by the arrow J1. The first pipe 35 supports a second pipe 36 in such a way that the second pipe 36 is rotatable in the direction indicated by the arrow J2. The above-mentioned extension pipe 6 is coupled to this second pipe 36.

Thus, the first pipe 35 allows the elevation (depression) angle of the extension pipe 6 to vary when the nozzle unit 8 is moved in the direction indicated by the arrow G. For example, the first pipe 35 is rotated in the direction J1 so that the extension pipe 6 becomes substantially upright, and then the second pipe 36 is rotated in the direction J2. Thus, the second pipe 36 allows the elevation (depression) angle of the extension pipe 6 to vary when the nozzle unit 8 is moved in the direction indicated by the arrow H.

On the two side surfaces of the coupling portion 32a of the body case 32, casters 39 are provided that roll on the floor so as to allow the nozzle unit 8 to move. The air sucked in in the direction indicated by the arrow F1 through the nozzle (not shown) formed in the bottom surface of the body case 32 flows in the direction indicated by the arrow F2 toward the coupling portion 32*a*. The air then flows through the first and second pipes 35 and 36 as indicated by the arrows F3, F4, and F5, then flows through the extension pipe 6, and then reaches the electric vacuum cleaner body 9.

In ordinary cleaning, as shown in FIG. 50, the first and second pipes 35 and 36 are kept in a straight line as seen from above, and cleaning is performed as the nozzle unit 8 is moved in the direction indicated by the arrow G. In cleaning of a narrow area such as a gap between pieces of furniture, as shown in FIG. 51, the second pipe 36 is rotated, and dust suction is performed as the nozzle unit 8 is moved in the direction indicated by the arrow H.

In an electric vacuum cleaner of this type, the handle 1 is fixed to the coupling member 2 so as to be integral therewith. Therefore, in cleaning of an area such as a gap below a bed, the user needs to take a low position to hold the handle 1 while moving the nozzle unit 8. This imposes an undue burden on the user, and is thus undesirable in terms of user-friendliness.

In some cases, to perform dust suction in a narrow area, an auxiliary nozzle is used, such as a crevice nozzle having a flat tip or a dusting brush having a brush at its tip. In such cases, first, the extension pipe 6 needs to be removed from the coupling member 2. Then, an auxiliary nozzle (not shown) stored inside the electric vacuum cleaner body 9 needs to be taken out and coupled to the coupling member 2 so as to be ready for use. This requires complicated handling, and is thus undesirable in terms of user-friendliness. There is also a possibility of loss of an auxiliary nozzle.

Handling of an auxiliary nozzle can be simplified if the auxiliary nozzle is removably held on the extension pipe 6. However, this requires the auxiliary nozzle to be kept visible with dust and the like clung to the tip thereof, and thus spoils the appearance. There is also a possibility of loss of an auxiliary nozzle as in the cases described previously.

Moreover, from the nozzle unit 8, the coupling portion 32*a* and the first and second pipes 35 and 36 protrude in the direction (indicated by G) of the depth of he nozzle unit 8. (Note here that a depth means the length of the shorter sides of something perpendicular as seen in a plan view.) Thus, the nozzle unit 8 has an unduly large depth W1 relative to the depth W2 of the nozzle 32*b* (see FIG. 51). This makes cleaning of a gap difficult, and also, by requiring the nozzle unit 8 to be made larger and thus heavier, imposes an undue burden on the user.

Moreover, the air passage is bent in the first pipe 35 and also in the second pipe 36, and thus the suction pressure suffers a great loss. This reduces suction efficiency and increases noise. Furthermore, the range of rotation of the first pipe 35 in the direction J1 is so narrow that the elevation (depression) angle of the extension pipe 6 can be varied only between approximately 30° and 70°. This makes it difficult to move the nozzle unit 8 so as to reach sufficiently deep into an area such as below a bed where there is only a small gap above the floor, and is thus undesirable in terms of user-friendliness.

SUMMARY OF THE INVENTION

An object of the present invention is to provide an electric vacuum cleaner and a nozzle unit for an electric vacuum cleaner that offer improved userfriendliness in cleaning performed with the user taking a low position and in cleaning performed using an auxiliary nozzle. Another object of the present invention is to provide a compact and light-weight nozzle unit for an electric vacuum cleaner that offers improved suction efficiency.

To achieve the above objects, according to one aspect of the present invention, an electric vacuum cleaner is provided with:

- a nozzle unit kept in contact with a surface to be cleaned for dust suction;
- an extension pipe coupled to the nozzle unit;
- a hose coupling the extension pipe to the body of the electric vacuum cleaner; and
- a handle provided at an end of the extension pipe so as to be held by a user during cleaning, the handle being so formed that the angle of at least a portion thereof is variable relative to the extension pipe.

According to this arrangement, it is possible to change the angle of the handle provided at one end of the extension pipe coupled to the nozzle unit to a desired angle in accordance with the situation in which cleaning is performed, so that the user can hold the handle at the desired angle when moving the nozzle unit back and forth to do the cleaning.

According to another aspect of the present invention, a nozzle unit for an electric vacuum cleaner is provided with:

a body case having a nozzle open toward a surface to be cleaned, the body case having a substantially rectangular shape as seen in a plan view;

a first pipe that has a first air flow passage for allowing passage of a flow of air sucked in through the nozzle and that is coupled to the body case so as to be rotatable about a rotation axis parallel to the direction of the longer sides of the nozzle, the first pipe having a sliding portion that slides along the body case as the first pipe rotates, the sliding portion arranged inside the body case as seen in a plan view; and a second pipe rotatably coupled to the first pipe, the second pipe having a second air flow passage that communicates with the first air passage.

According to this arrangement, the sliding portion of the first pipe is arranged inside the substantially rectangular body case as seen in a plan view so as to be slidable along the body case, and thus the first pipe can be inclined in the direction of the depth (i.e. in the direction of the shorter sides) of the nozzle unit. The air sucked in through the nozzle achieves dust suction by flowing through the first air flow passage inside the first pipe and then through the second air flow passage inside the second pipe, of which the latter can be inclined in the direction of the longer sides of the body case. By rotating the first and second pipes appropriately, it is possible to reduce the depth-direction width of the nozzle unit.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Figure 1:
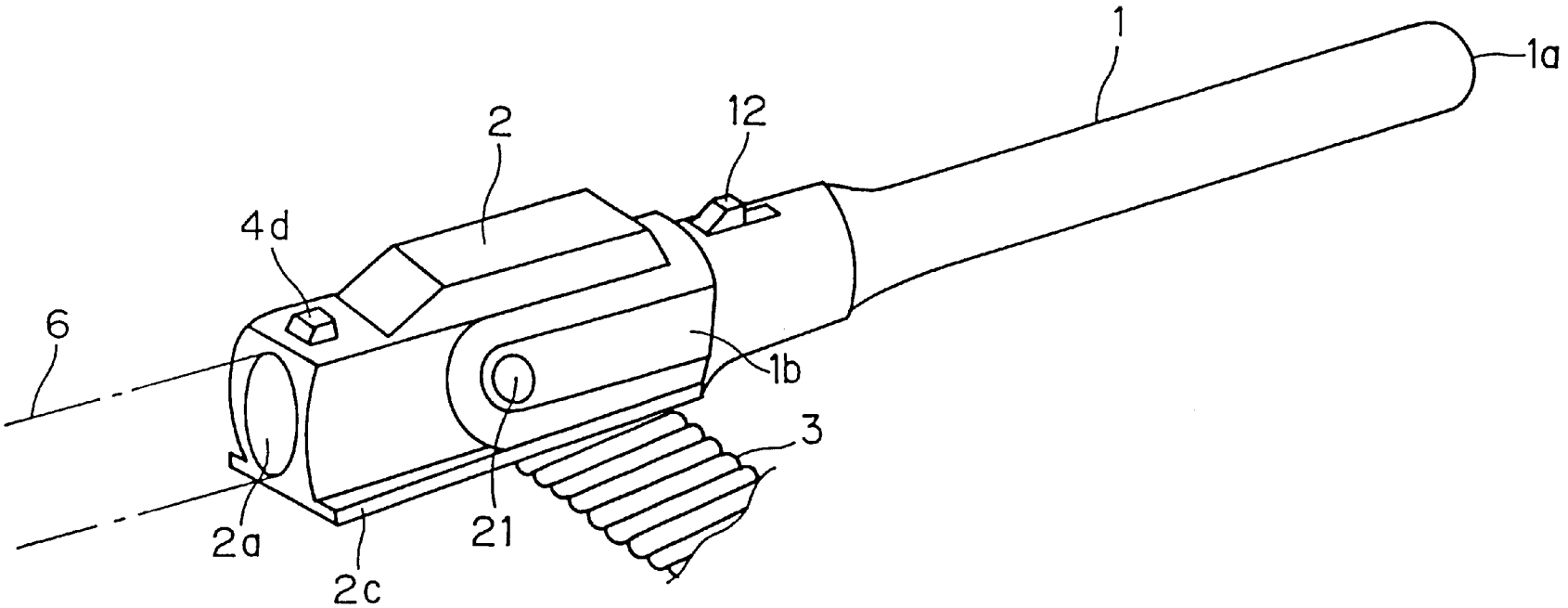
FIG. 1 is a perspective view of the handle of the electric vacuum cleaner of a first embodiment of the invention.
Figure 2:
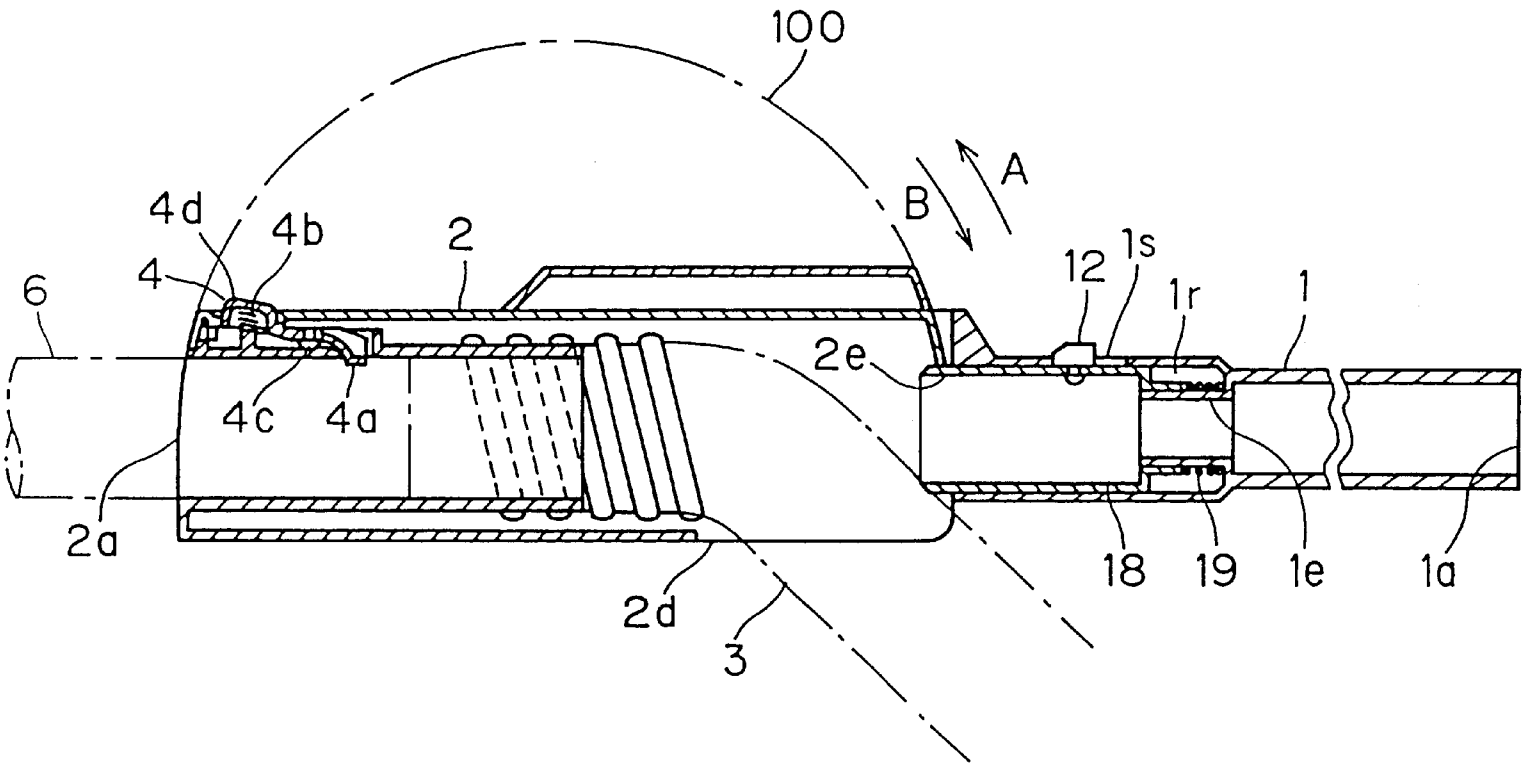
FIG. 2 is a sectional view, as seen from the side, of the handle of the electric vacuum cleaner of the first embodiment.

Hereinafter, embodiments of the present invention will be described with reference to the drawings. FIGS. 1 and 2 are a perspective view and a sectional view of the principal portion of the handle of the electric vacuum cleaner of a first embodiment of the invention. The electric vacuum cleaner as a whole has the same structure as the conventional example shown in FIG. 48. In a coupling member 2, an extension pipe connection aperture 2*a* is provided into which an extension pipe 6 is inserted. Inside the coupling member 2, the extension pipe connection aperture 2*a* communicates with a hose 3 that is inserted through an opening 2*d*.

To the coupling member 2, a handle 1 is fitted through a mount 1*b* (having a U-like shape as seen in a plan view) in such a way that the mount 1*b* sandwiches the coupling member 2 from the two side surfaces thereof. The mount 1*b* is rotatably supported on the coupling member 2 through a supporting shaft 21. The handle 1 has the shape of a hollow cylinder and is open at its free-end surface 1*a*. Moreover, the handle 1 has an inner barrel 18 slidably provided inside it.

Within a cavity 1*r* formed in a double-cylinder portion 1*e* formed inside the handle 1, the inner barrel 18 is loaded with a force that tends to move it toward the coupling member 2 by a compression spring 19. The inner barrel 18 reaches into the opening 2*d* of the coupling member 2, and thus a stopper portion 2*e* of the coupling member 2 restricts rotation of the handle 1 in the direction indicated by the arrow A. On the other hand, a base plate 2*c* strikes the mount 1*b* and thereby restricts rotation of the handle 1 in the direction indicated by the arrow B. In this way, the handle 1 is locked.

The state shown in FIG. 2 is the standard position of the handle (hereafter the "standard position") that allows a standing user to hold the handle 1 and move the nozzle unit 8 (see FIG. 48) back and forth with ease. In the handle 1, an unlocking button 12 is provided integrally with the inner barrel 18. The unlocking button 12 protrudes through a slot is so as to be movable along it. When the unlocking button 12 is moved rightward as seen in FIG. 2, the inner barrel 18 is unlocked from the coupling member 2, allowing rotation of the handle 1 in the direction indicated by the arrow A.

Reference numeral 4 represents a lock mechanism for the extension pipe 6. A claw portion 4*a* is loaded with a force by a compression spring 4*b*, with a supporting portion 4*c* used as a fulcrum. The lock mechanism 4 engages with a hole (not shown) provided in the extension pipe 6, and thereby the extension pipe 6 is locked to the coupling member 2. When a button portion 4*d* is pressed, the claw portion 4*a* retracts from the hole, allowing removal of the extension pipe 6.

Figure 3:
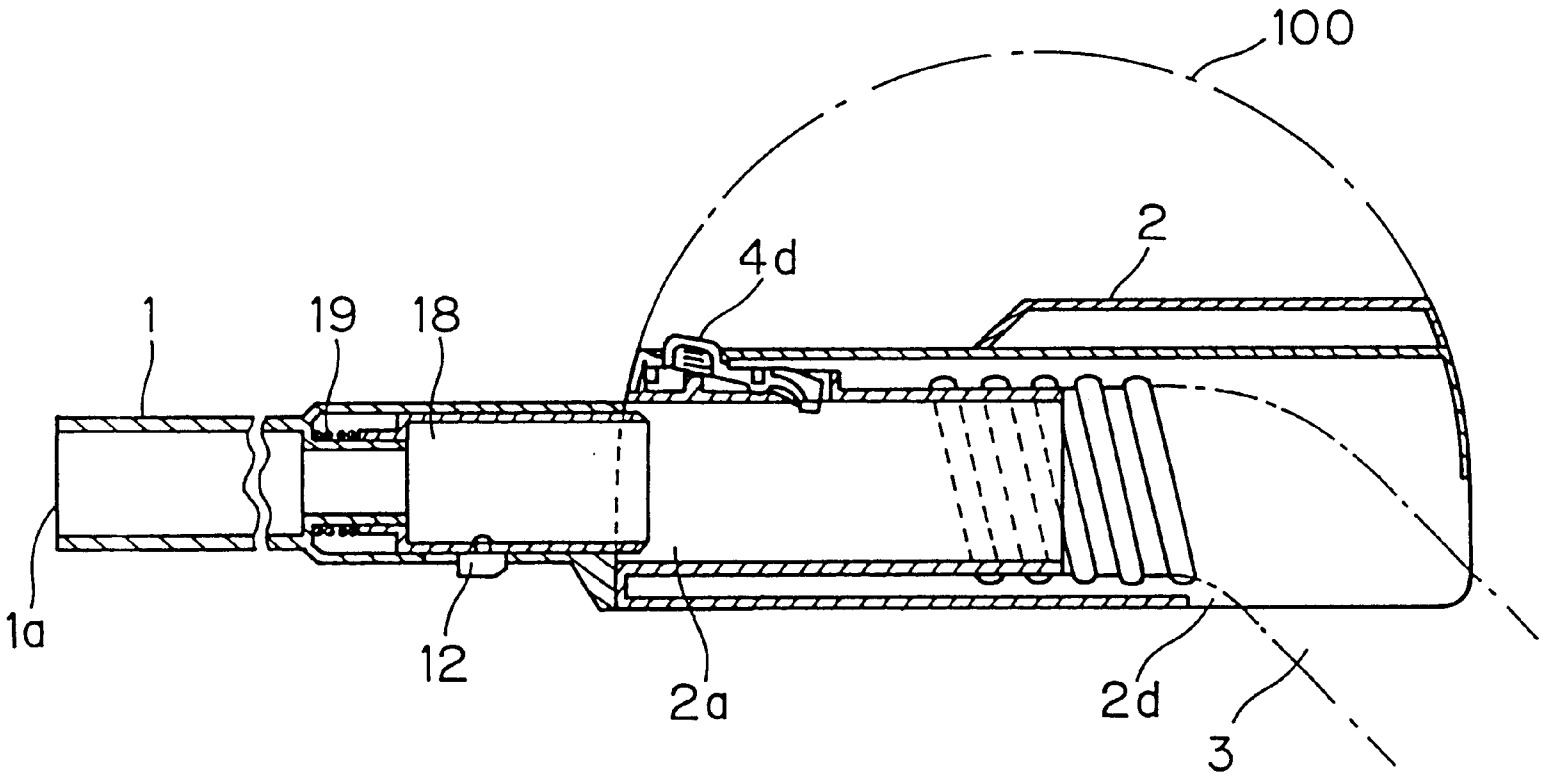
FIG. 3 is a diagram showing the state of the handle of the electric vacuum cleaner of the first embodiment when it is in the reversed position.

In cleaning of a narrow area, the extension pipe 6 is removed, and then the handle 1 is rotated, along the imaginary line 100, from the standard position shown in FIG. 2 to the position of the extension pipe connection aperture 2*a*. The resulting state is shown in FIG. 3. At this time, the inner barrel 18 reaches into the extension pipe connection aperture 2*a*, and the mount 1*b* of the handle 1 strikes the base plate 2*c* (see FIG. 1), thereby locking the handle 1. Now, the handle 1 communicates with the hose 3, allowing dust suction from the aperture at the free-end surface 1*a*. Thus, the handle 1 can be used as a crevice nozzle.

This eliminates the need to take a crevice nozzle out of the body 9 (see FIG. 48) of the electric vacuum cleaner and fit it into the extension pipe connection aperture 2*a*. Thus, it is possible to simplify the fitting of a crevice nozzle, and thereby enhance user-friendliness. Moreover, it is also possible to prevent loss of a crevice nozzle.

Figure 4:
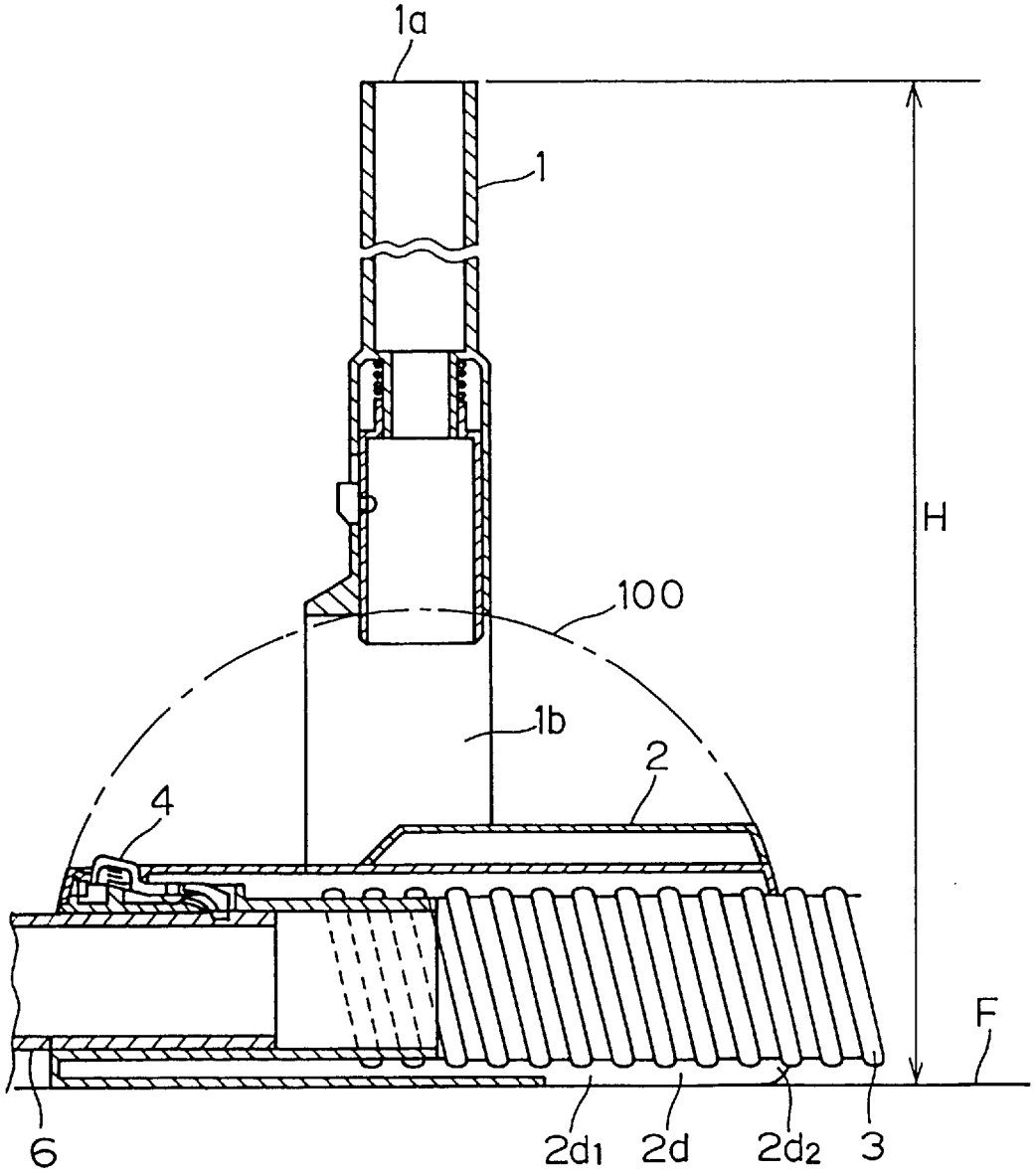
FIG. 4 is a diagram showing the state of the handle of the electric vacuum cleaner of the first embodiment when it is in the upright position.

FIG. 4 shows the state of the coupling member 2 when it is put on the floor surface F as when cleaning is suspended for a while. By rotating the handle 1 along the imaginary line 100 and locking it in an upright position relative to the coupling member 2, it is possible to increase the height H from the floor surface F to the free-end surface 1*a* of the handle 1. Thus, it is possible to reduce the stoop that the user needs to make to hold the handle 1 when restarting cleaning, and thereby reduce the burden on the user.

Moreover, the portion 2*d*2 of the opening 2*d* into which the handle 1 is inserted (when the handle 1 is in the standard position) is continuous with the portion 2*d*1 of the opening 2*d* through which the hose 3 passes. Accordingly, by placing the hose 3 through the portion 2*d*2 for insertion of the handle 1, it is possible to arrange the extension pipe 6 and the hose 3 substantially in a straight line. This makes it possible to put the coupling member 2 so low as to make contact with the floor surface F, and thereby lower the position of the extension pipe 6. As a result, it is possible to insert the extension pipe 6 with ease into a narrow area such as a gap under a bed to perform cleaning.

At this time, the handle 1 is in the upright position, and therefore the user can move the nozzle unit 8 (see FIG. 48) with ease, with a reduced stoop and thus with a reduced burden on the user.

Figure 5:
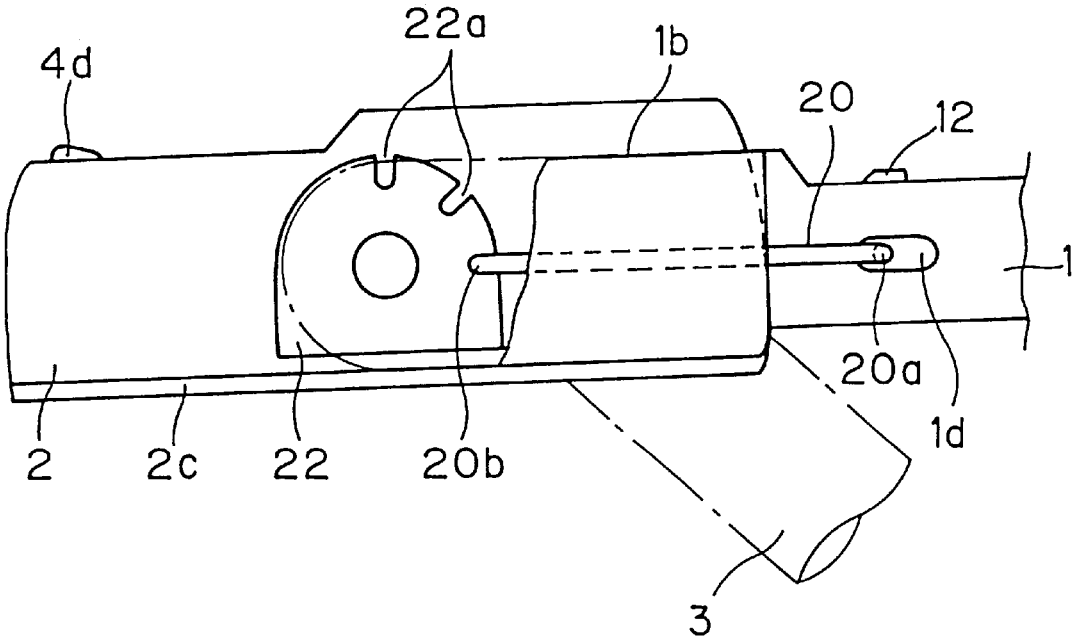
FIG. 5 is a side view of the handle of the electric vacuum cleaner of the first embodiment, illustrating its lock mechanism.

It is preferable to design the handle 1 to be lockable at a plurality of rotation positions, because this allows the user to select a suitable handle position. A lock mechanism for locking the handle 1 has, for example, a structure as shown in FIG. 5. In this figure, a lever 20 is coupled to the inner barrel 18 (see FIG. 2) in such a way that a pin 20*a* provided integrally with the lever 20 is movably placed in a slot id provided in the handle 1. On an outer wall of the coupling member 2, a locking plate 22 having a plurality of grooves 22*a* is provided.

A tip portion 20*b* of the lever 20 engages with one of the grooves 22*a* formed in the locking plate 22, and thereby the handle 1 is locked. When an unlocking button 12 is moved rightward as seen in FIG. 5, the pin 20*a* moves along the slot 1*d* together with the inner barrel 18, and thus the tip portion 20*b* is unlocked from the groove 22*a*, allowing rotation of the handle 1.

Figure 6:
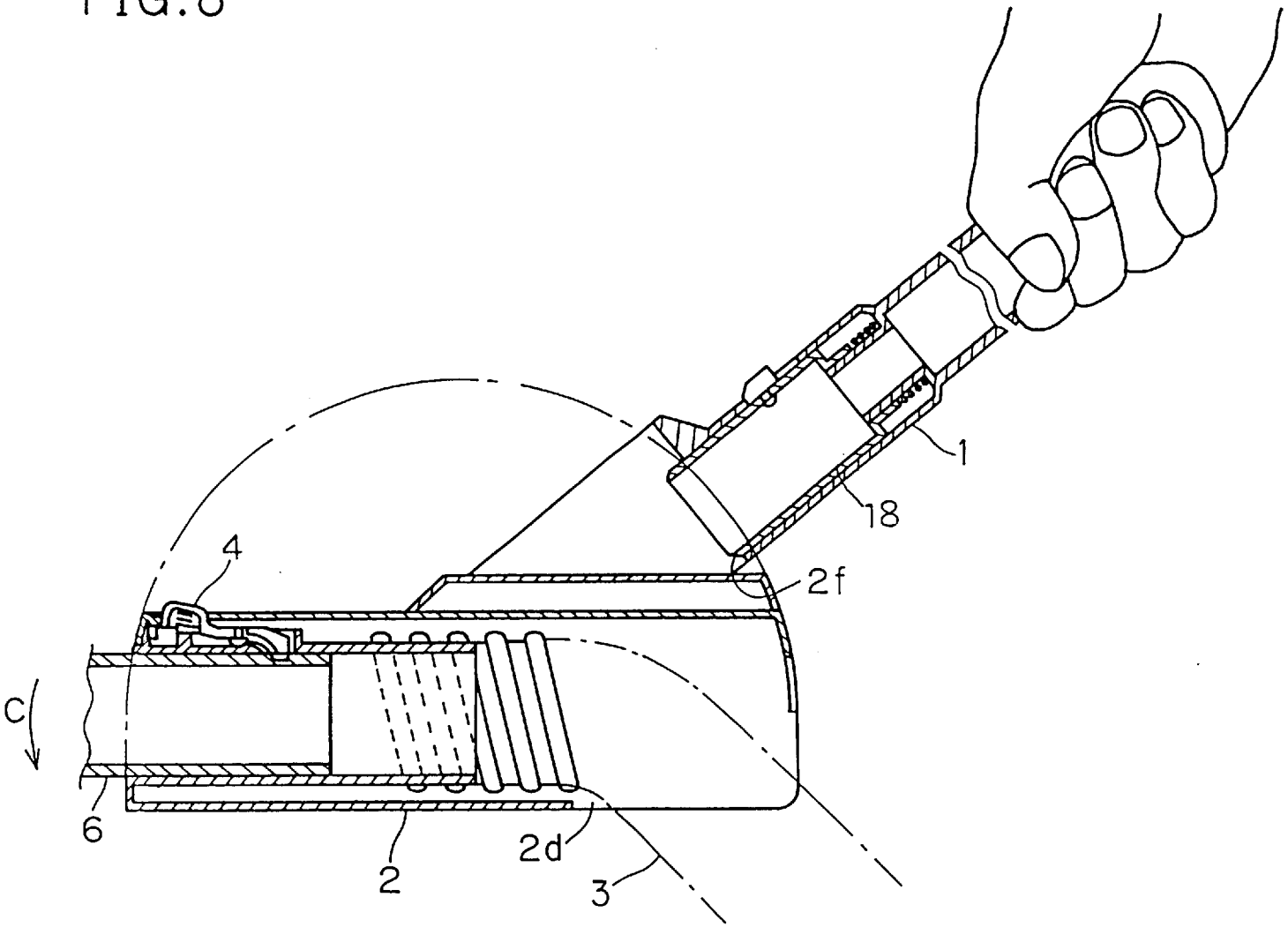
FIG. 6 is a diagram showing the state of the handle of the electric vacuum cleaner of the first embodiment when the lock mechanism is unlocked.

As shown in FIG. 6, when the user, after unlocking the handle 1, lifts the extension pipe 6 and the nozzle unit 8 while holding the handle 1, the extension pipe 6 rotates by its own weight in the direction indicated by the arrow C. At this time, a chamfered portion 2*f* provided in the inner barrel 18 strikes the coupling member 2, and thereby the inner barrel 18 is pressed to permit the handle 1 to return to the standard position. This structure is preferable, because it makes quick restarting of cleaning possible.

Figure 7A:
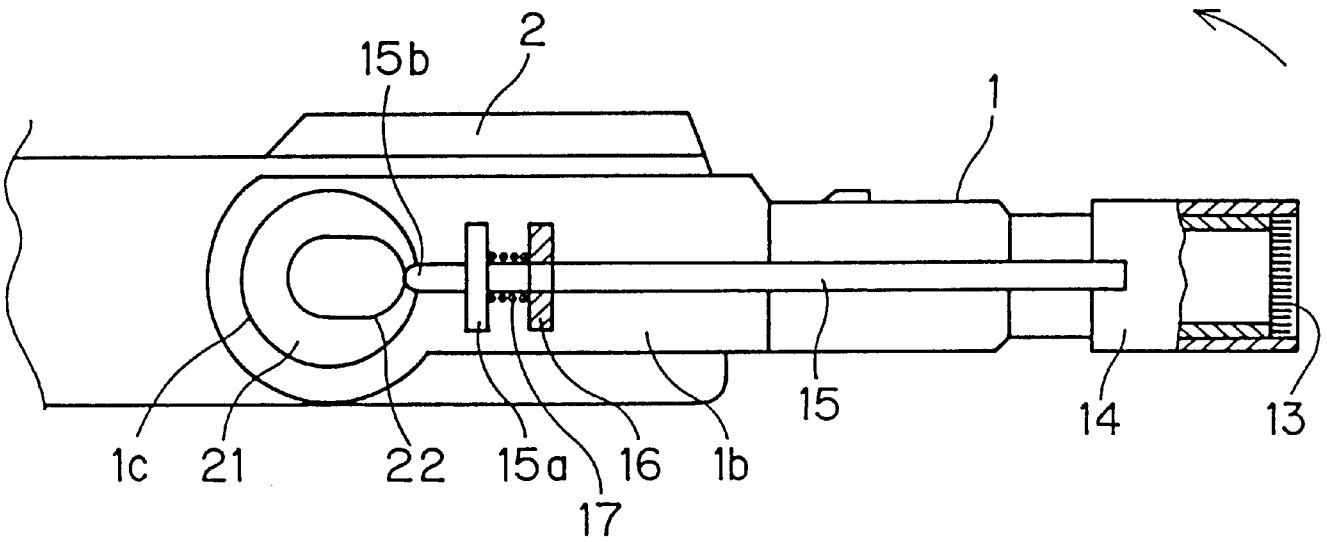
FIGS. 7A and 7B are side views of the handle of the electric vacuum cleaner of a second embodiment.

FIG. 7A is a side view of the handle of the electric vacuum cleaner of a second embodiment of the invention. In this embodiment, a brush 13 is provided in the handle 1 shown in FIG. 2. The handle 1 has a hole 1*c* formed in its mount 1*b*, and, into this hole 1*c*, a supporting shaft 21 is fitted so that the handle 1 is rotatable about the supporting shaft 21. At the free end of the handle 1, a brush 13 is formed. To allow the brush 13 to be covered, a covering member 14 is provided so as to be slidable relative to the handle 1.

The covering member 14 has a lever 15 provided integrally therewith. The lever 15 has a flange portion 15*a*, which is loaded, by a compression spring 17, with a force that tends to move it toward the supporting shaft 21 relative to a fixed plate 16 provided on the mount 1*b*. An end portion 15*b* of the lever 15 makes contact with a cam 22 that is provided on the supporting shaft 21 so as to protrude axially.

Figure 7B:
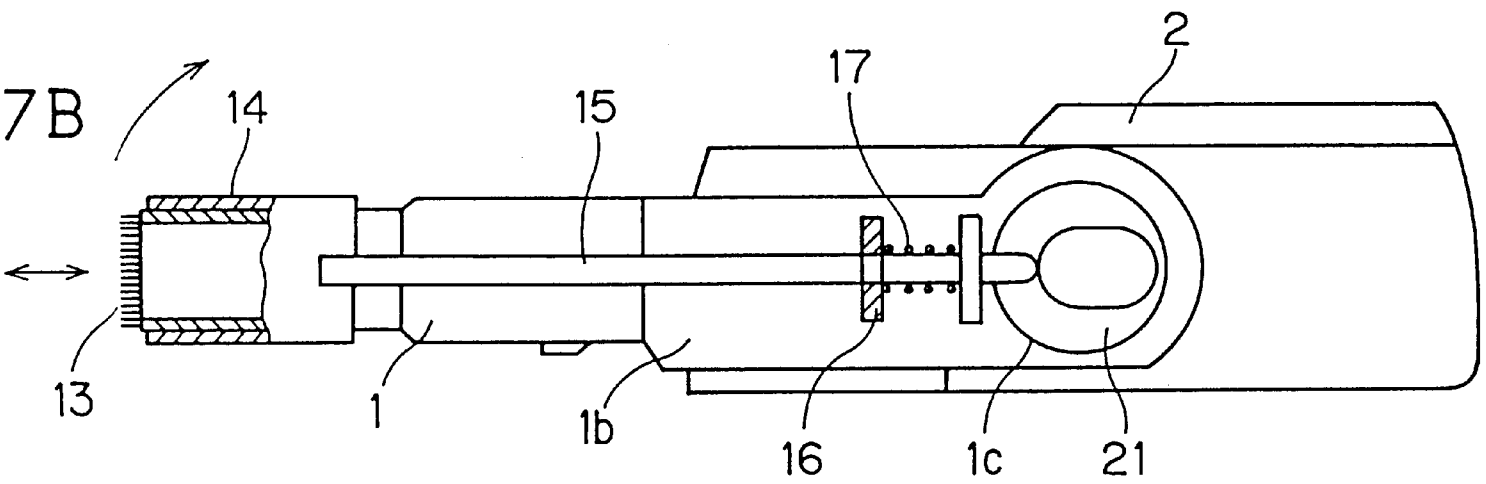

In the same manner as in the first embodiment shown in FIGS. 2 and 3, the extension pipe 6 (see FIG. 48) is removed from the coupling member 2. Next, when the handle 1 is rotated from the state shown in FIG. 7A in which the brush 13 is covered by the covering member 14, the covering member 14, pressed by the compression spring 17, retracts according to the shape, of the cam 21. The resulting state, in which the brush 13 is uncovered, is shown in FIG. 7B.

This makes it possible to use the handle 1 as a dusting brush, and thereby eliminates the need to take a dusting brush out of the body 9 of the electric vacuum cleaner (see FIG. 48) and fit it into the extension pipe connection aperture 2*a*. This enhances user-friendliness, and also helps prevent loss of a dusting brush. Moreover, since the brush 13, with dust and the like clung thereto, is kept covered when not in use, it does not spoil the appearance.

Figure 8A:
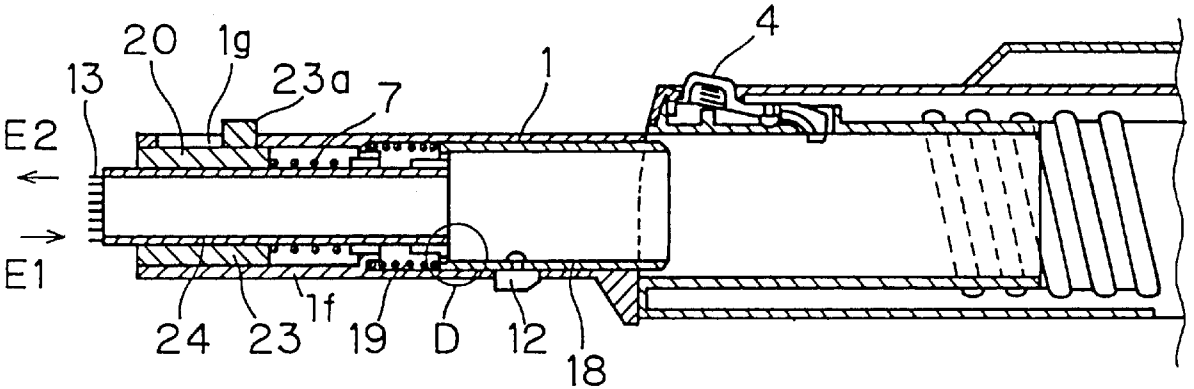
FIGS. 8A, 8B, and 8C are sectional views, as seen from the side, of the handle of the electric vacuum cleaner of a third embodiment.
Figure 8B:
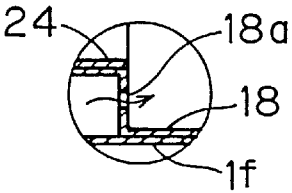
Figure 8C:
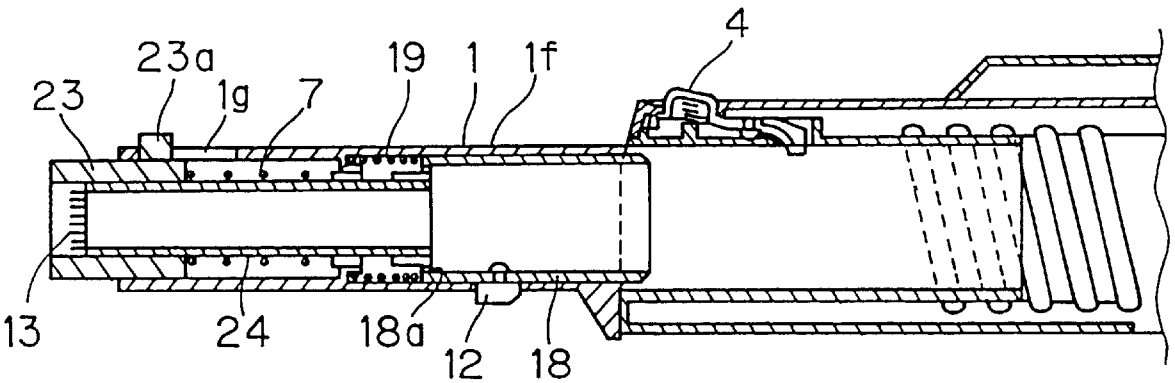

FIGS. 8A and 8C are sectional views, as seen from the side, of the principal portion of the handle of the electric vacuum cleaner of a third embodiment of the invention, and FIG. 8B is an enlarged view of the portion indicated by D in FIG. 8A. In this embodiment, a brush 13 is provided integrally with the inner barrel 18 of the handle 1 shown in FIG. 2. More specifically, the inner barrel 18 has a nozzle 24 formed integrally therewith, and, at the tip end of this nozzle 24, a brush 13 is provided. A covering member 23 is provided slidably between the nozzle 24 and the outer barrel if of the handle 1.

The covering member 23 has a stopper 23*a*. The stopper 23*a* slides along a slot 1*g* formed in the outer barrel 1*f*, and thereby restricts the movement stroke of the covering member 23. Moreover, the covering member 23 is loaded with a force that tends to move it so as to cover the brush 13 by a compression spring 7. As shown in FIG. 8B, the inner barrel 18 has an air inlet port 18*a* that permits the space between the nozzle 24 and the outer barrel 1*f* to communicate with the inside of the inner barrel 18.

In the same manner as in the first embodiment, the extension pipe 6 (see FIG. 48) is removed from the coupling member 2, and instead the handle 1 is rotated to that position. When the electric vacuum cleaner starts suction, the suction force acts on the covering member 23 through the air inlet port 18*a*. As a result, the covering member 23 moves in the direction indicated by the arrow E1 so as to uncover the brush 13. When the electric vacuum cleaner stops suction, the compression spring 7 causes the covering member 23 to move in the direction indicated by the arrow E2. The resulting state, in which the brush 13 is covered by the covering member 23, is shown in FIG. 8C.

This structure serves the same purpose as that of the second embodiment. In addition, in cleaning using the dusting brush, it is possible to keep the dusting brush 13, with dust and the like clung thereto, covered even in temporary suspension of dust suction so that the dusting brush 13 does not spoil the appearance.

Figure 9A:
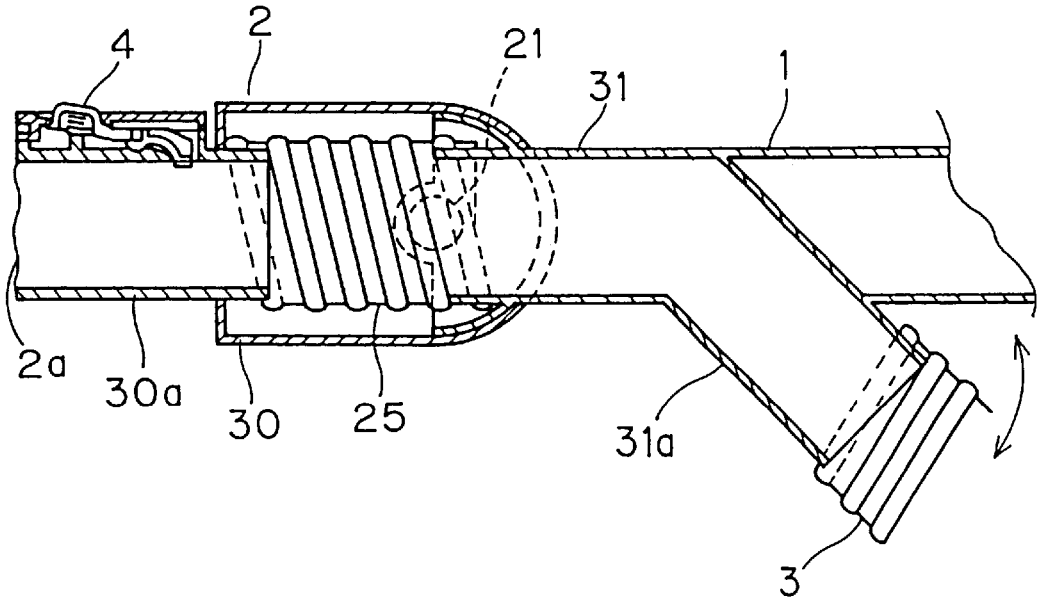
FIGS. 9A and 9B are sectional views, as seen from the side, of the handle of the electric vacuum cleaner of a fourth embodiment.
Figure 9B:
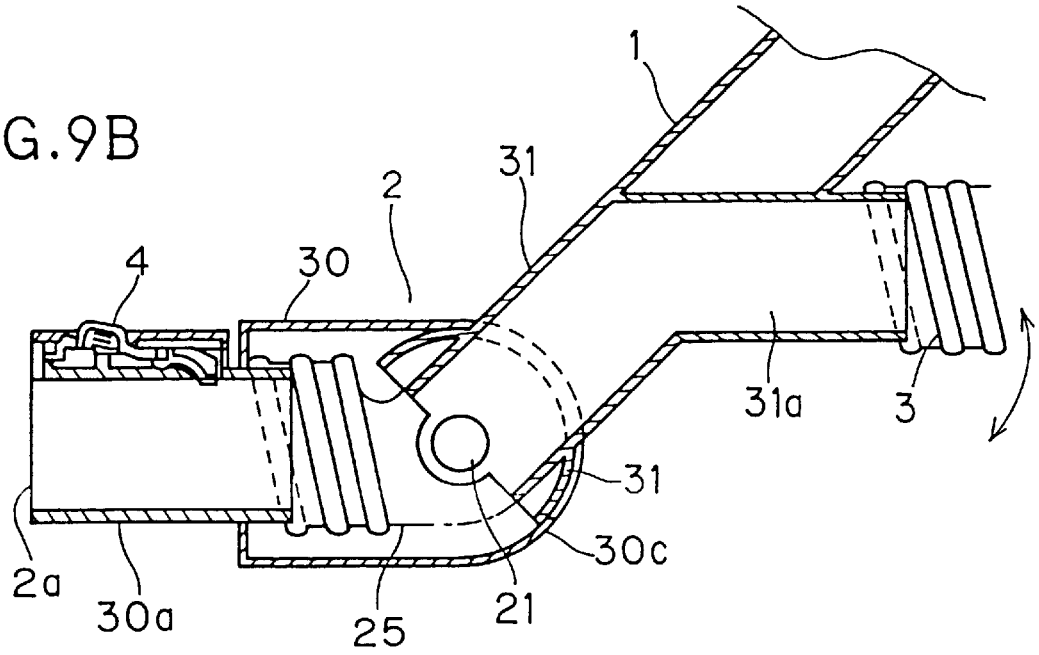

FIGS. 9A and 9B are sectional views, as seen from the side, of the principal portion of the handle of the electric vacuum cleaner of a fourth embodiment of the invention. A coupling member 2 is composed of a fixed portion 30 and a rotatable portion 31. The fixed portion 30 has an extension pipe connection portion 30*a* in which an extension pipe connection aperture 2*a* is formed. The extension pipe connection portion 30*a* has a lock mechanism 4, similar to the one shown in FIG. 2, for locking an extension pipe 6 (see FIG. 48). The rotatable portion 31 rotates about a supporting shaft 21 while sliding along a cylindrical surface 30*c* of the fixed portion 30. The rotatable portion 31 and the extension pipe connection portion 30*a* are coupled together by a hose 25.

Moreover, the rotatable portion 31 has a hose connection aperture 31*a* to which the hose 3 is connected. A handle 1 is formed integrally with the rotatable portion 31. The hose 3 and the handle 1 rotate together, and can be locked in a desired position by a lock mechanism (not shown).

In this embodiment, connecting together the rotatable portion 31 and the extension pipe connection portion 30*a* with a flexible hose 25 makes it possible to change easily the angle of the handle 1, which is integral with the hose 3. Thus, as in the first embodiment, by rotating the handle 1 to keep it in an upright position relative to the fixed portion 30 when, for example, cleaning is suspended for a while, it is possible to increase the height from the floor surface to the freeend surface (not shown) of the handle 1. This reduces the stoop that the user needs to make to hold the handle 1 when restarting cleaning, and thereby reduces the burden on the user.

Moreover, in cleaning of a gap below a bed or the like, it is possible to set the handle 1 at a desired angle and thereby allow the user to move the nozzle unit 8 (see FIG. 48) with ease with a reduced stoop. Thus, it is possible to reduce the burden on the user.

Figure 10:
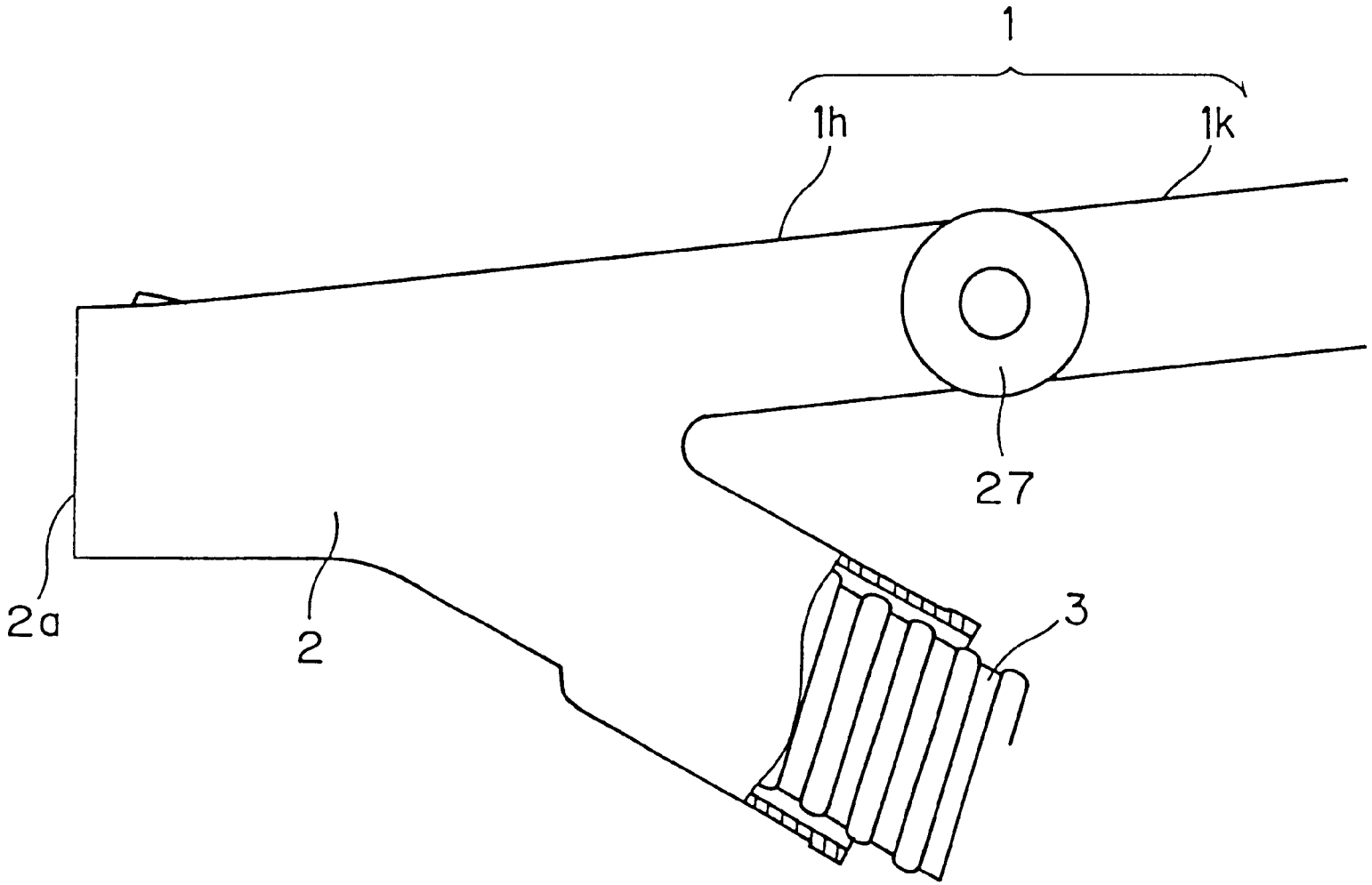
FIG. 10 is a side view of the handle of the electric vacuum cleaner of a fifth embodiment.

FIG. 10 is a side view of the principal portion of the handle of the electric vacuum cleaner of a fifth embodiment of the invention. A handle 1 is formed integrally with a coupling member 2, and the handle 1 is divided axially into a front portion 1*h* and a rear portion 1*k*. The rear portion 1*k* is supported by a supporting member 27 so as to be rotatable relative to the front portion 1*h*, and the ear portion 1*k* is lockable at a desired angle. This makes it possible to change easily the angle of the handle 1 and thereby achieve the same purpose as achieved in the fourth embodiment.

Figure 11A:
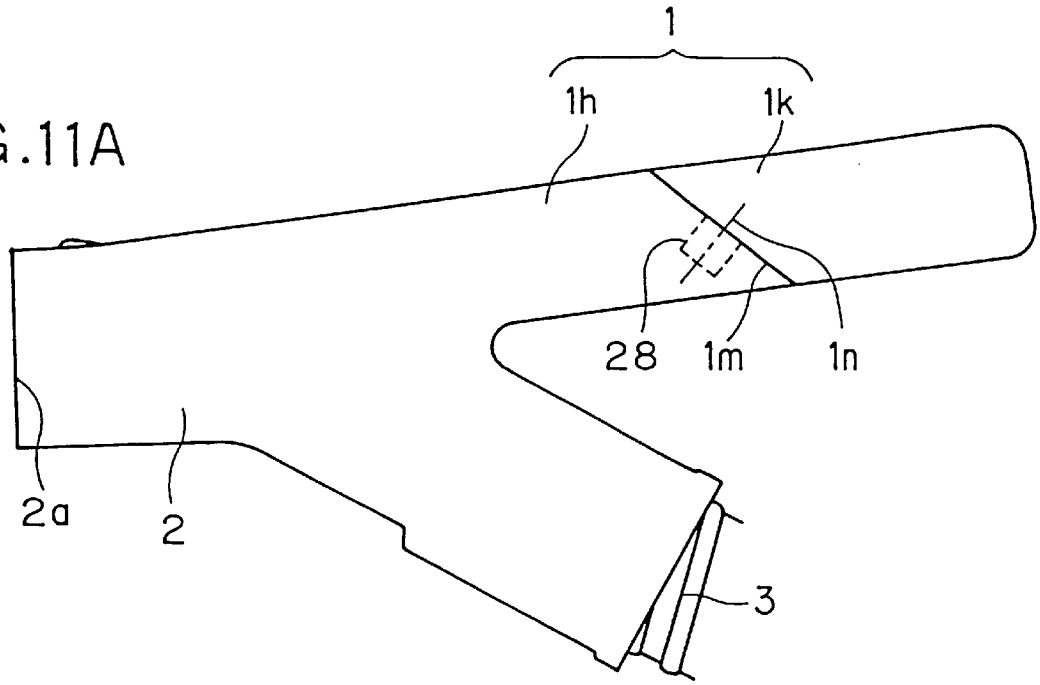
FIGS. 11A and 11B are side views of a principal portion of the handle of the electric vacuum cleaner of a sixth embodiment.
Figure 11B:
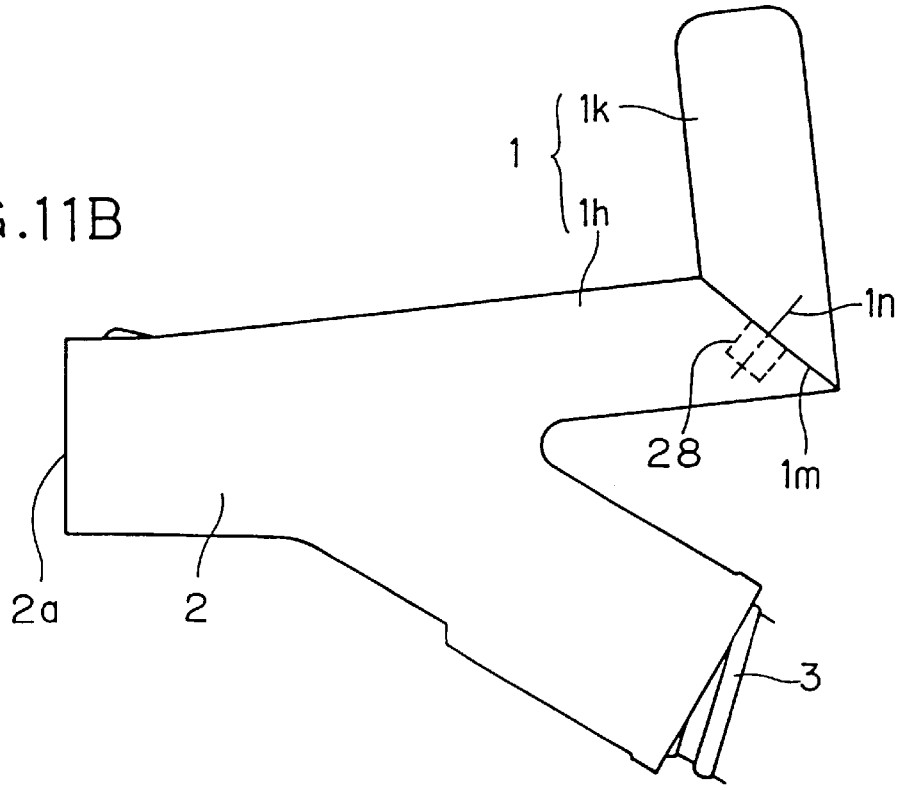

FIGS. 11A and 11B are side views of the principal portion of the handle of the electric vacuum cleaner of a sixth embodiment of the invention. A handle 1 is formed integrally with a coupling member 2, and the handle 1 is divided axially into a front portion 1*h* and a rear portion 1*k*, with an inclined interface 1*m* between them. The rear portion 1*k* is supported by a supporting member 28 so as to be rotatable about an axis in perpendicular to the inclined interface 1*m*. The rear portion 1*k* can be rotated and locked, for example, with the handle 1 in a bent state, as shown in FIG. 11B. This makes it possible to change easily the angle of the handle 1 and thereby achieve the same purpose as achieved in the fourth embodiment.

Figure 12:
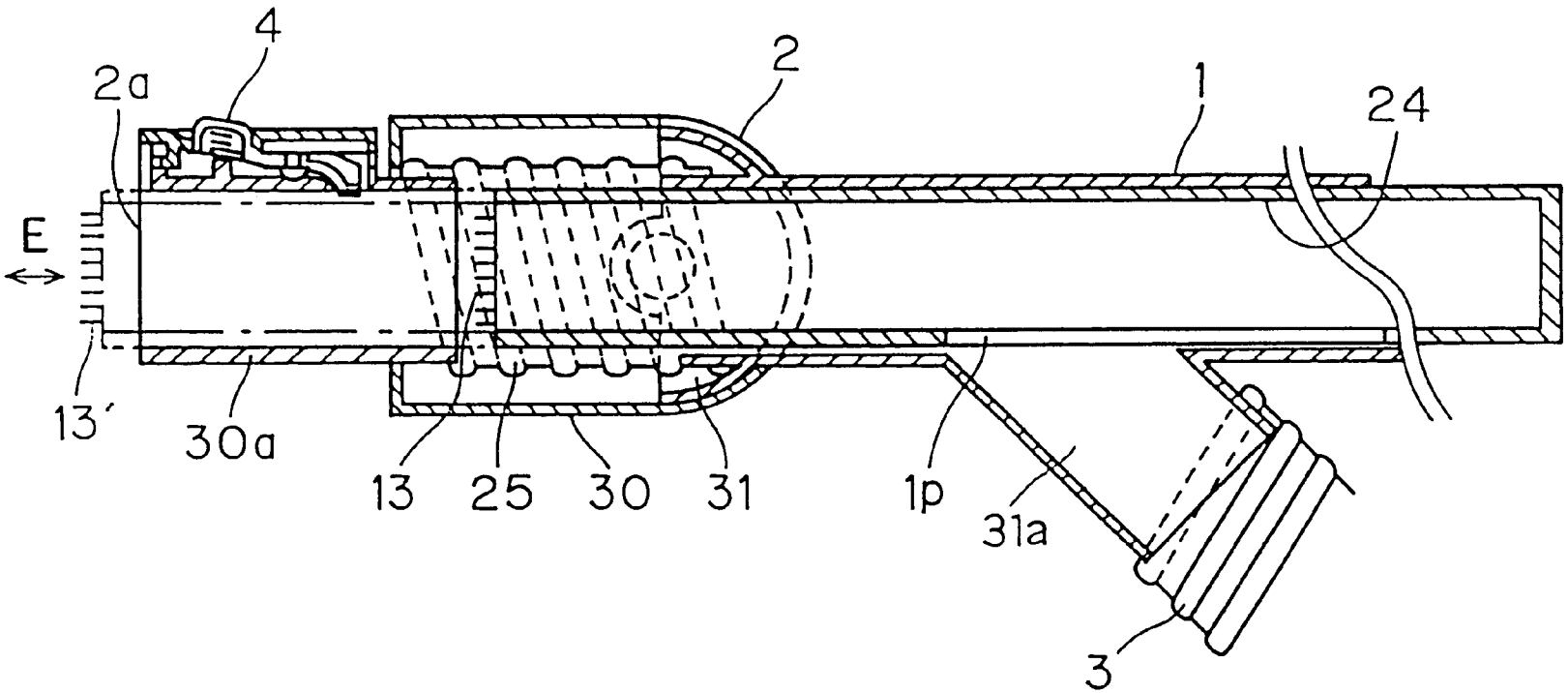
FIG. 12 is a sectional view, as seen from the side, of the handle of the electric vacuum cleaner of a seventh embodiment.

FIG. 12 is a sectional view, as seen from the side, of the handle of the electric vacuum cleaner of a seventh embodiment of the invention. In this embodiment, inside the handle 1 of the electric vacuum cleaner of the fourth embodiment shown in FIG. 9, a nozzle 24 slidable in the direction indicated by the arrow E is provided. At the tip end of the nozzle 24, a brush 13 is formed. Moreover, the nozzle 24 has an opening 1*p* formed so as to open to a hose connection portion 31*a*. Accordingly, the air sucked in through an extension pipe connection aperture 2*a* flows through this opening 1*p* to the hose 3.

As shown in FIG. 12, when the handle 1 is placed in the standard position, the extension pipe connection portion 30*a* and the handle 1 are arranged in a straight line. By removing the extension pipe 6 (see FIG. 48) and thereby pressing the nozzle 24 toward the extension pipe connection aperture 2*a*, the brush 13 is uncovered from the coupling member 2 as indicated by the dash-and-dot lines 13'. At this time, a lock mechanism 4 locks the nozzle 24 in the same way as it locks the extension pipe 6. Thus, the air sucked through the brush 13 flows through the opening 1*p* to the hose 3.

This structure makes it possible to use the handle 1 as a dusting brush as in the second embodiment, and thereby eliminates the need to take a dusting brush out of the body 9 of the electric vacuum cleaner (see FIG. 48) and fit it into the extension pipe connection aperture 2*a*. This enhances user-friendliness, and also helps prevent loss of a dusting brush. Moreover, since the brush 13, with dust and the like clung thereto, is kept covered when not in use, it does not spoil the appearance.

Figure 13:
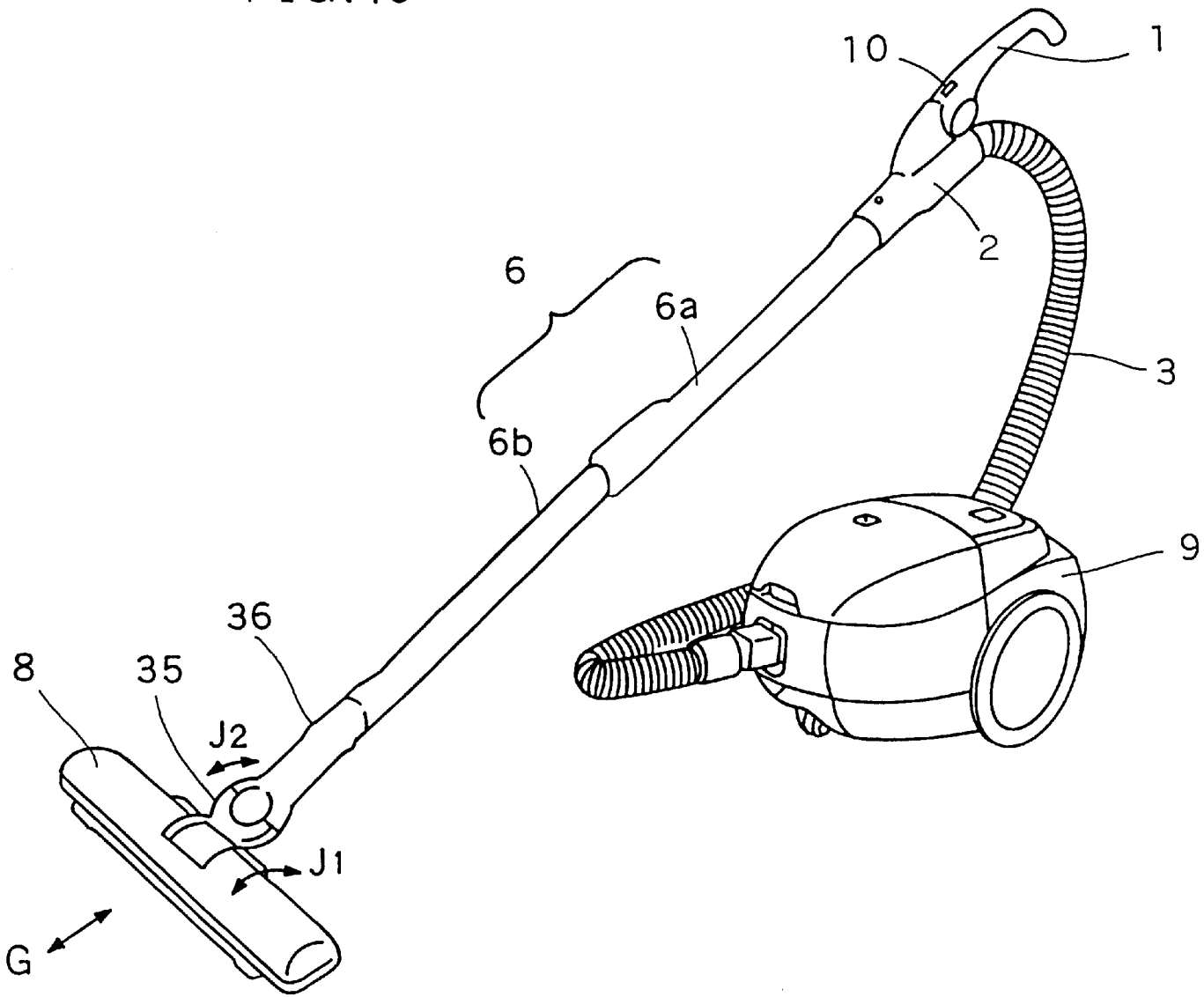
FIG. 13 is a schematic overall view of the electric vacuum cleaner of an eighth embodiment.

FIG. 13 is an external view of the electric vacuum cleaner of an eighth embodiment of the invention. By a nozzle unit 8 having a nozzle (not shown), a first pipe 35 is supported so as to be rotatable in the direction indicated by the arrow J1. By the first pipe 35, a second pipe 36 is supported so as to be rotatable in the direction indicated by the arrow J2. To the second pipe 36, an extension pipe 6 is connected. The extension pipe 6 is divided into a front portion 6*a* and a rear portion 6*b*.

To a body 9 of the electric vacuum cleaner, a hose 3 is connected. To the end of the hose 3, a coupling member 2 is coupled that has a handle 1 to be held by the user and an operation switch 10 to be operated to control the operation of the electric vacuum cleaner. The coupling member 2 is coupled to the extension pipe 6, and thus dust suction from the nozzle is achieved.

Figure 14:
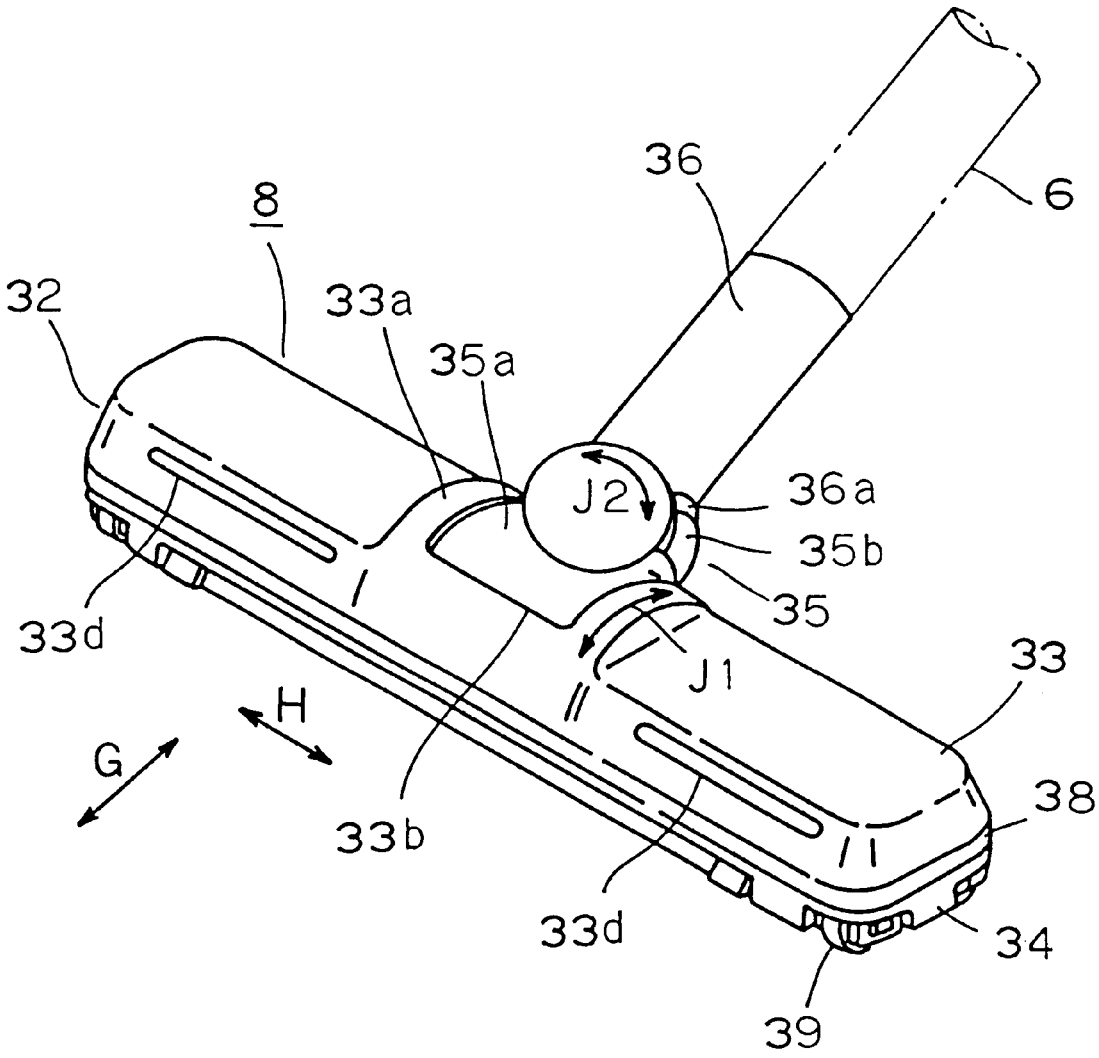
FIG. 14 is a schematic perspective view of the nozzle unit of the electric vacuum cleaner of the eighth embodiment.
Figure 15:
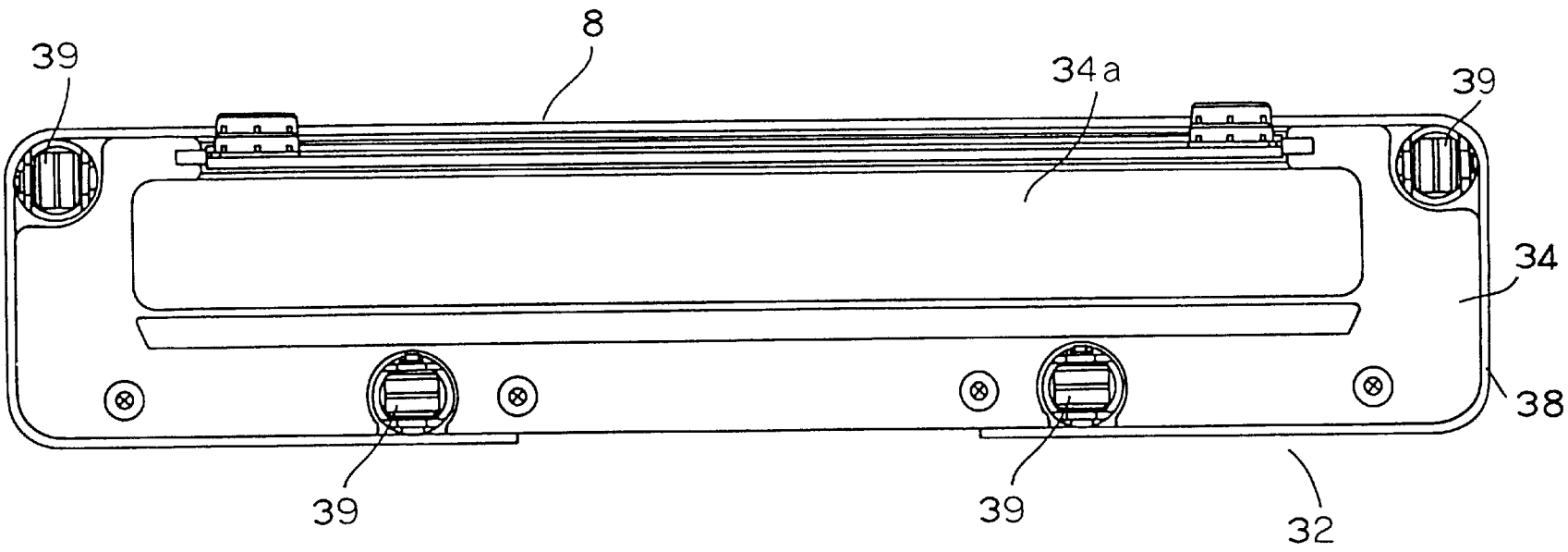
FIG. 15 is a bottom view of the nozzle unit of the electric vacuum cleaner of the eighth embodiment.

FIGS. 14 and 15 are a perspective view and a bottom view showing the detail of the nozzle unit 8. The nozzle unit 8 has a body case 32, which is composed of a lower case 34 having a nozzle 34*a* formed in its bottom surface, an upper case 33 to which the first pipe 35 is coupled, and a bumper 38 fitted between the upper and lower cases 33 and 34. The bumper 38 protects the nozzle unit 8 from scratches and cracks that may result from its collision with a wall or a piece of furniture.

Figure 16:
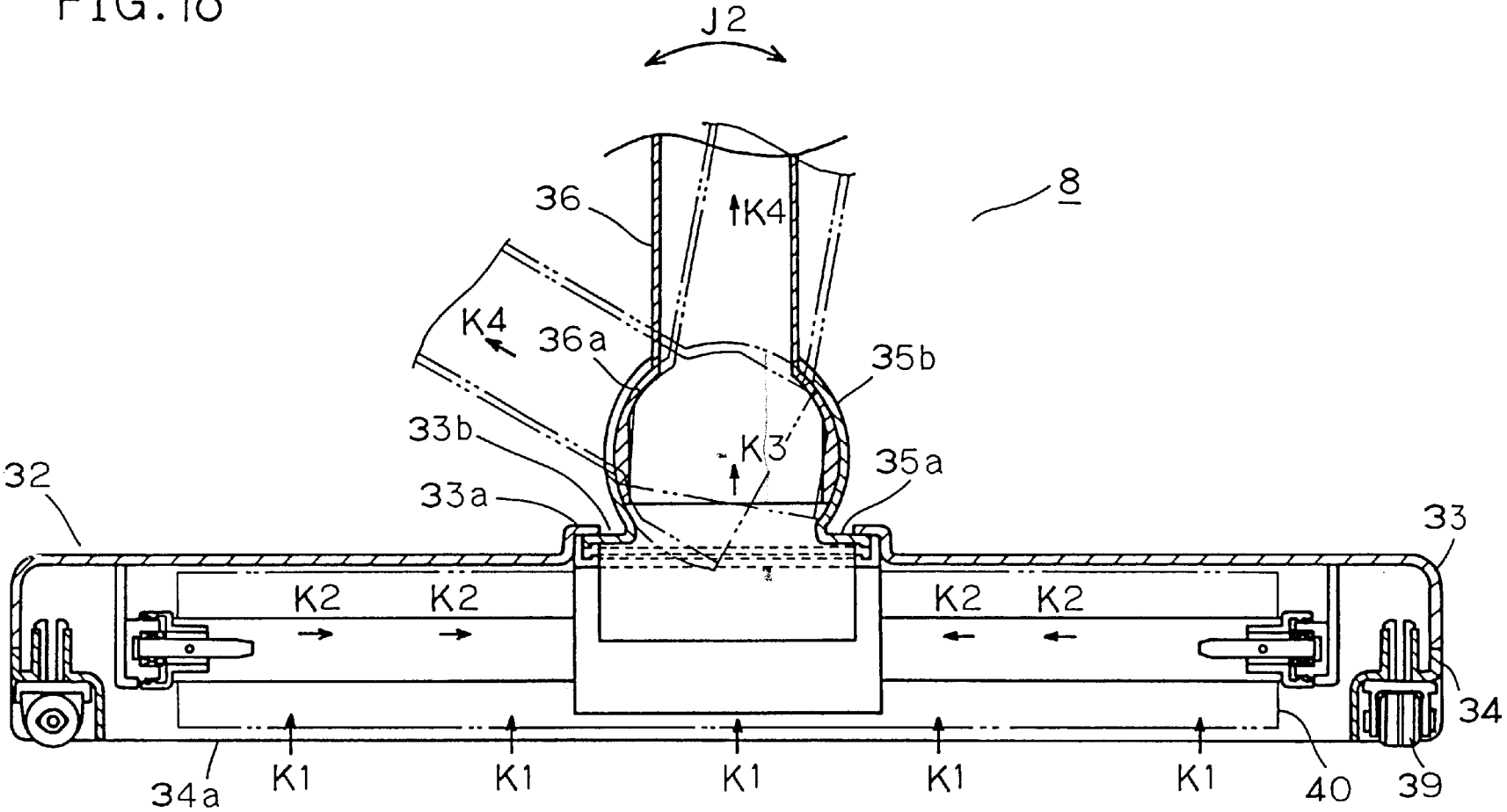
FIG. 16 is a sectional view, as seen from the front, of the nozzle unit of the electric vacuum cleaner of the eighth embodiment.

On the bottom surface of the lower case 34, casters 39 are provided at four locations so as to roll on the floor surface and thereby allow movement of the nozzle unit 8. Moreover, as shown in FIG. 16, which is a sectional view as seen from the front, inside the nozzle unit 8, a rotary brush 40 is provided. In the upper case 33, an air inlet 33*d* (see FIG. 14) is provided to allow air to be sucked in to make the rotary brush 40 rotate.

The first pipe 35 has a sliding portion 35*a* having an arc-shaped cross section that slides along the inner surface of a guide portion 33*a* having an arc-shaped cross section provided in the upper case 33. As a result, the first pipe 35 is so supported as to be rotatable in the direction indicated by the arrow J1 within an opening 33*b*. The second pipe 36 has a sliding portion 36*a* that slides along the inner surface of a supporting portion 35*b* provided in the first pipe 35. As a result, the second pipe 36 is so supported as to be rotatable in the direction indicated by the arrow J2.

Figure 17:
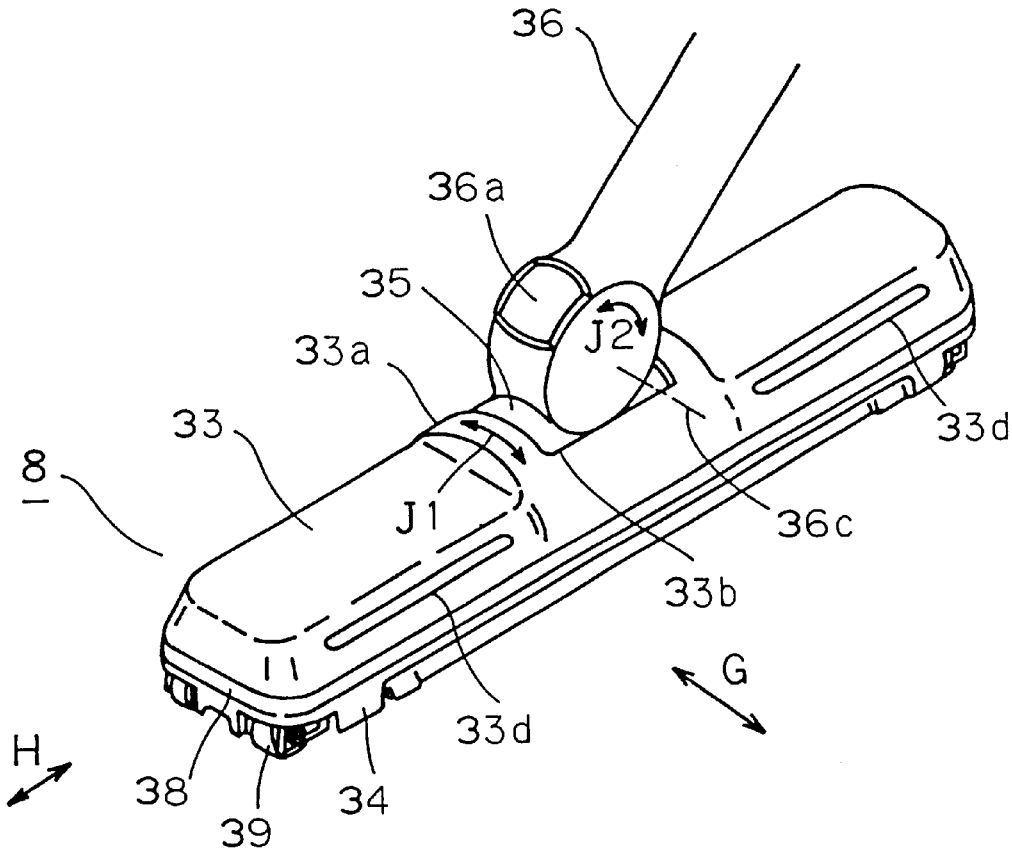
FIG. 17 is a schematic perspective view showing the state of the nozzle unit of the electric vacuum cleaner of the eighth embodiment when it is ready for cleaning in another direction.

Thus, it is possible to change the elevation (depression) angle of the extension pipe 6 as the nozzle unit 8 is moved in the direction indicated by G (in the direction of the depth, or the shorter sides, of the nozzle unit 8) by rotation of the first pipe 35. (Hereinafter, this position of the nozzle unit will be referred to as the "lateral position"). Moreover, as shown in FIG. 17, it is possible to change the elevation (depression) angle of the extension pipe 6 also as the nozzle unit 8 is moved in the direction indicated by H (in the direction of the width, or the longer sides, of the nozzle unit 8) by rotation of the second pipe 36. (Hereinafter, this position of the nozzle unit will be referred to as the "longitudinal position"). In FIG. 17, reference numeral 36*c* represents the rotation axis of the second pipe 36.

In FIG. 16 described previously, the air sucked in through the nozzle 34*a* and flowing in the direction indicated by the arrow K1 then flows in the direction indicated by the arrow K2 toward the first pipe 35. The air then flows through the first and second pipes 35 and 36 as indicated by the arrows K3 and K4, then flows through the extension pipe 6, and then reaches the body 9 of the electric vacuum cleaner. Here, the first and second pipes 35 and 36 are coupled together in such a way that the air flow passages (K3 and K4) through the first and second pipes 35 and 36 are arranged in a straight line when the nozzle unit 8 is used in the lateral position. In addition, the rotation axis 36*c* of the second pipe 36 is kept perpendicular to the air flow passage (K3) through the first pipe 35.

Figure 18:
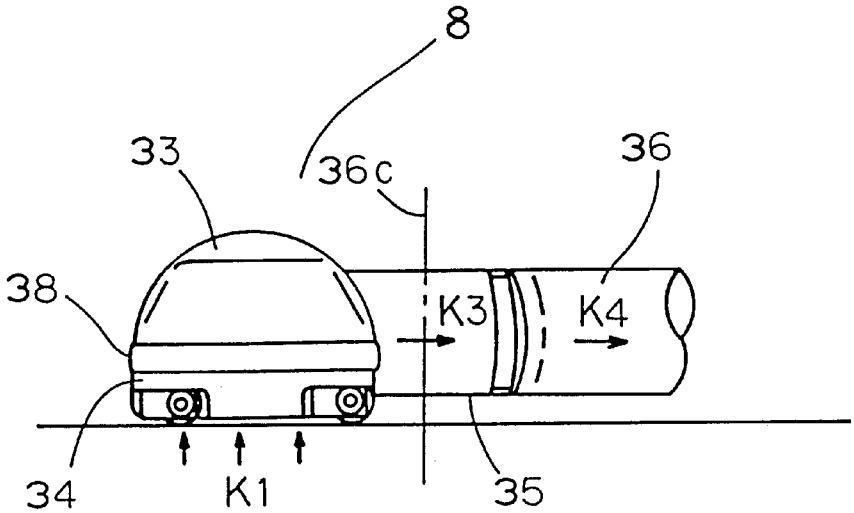
FIG. 18 is a side view of the nozzle unit of the electric vacuum cleaner of the eighth embodiment.

Thus, when the nozzle unit 8 is used in the lateral position (see FIG. 14), which is more frequently the case than otherwise, the air flow passage of the sucked air toward the extension pipe 6 has no bend at all. This makes it possible to reduce the loss in suction pressure and thereby increase suction efficiently, and also to reduce noise. Moreover, as shown in FIG. 18, which is a side view, even when the second pipe 36 is rotated about the rotation axis 36*c* relative to the first pipe 35, the air flow passages (K3 and K4) through the first and second pipes 35 and 36 are kept arranged in a straight line all the time. Thus, when the first pipe 35 is in the upright position, the second pipe 36 rotates within a plane perpendicular to the floor surface.

Figure 19:
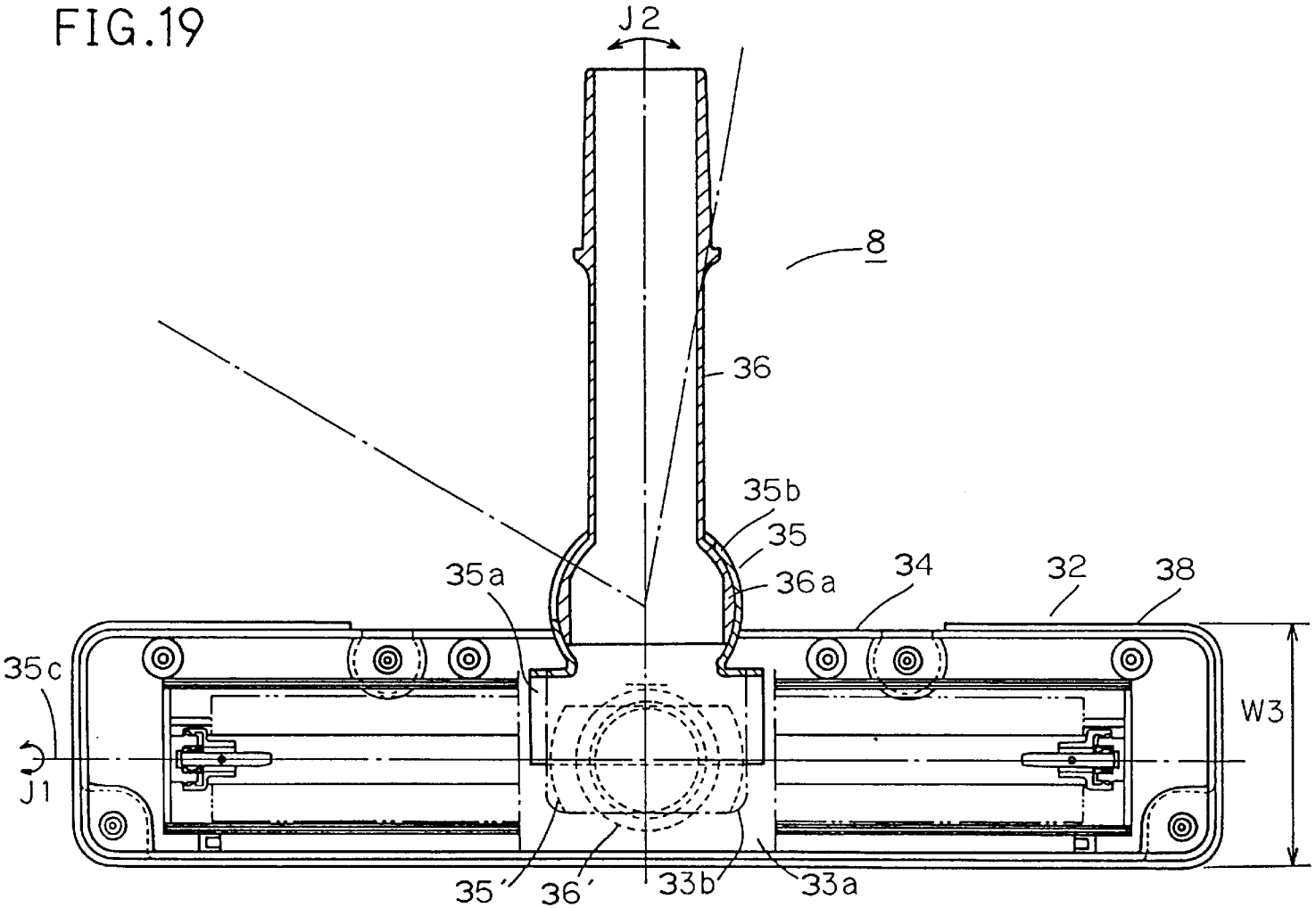
FIG. 19 is a top view of the nozzle unit of the electric vacuum cleaner of the eighth embodiment.
Figure 49:
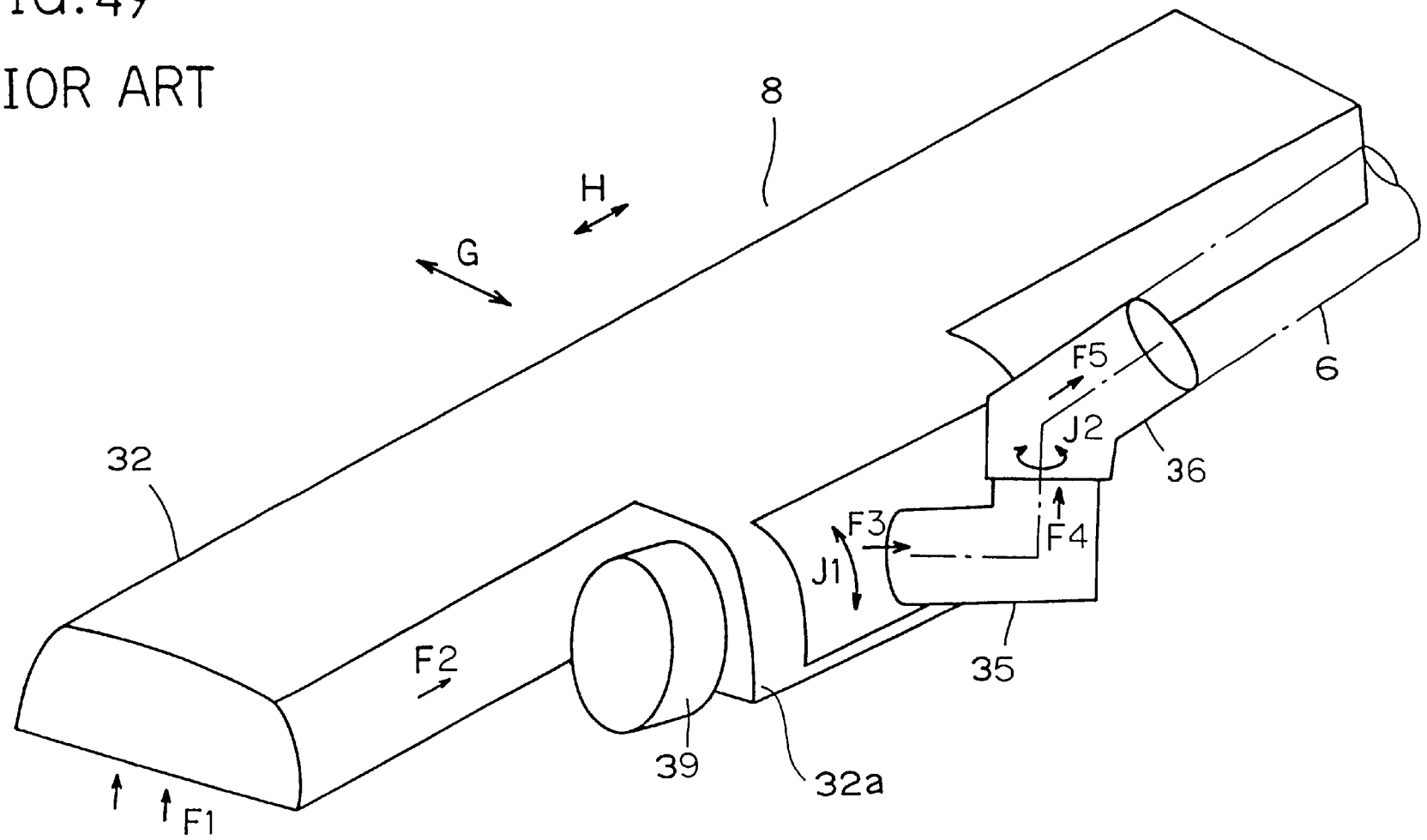
FIG. 49 PRIOR ART
FIG. 49 is a schematic perspective view of the nozzle unit of a conventional electric vacuum cleaner.
Figure 50:
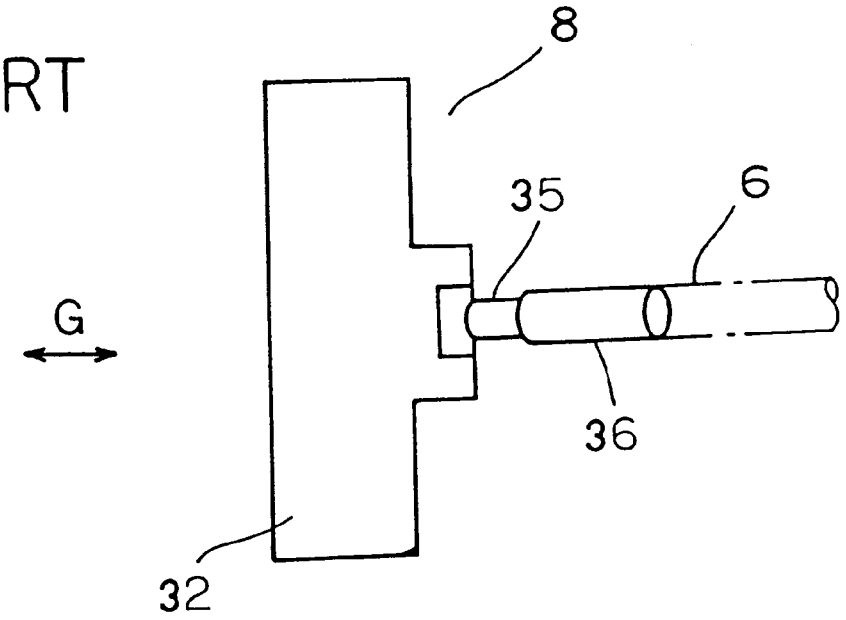
FIG.50 PRIOR ART
FIG. 50 is a schematic top view showing the state of the nozzle unit of a conventional electric vacuum cleaner when it is in the lateral position.
Figure 51:
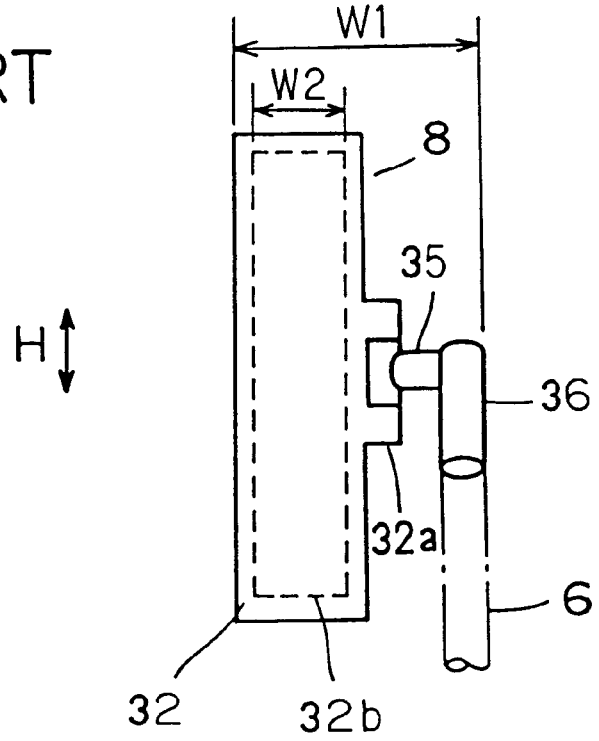
FIG.51 PRIOR ART
FIG. 51 is a schematic top view showing the state of the nozzle unit of a conventional electric vacuum cleaner when it is in the longitudinal position.

FIG. 19 is a top view of the nozzle unit 8 with the upper cover 33 removed. The sliding portion 35*a* of the first pipe 35 is arranged inside the body case 32, which is substantially rectangular, as seen from above. Moreover, the first pipe 35 has a rotation axis 35c substantially at the center of the depth W3 (i.e. the shorter sides) of the body case 32. Accordingly, there is no need to provide a protruding coupling portion 32*a* (see FIG. 49) as is provided in the conventional example, and thus it is possible to reduce the depth W3 of the nozzle unit 8 and thereby make the nozzle unit 8 compact and light-weight. Furthermore, when the nozzle unit 8 is used in the longitudinal position, there exists no obstacle like the coupling portion 32*a*, and thus it is possible to achieve enhanced user-friendliness.

Moreover, the rotation axis 36*c* (see FIG. 17) of the second pipe 36 lies substantially at the center of the nozzle unit 8 in the direction of the longer sides thereof. This ensures that, when the nozzle unit 8 is used in the longitudinal position, the applied force is borne substantially at the center of the body case 32. As a result, a proper balance is obtained when the nozzle unit 8 is moved back and force in the direction H (see FIG. 17). This helps reduce staggering motion of the nozzle unit 8 and thereby enhance user-friendliness. In FIG. 19, when the first pipe 35 is held in the vertical position relative to the floor surface, the first and second pipes 35' and 36', as indicated by the broken lines, are arranged within the body case 32 in the direction of its depth. This makes it possible to perform cleaning of an area as narrow as the width W3 of the body case 32.

Figure 20:
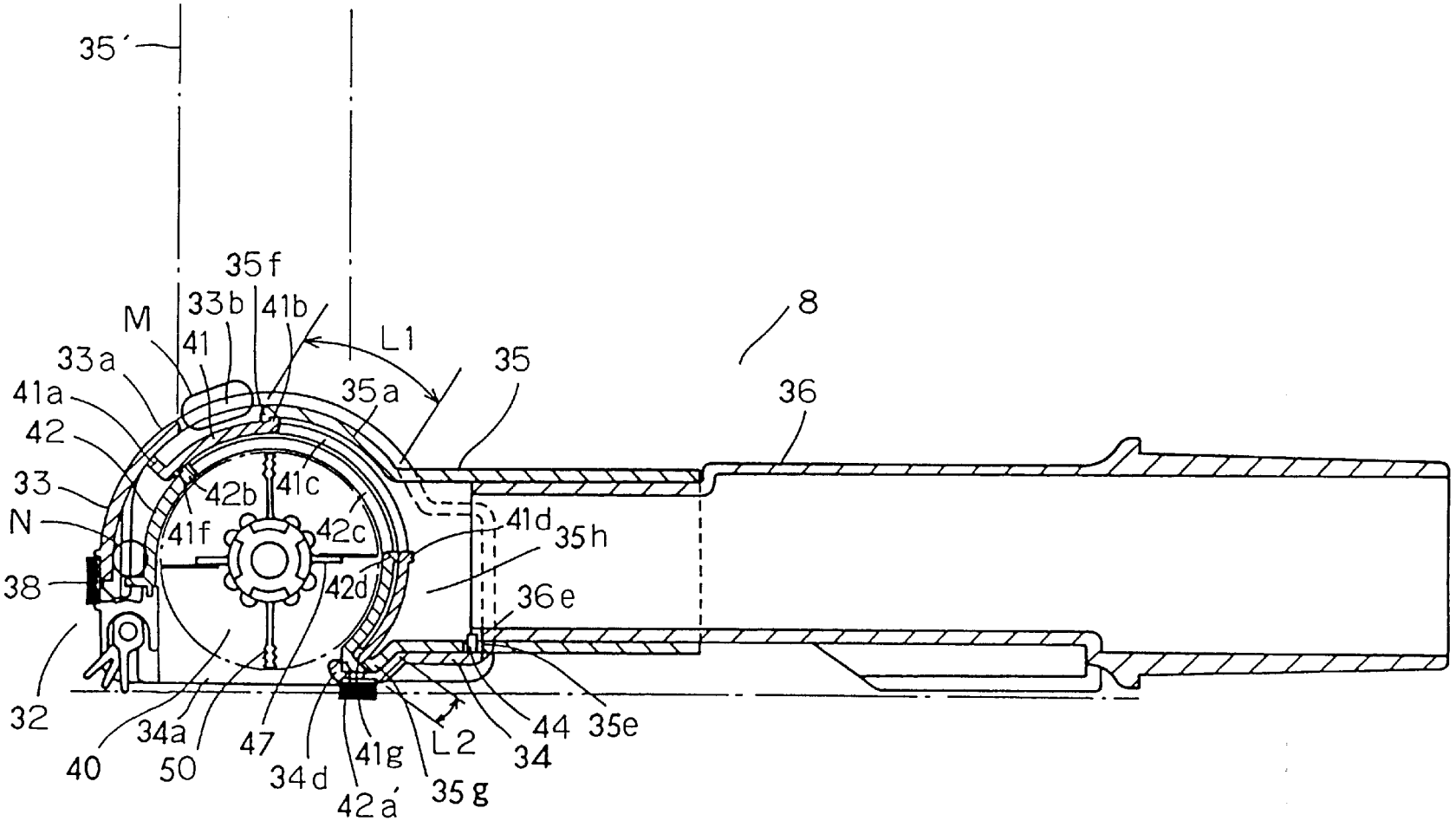
FIG. 20 is a sectional view, as seen from the side, of the nozzle unit of the electric vacuum cleaner of the eighth embodiment.

In FIG. 19 and in FIG. 18 described previously, the first pipe 35 is substantially parallel to the floor surface. This makes it possible to insert the nozzle unit 8 with ease deep into a narrow area such as a gap below a bed, and thus leads to enhanced user-friendliness. In this way, the first pipe 35 is rotatable from a position substantially parallel to the floor surface to a position substantially perpendicular thereto. This is achieved by a rotation mechanism having a structure as shown in FIG. 20, which is a sectional view thereof as seen from the side.

As described previously, to allow rotation of the first pipe 35, the sliding portion 35*a* of the first pipe 35 slides along the inner surface of the guide portion 33*a* of the upper case 33. To allow rotation from a position as shown in FIG. 20 in which the first pipe 35 is substantially parallel to the floor surface to a position in which it is substantially perpendicular thereto as indicated by the dash-and-dot lines 35', the opening 33*b* of the upper case 33 needs to be considerably large.

The lengths L1 and L2 of the front and rear portions of the sliding portion 35*a* have limits because of the first pipe 35 colliding with the upper and lower cases 33 and 34. Accordingly, between the opening 33*b* and the sliding portion 35*a*, an opening, for example as indicated by M, is formed in an upper portion of the body case 32. When the first pipe 35 is in the vertical position, a similar opening is formed in a rear portion (i.e. on the right in FIG. 20) of the body case 32.

Figure 21:
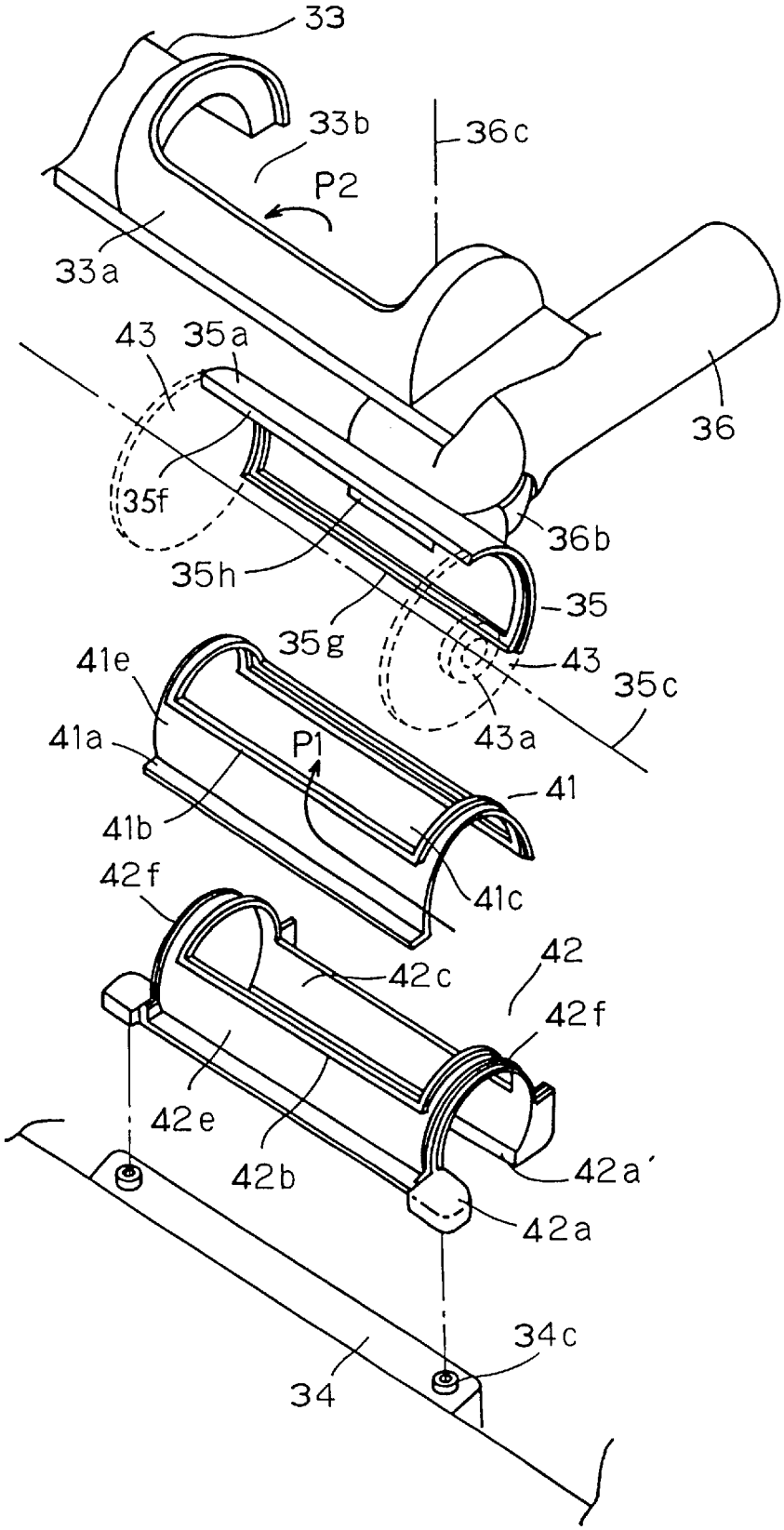
FIG. 21 is an exploded perspective view showing an example of the structure of the rotation mechanism of the nozzle unit of the electric vacuum cleaner of the eighth embodiment.

To prevent such an opening (for example the opening indicated by M) from communicating with the air flow passage of the flow of air sucked in through the nozzle 34*a*, an engagement member 41 and a fixed member 42 as shown in FIG. 21, which is an exploded perspective view of the rotation mechanism, are provided. The fixed member 42 has an arc-shaped cross section. A fitting portion 42*a*' formed at one end of the fixed member 42 engages with an engagement portion 34*d* (see FIG. 20) of the lower case 34, and a fitting portion 42*a* formed at the other end thereof is fitted into projections 34*c* provided on the lower case 34 in such a way as to pull the fixed member 42, which has resilience like a plate spring. In this way, the fixed member 42 is fixed securely. The engagement member 41 has an arc-shaped cross section, and is so arranged as to slide along the inner surface of the sliding portion 35*a* of the first pipe 35 and along the outer surface of the fixed member 42.

Here, since there is no coupling portion 32*a* as is provided in the conventional example (see FIG. 49), it is not possible to provide circular side plates 43 on the sliding portion 35*a*. Therefore, the sliding potion 35*a* and the engagement member 41 are held by being sandwiched between the guide portion 33*a* of the upper case 33 and the fixed member 42 fixed to the lower case 34. This helps prevent deformation in the arc-shaped cross sections of the sliding portion 35*a* and the engagement portion 41 and thereby obtain smooth rotation.

The engagement member 41 and the fixed member 42 have cylindrical surfaces 41*e* and 42*e* and openings 41*c* and 42*c*. Through these openings 41*c* and 42*c*, the flow of the sucked air flows to the inside of the first pipe 35. The fixed member 42 has flanges 42*f* formed at both sides thereof. These flanges 42*f* make contact with the inner surface of the guide portion 33*a*. This helps shut off the flow of air that flows from the sides of the engagement member 41 along the outer surface of the engagement member 41 to the opening 33*b* as indicated by the arrows P1 and P2, and thereby prevent leakage of the sucked air.

In accordance with the rotation angle of the first pipe 35, engagement claws 41*b* and 41*d* (see FIG. 20) provided on the engagement member 41 engage with engagement claws 35*f* and 35*g* provided on the sliding portion 35*a*. This allows rotation of the engagement member 41. On the other hand, engagement claws 41*f* and 41*g* provided on the inner surface of the engagement member 41 engage with engagement claws 42*b* and 42*d* (see FIG. 20) provided on the fixed member 42. This restricts rotation of the engagement member 41.

Figure 22:
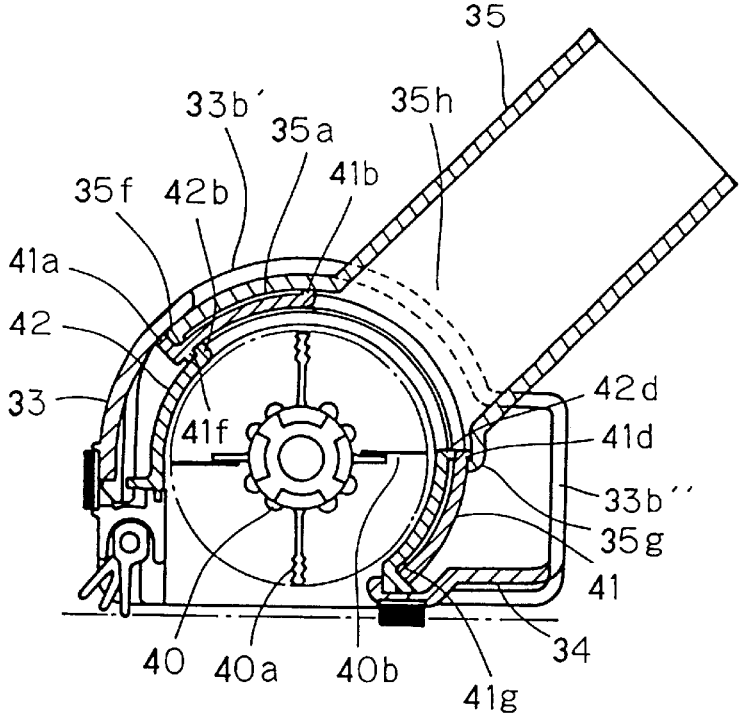
FIG. 22 is a sectional view, as seen from the side, of the nozzle unit of the electric vacuum cleaner of the eighth embodiment, showing a state of rotation of the first pipe.

Now, how the engagement member 41 moves as the first pipe 35 rotates will be described with reference to FIGS. 22 and 23 and also FIG. 20 described previously. First, in the state shown in FIG. 20, where the first pipe 35 is in the position substantially parallel to the floor surface, the engagement claws 35*f* provided on the sliding portion 35*a* engage with the engagement claws 41*b* provided on the engagement member 41. Accordingly, the engagement member 41 is rotated clockwise as seen in the figure, and thus closes the upper portion of the opening 33*b* of the upper case 33.

At this time, the engagement claw 41*g* of the engagement member 41 strikes the fixed member 42, and the engagement claw 41*f* of the engagement member 41 engages with the engagement claw 42*b* of the fixed member 42. This restricts rotation of the engagement member 41. Moreover, an air inflow portion 35*h* of the first pipe 35 is partially closed by the engagement member 41 and the fixed member 42.

As the first pipe 35 is rotated counter-clockwise, the air flow passage in the air inflow portion 35*h* gradually widens. When, as shown in FIG. 22, the inclination of the first pipe 35 becomes equal to about 45°, the engagement claw 35*g* provided on the sliding portion 35*a* engages with the engagement claw 41*d* provided on the engagement member 41. At this time, the air flow passage in the air inflow portion 35*h* has the maximum cross-sectional area. Now, the upper portion 33*b*' of the opening 33*b* of the upper case 33 is closed by the sliding portion 35*a*, and the rear portion 33*b*" thereof is closed by the engagement member 41 and the fixed member 42.

When the first pipe 35 is rotated further counter-clockwise, the air flow passage in the air inflow portion 35*h* is kept having the maximum cross-sectional area. When, as shown in FIG. 23, the first pipe 35 strikes an end surface 33*c* of the opening 33*b* of the upper case 33, rotation of the first pipe 35 is restricted. At the same time, the engagement claw 42*d* provided on the fixed member 42 engages with the engagement claw 41*g* provided on the engagement member 41, and thereby rotation of the engagement member 41 is restricted.

Figure 23:
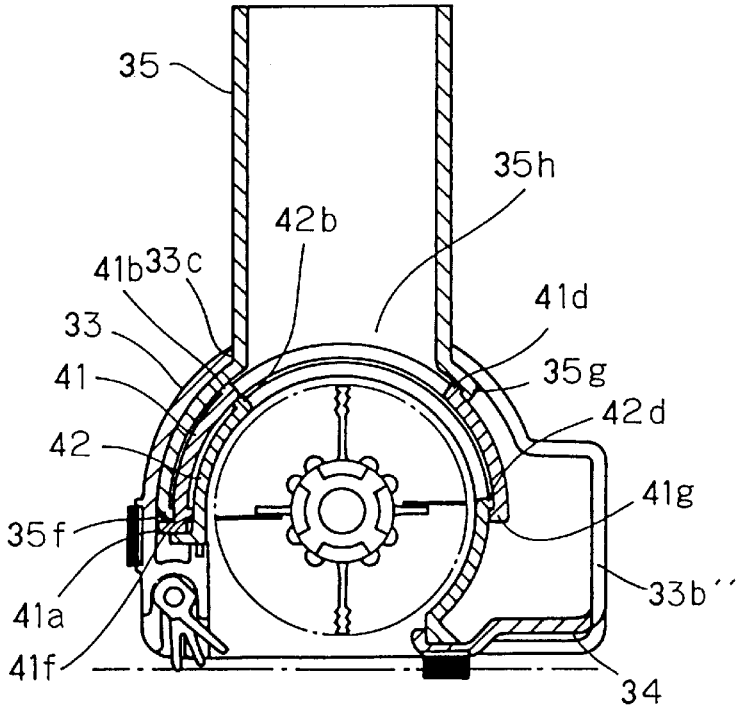
FIG. 23 is a sectional view, as seen from the side, of the nozzle unit of the electric vacuum cleaner of the eighth embodiment, showing another state of rotation of the first pipe.

Next, when the first pipe 35 is rotated clockwise from the state shown in FIG. 23, the air flow passage in the air inflow portion 35*h* is gradually narrowed by the engagement member 41. When the inclination of the first pipe 35 becomes equal to about 45°, the air flow passage in the air inflow portion 35*h* has the minimum cross-sectional area. When the first pipe 35 is rotated further clockwise, the air flow passage in the air inflow portion 35*h* is kept having the minimum cross-sectional area. Eventually, the first pipe 35 strikes the lower case 34, restoring the state shown in FIG. 20.

The structure as described above makes it possible to rotate the first pipe 35 from a position substantially parallel to the floor surface to a position substantially perpendicular thereto. When the nozzle unit 8 is used in the lateral position, which is more frequently the case than otherwise, and in addition when the inclination of the first pipe 35 is in the range from about 45° to 60°, which is more frequently the case than otherwise, by rotating the first pipe 35 once to the position substantially parallel to the floor surface and then backward, it is possible to maximize the cross-sectional area of the air flow passage in the air inflow portion 35*h*. Thus, it is possible to achieve increased suction efficiency in the state in which the nozzle unit 8 is most frequently used.

Similarly, when the nozzle unit 8 is used in the longitudinal position, in which case the inclination of the first pipe 35 equals about 90°, the air flow passage in the air inflow portion 35*h* has the maximum cross-sectional area, and thus it is possible to achieve high suction efficiency. To allow the air flow passage in the air inflow portion 35*h* to have the maximum cross-sectional area when the inclination of the first pipe 35 is otherwise (for example 30° to 60°), it is also possible to provide another engagement member between the engagement member 41 and the fixed member 42.

In FIG. 20 described previously, in the front-end portion of the engagement member 41, a shield portion 41*a* is provided that makes contact with the inner surface of the upper case 33. If dust or the like, entering through the opening 33*b* of the upper case 33, collects in the lower front portion (indicated by N) of the fixed member 42, it is difficult to remove it. The shield portion 41*a* serves to shield this gap between the fixed member 42 and the upper case 33. As a result, even if dust or the like enters through the opening 33*b*, it collects on the shield portion 41*a*, which is closer to the opening 33*b*, and thus it is easy to remove it.

In cleaning of, for example, a gap below a bed, since the nozzle unit 8 is kept invisible, the force applied thereto tends to deviate from the intended direction. This causes unintended rotation of the second pipe 36 and thus staggering motion of the body case 32. In FIG. 20, when the first pipe 35 is in the position substantially parallel to the floor surface, a pin 44 provided on the lower case 34 engages, through a through hole 35*e* provided in the first pipe 35, with an engagement portion 36*e* having a semi-circular cross section provided in the second pipe 36. This prevents staggering motion of the body case 32. The pin 44 and the through hole 35*e* are made so small as to cause almost no drop in the suction force due to leakage of the sucked air.

Figure 24:
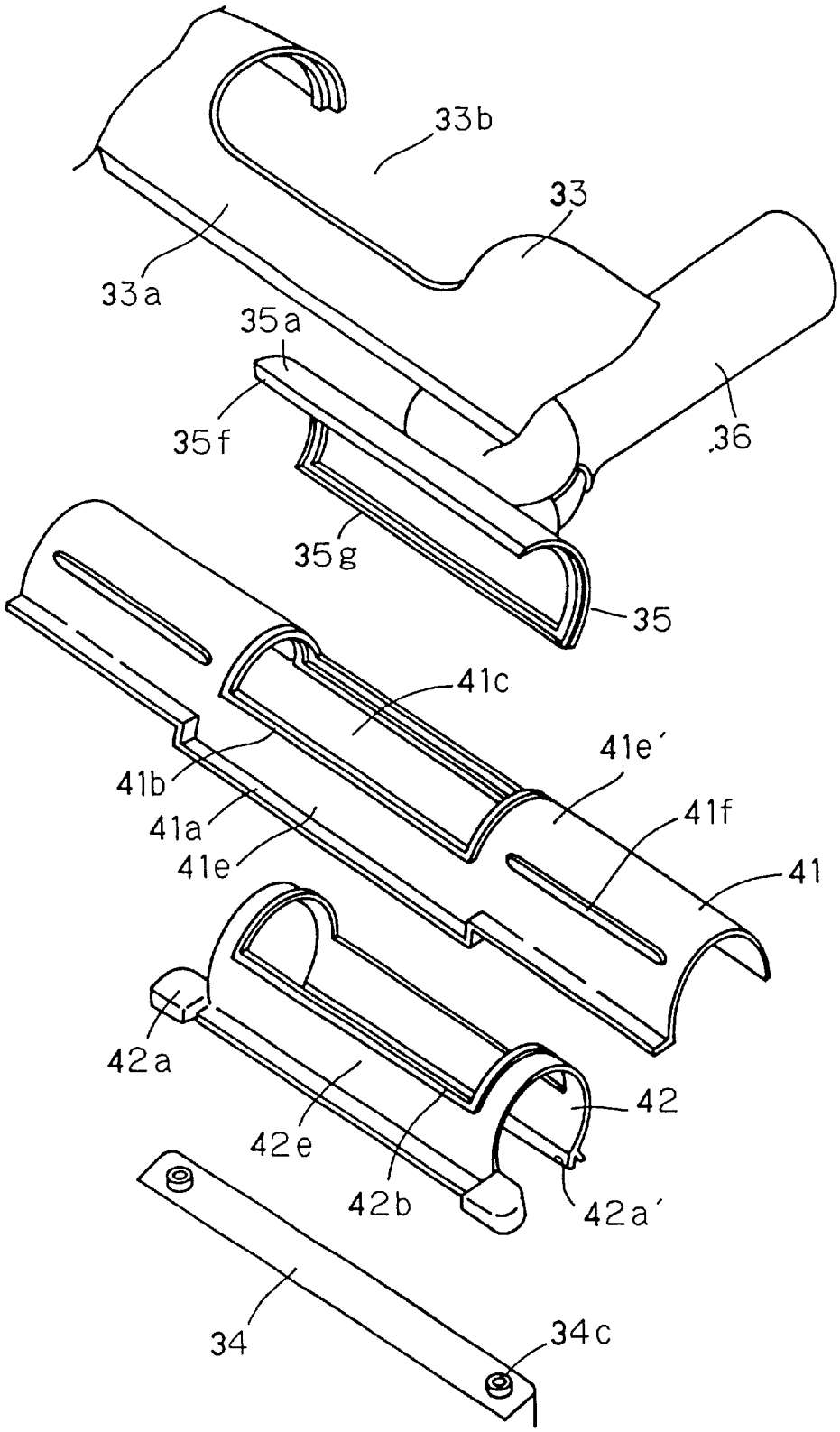
FIG. 24 is an exploded perspective view showing another example of the structure of the rotation mechanism of the nozzle unit of the electric vacuum cleaner of the eighth embodiment.

FIG. 24 is an exploded perspective view of another example of the structure of the engagement member 41. As compared with the one shown in FIG. 21 described previously, the engagement member 41 is extended in the direction of its longer sides, and has slots 41*f* provided in the cylindrical surfaces 41*e*' constituting the extended portion thereof. The flow of air sucked through the air inlet 33*d* (see FIG. 14) of the upper case 33 into the nozzle unit 8 flows through the slots 41*f* and blows on the blades 50 (see FIG. 20) of the rotary brush 40, thereby rotating the rotary brush 40. This causes rotating brushes 47 to rotate and thereby rake up dust from the floor surface. Thereafter, the dust, together with the flow of the sucked air, flows toward the first pipe 35 as indicated by the arrow K2 in FIG. 16.

In the engagement member 41 shown in FIG. 21, the air sucked in through the upper case 33 immediately flows toward the first pipe 35. By contrast, in the engagement member 41 shown in FIG. 24, the air sucked in first flows through the slots 41*f* to a portion closer to the blades 50 and then flows toward the first pipe 35. This makes it possible to rotate the rotary brush 40 efficiently and thereby increase suction efficiency.

The positions of the slots 41*f* vary according to the rotation direction of the first pipe 35 as the first pipe 35 rotates, but the slots 41*f* remain substantially in the same positions relative to the first pipe 35. Thus, it is possible to keep at all times the slots 41*f* in such positions relative to the first pipe 35 that the sucked air efficiently blows on the blades 50.

Figure 25:
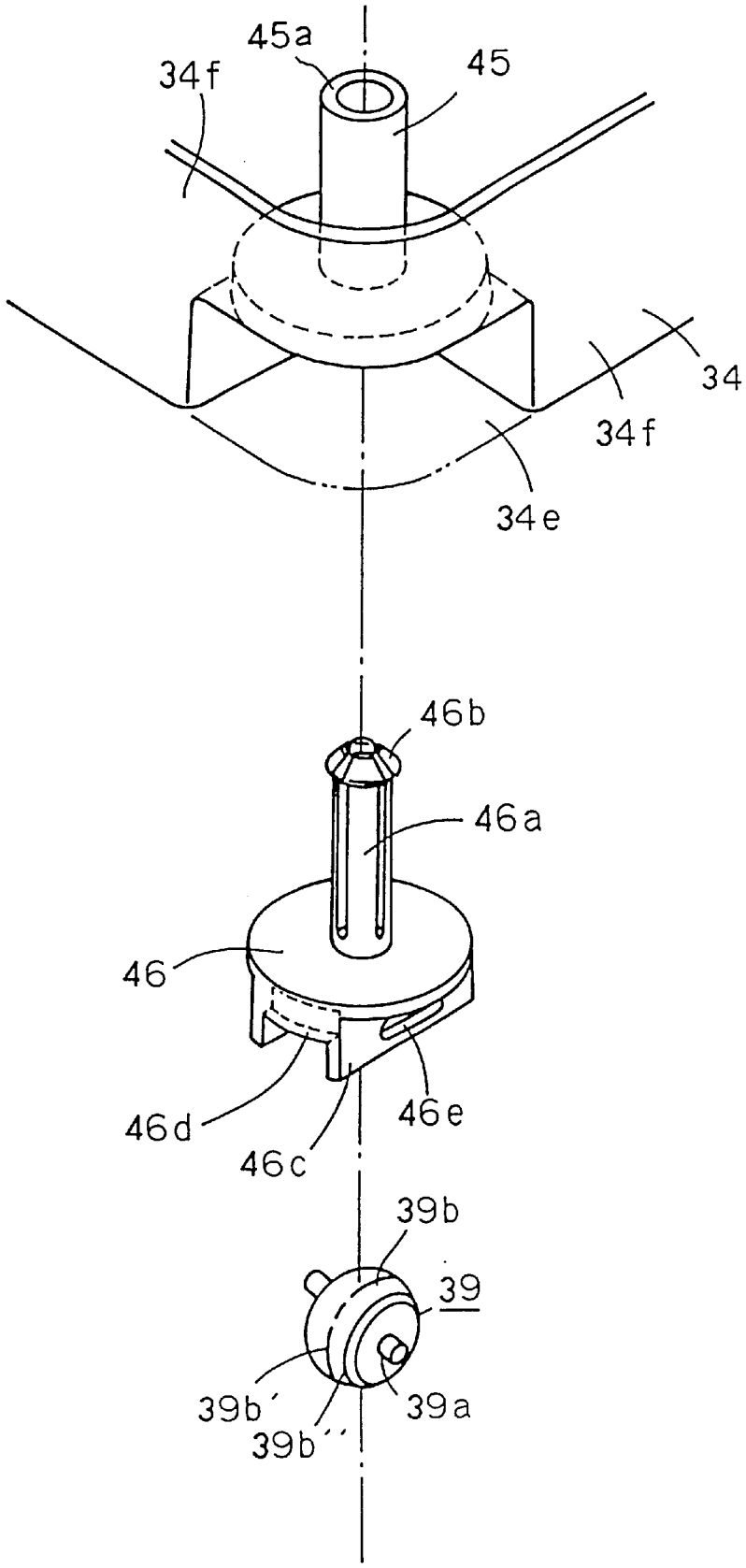
FIG. 25 is an exploded perspective view showing an example of the structure of a caster portion of the nozzle unit of the electric vacuum cleaner of the eighth embodiment.

FIG. 25 is an exploded perspective view of the portion around a caster 39 of the nozzle unit 8 of the embodiment under discussion. A caster 39 is supported by a caster mount 46, which has a pair of supporting ribs 46*c* each having a horizontally long slot 46*e*. Into these slots 46*e*, a caster shaft 39*a* fixed to the caster 39 is loosely fitted. The caster shaft 39*a* may be formed integrally with the caster 39 to reduce the number of components. The caster mount 46 has a pivot 46*a* having resilience radially. In the lower case 34, a recessed portion 34*e* is provided that has a pivot socket 45 formed integrally. The pivot 46*a* is fitted into the pivot socket 45. The pivot 46*a* of the caster mount 46 has a stopper 46*b* formed at the end. This stopper 46*b* engages with an end surface 45*a* of the pivot socket 45 so as to prevent the caster 39 from dropping out.

The recessed portion 34*e* is so formed as to have an opening in the circumferential surface 34*f* of the lower case 34. This helps prevent dust or the like from collecting in the recessed portion 34*e*. The caster 39 and the caster mount 46 are so formed as not to protrude from the circumferential surface 34*f*. This helps prevent damage to the caster 39 or scratches on a wall or a piece of furniture resulting from collision between them during cleaning. Moreover, reinforcing ribs 46*d* are provided so as to bridge between the pair of supporting ribs 46*c* in order to reinforce the supporting ribs 46*c* and thereby obtain higher reliability in the function of the caster.

In this structure, the caster 39 is fitted so as to be freely rotatable about the pivot 46*a*. This ensures smooth change of the movement direction of the nozzle unit 8 between directions G and H (see FIG. 14). Moreover, the caster 39 does not slide but rolls, and thereby prevents scratches on the flooring or the like. Moreover, since the caster shaft 39*a* is supported by the slots 46*e*, the caster 39 can move translation ally. This makes the caster 39 more susceptible to the moment that tends to change the movement direction and thereby ensures smoother change of the movement direction. Furthermore, it is preferable to form the caster 39 so as to have a smaller diameter in the edge portions 39*b*" of its circumferential surface than in the central portion 39*b*' thereof, because this makes it possible to keep the caster 39 substantially in point contact with the floor surface and thereby make it even more susceptible to the moment that tends to change the movement direction.

Figure 26:
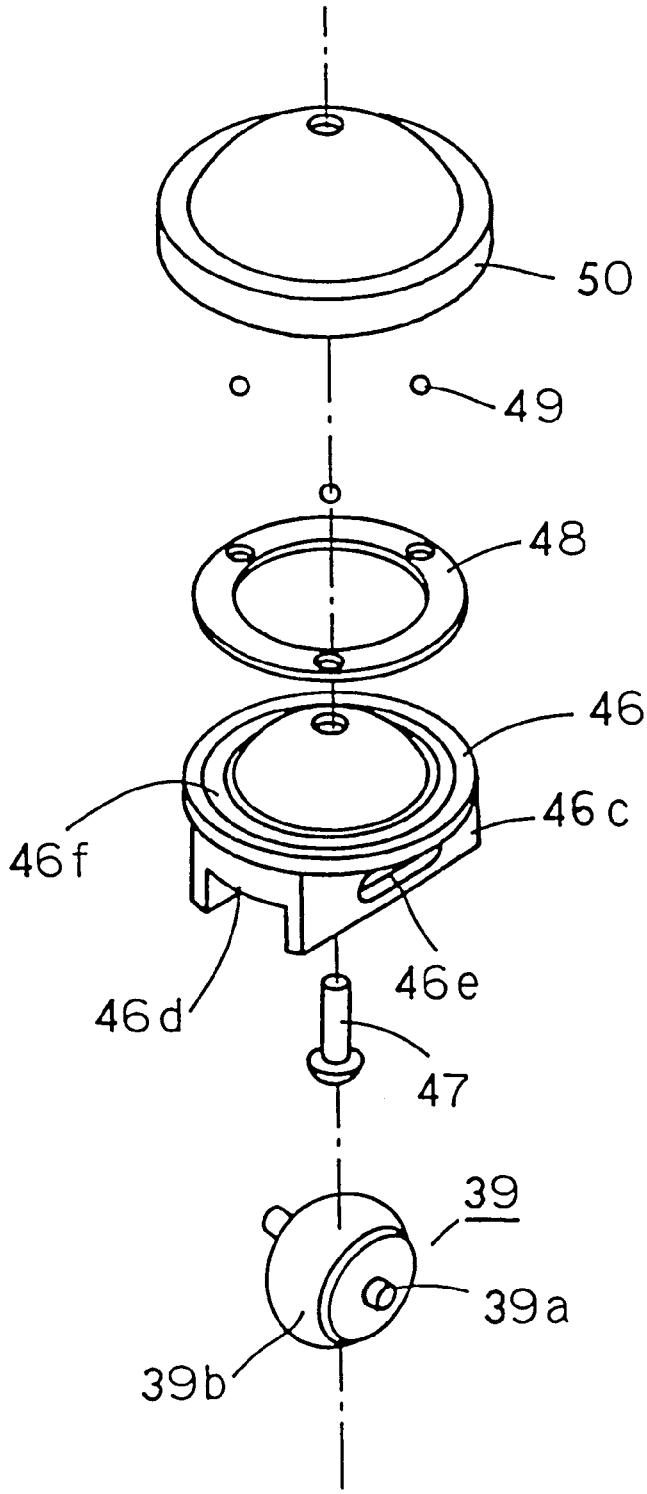
FIG. 26 is an exploded perspective view showing another example of the structure of a caster portion of the nozzle unit of the electric vacuum cleaner of the eighth embodiment.

FIG. 26 is an exploded perspective view showing another example of the structure of the portion around a caster 39. On a bearing surface 46*f* of a caster mount 46, a plurality of balls 49 are arranged by being positioned by a ring 48. The balls 49 are held between the bearing surface 46*f* and a bearing surface (not shown) provided on the bottom surface of a fixed base 50. The caster mount 46 is fixed to a recessed portion 34*e* (see FIG. 25) by a pin 47. This structure serves the same purpose as the previously described structure does.

Figure 27:
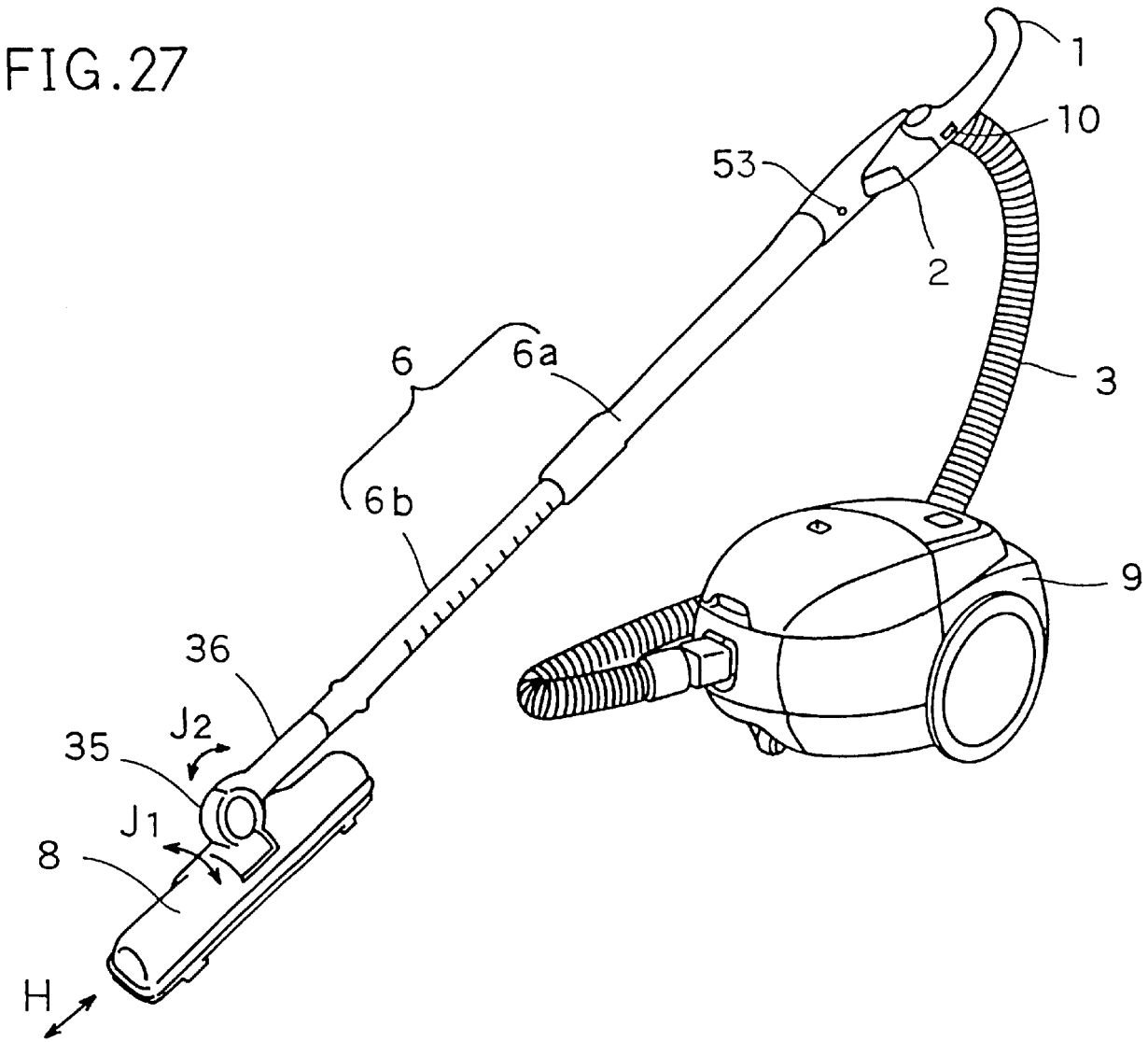
FIG. 27 is a schematic view showing the state of the electric vacuum cleaner of the eighth embodiment when the nozzle unit is in the longitudinal position.
Figure 28:
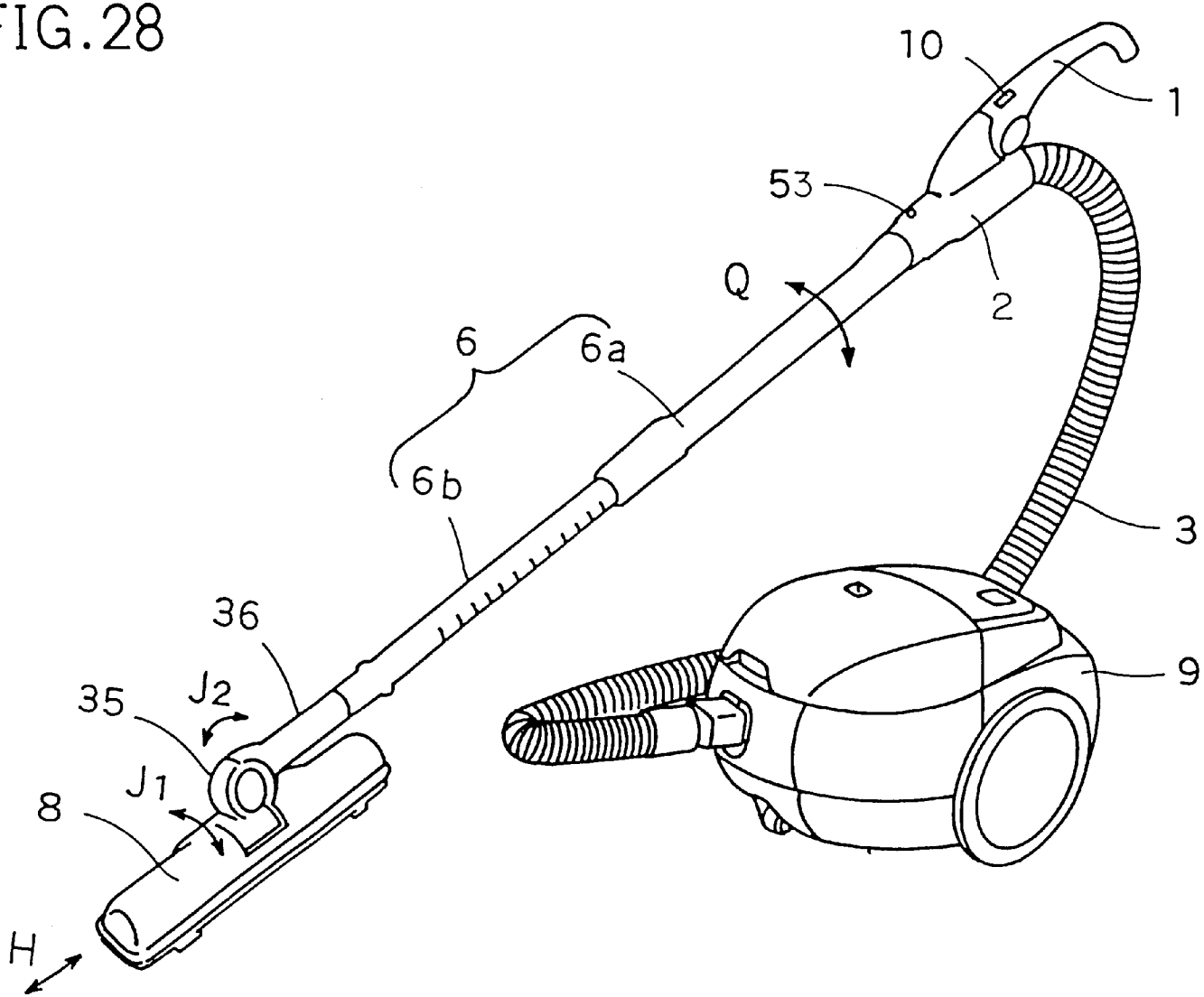
FIG. 28 is a schematic view showing the state of the electric vacuum cleaner of the eighth embodiment when the nozzle unit is in the longitudinal position and the extension pipe is rotated.

When the nozzle unit 8 described above is used in the longitudinal position, the first and second pipes 35 and 36 are rotated, from the state shown in FIG. 13 described earlier, in the directions indicated by arrows J1 and J2, respectively. At this time, the extension pipe 6, the coupling member 2, and the hose 3 move together, bringing the handle into a state pointing to the side as shown in FIG. 27. However, in the embodiment under discussion, by operating a button 53, it is possible to rotate the coupling member 2 in the direction indicated by the arrow Q relative to the extension pipe 6 as shown in FIG. 28, so that the handle 1 and the operation switch 10 point upward. As a result, even when the nozzle unit 8 is used in the longitudinal position, the handle 1 and the operation switch 10 can be used in the same way as when the nozzle unit 8 is used in the lateral position, and thus enhanced user-friendliness is achieved in cleaning.

Now, the rotation mechanism of the coupling member 2 will be described with reference to a sectional view and a partial sectional view thereof shown in FIGS. 29 and 30, respectively. On the outer surface of the hollow extension pipe 6, a coupling groove (a first groove) 55 is provided circumferentially. Moreover, on the outer surface of the extension pipe 6, a plurality of locking grooves (second grooves) 56 are provided around the same circumference. On the coupling member 2, a lock mechanism 60 for coupling the extension pipe 6 is provided. The lock mechanism 60 is supported so as to be rotatable about a rotation axis 60*a*. The lock mechanism 60 has, at one end thereof, a button 53 (a disengaging member) that protrudes through a hole 2*c* provided in the coupling member 2. The lock mechanism 60 has, at the other end thereof, a first and a second projection (a first and a second engagement member) 57 and 58 that can engage with the first and second grooves 55 and 56, respectively.

Figure 31:
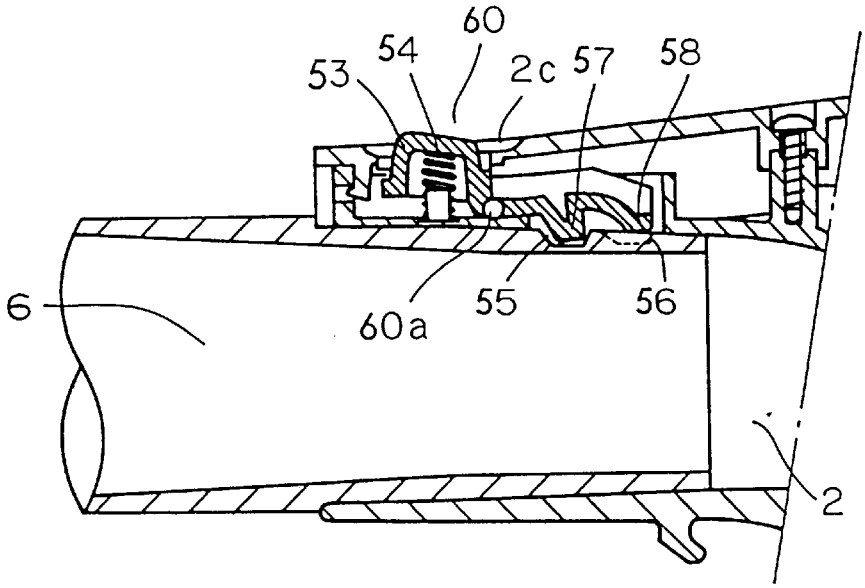
FIG. 31 is a sectional view showing the state of the coupling portion of the electric vacuum cleaner of the eighth embodiment when the second projection is disengaged.

The button 53 is loaded with a force that tends to move it upward as seen in the figures by a compression spring 54. Accordingly, the first and second projections 57 and 58 are pressed against the extension pipe 6. With the button 53 pressed with a finger, the extension pipe 6 is inserted into the coupling member 2. By releasing the finger from the button 53, since the first projection 57 has a smaller rotation radius than the second projection 58 with respect to the rotation axis 60*a* as shown in FIG. 31, it is possible to engage the first projection 57 with the coupling groove 55 without engaging the second projection 58 with the locking grooves 56. In this way, the coupling member 2 and the extension pipe 6 are rotatably coupled together.

Figure 29:
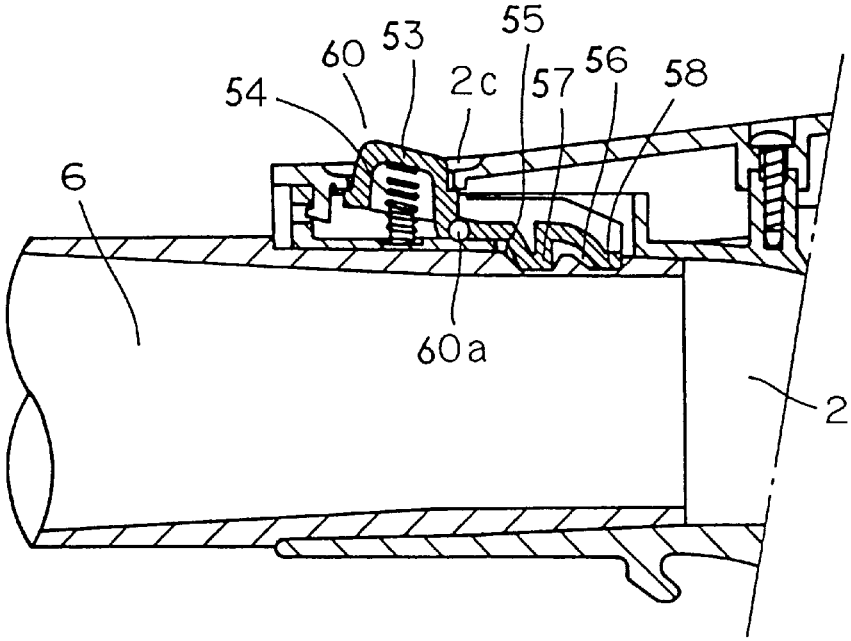
FIG. 29 is a sectional view of the coupling portion of the electric vacuum cleaner of the eighth embodiment.
Figure 30:
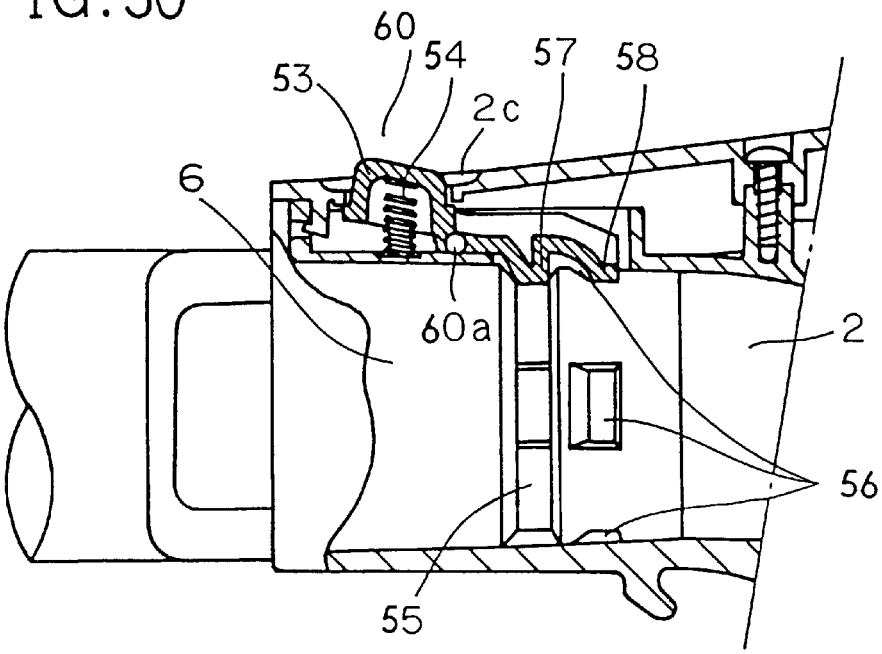
FIG. 30 is a partial sectional view of the coupling portion of the electric vacuum cleaner of the eighth embodiment.

When the coupling member 2 is rotated relative to the extension pipe 6, the second projection 58 slides along the outer surface of the extension pipe 6, and then the second projection 58 engages with one of the locking grooves 56 as shown in FIGS. 29 and 30 described previously, locking the coupling member 2 in a predetermined position relative to the extension pipe 6.

Figure 32:
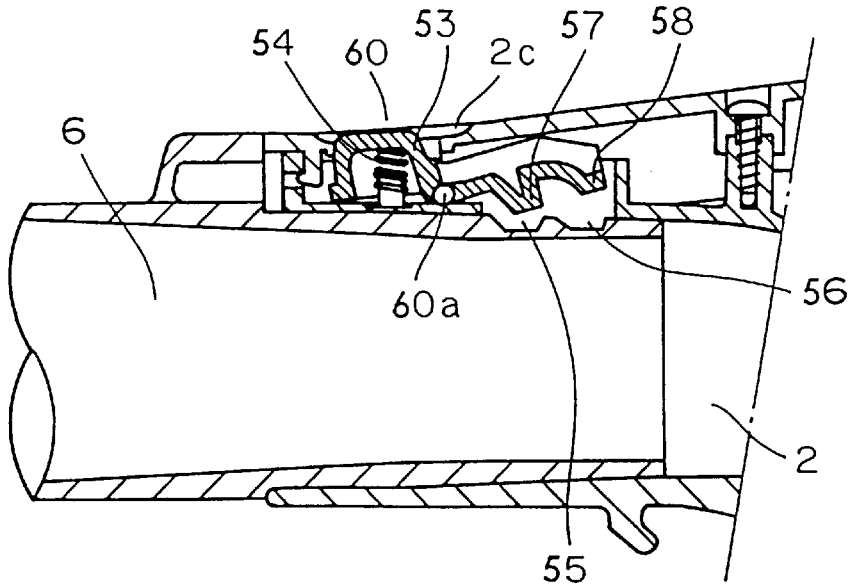
FIG. 32 is a sectional view, as seen from the front, of the locking groove of the extension pipe of the electric vacuum cleaner of the eighth embodiment.

Removal of the extension pipe 6 from the coupling member 2 is achieved in the following manner. By pressing the button 53 (a disengaging member) with a finger, as shown in FIG. 31, the second projection 58 is disengaged from the locking groove 56. By pressing the button 53 further with a finger, as shown in FIG. 32, the first projection 57 is disengaged from the coupling groove 55. In this state, by pulling out the extension pipe 6, it is removed from the coupling member 2.

Figure 33:
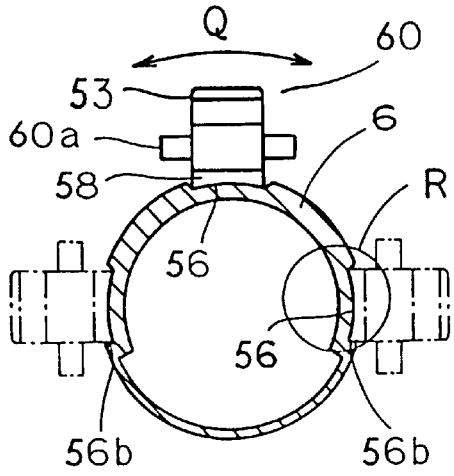
FIG. 33 is an enlarged partial view of FIG. 32.

As shown in FIG. 33, which is a sectional view as seen from the front, the locking grooves 56 are arranged at three locations, i.e. at the location indicated by solid lines where the button 53 of the lock mechanism 60 points upward (hereafter referred to as the "normal position") and at the locations indicated by dash-and-dot lines 90° apart rightward and leftward from the normal position (hereafter referred to as the "90° positions").

When the nozzle unit 8 is used in the lateral position (see FIG. 13), the coupling member 2 is in the normal position. When the nozzle unit 8 is used in the longitudinal position (see FIG. 28), the coupling member 2 is in one of the 90° positions. Thus, in either case, the handle 1, the operation switch 10, and the button 53 can be made to point upward. The locking grooves 56 may be arranged at other locations than described above.

Figure 34:
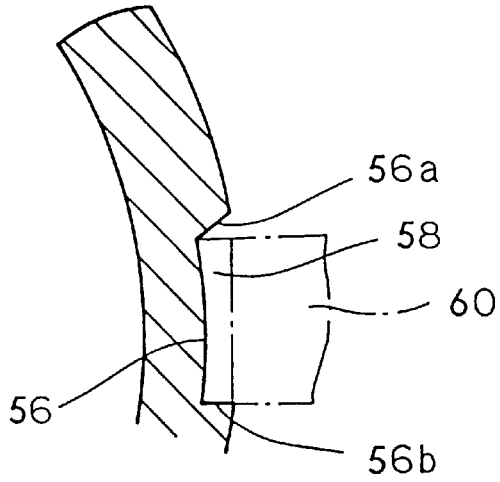
FIG. 34 is a sectional view, as seen from the front, of the coupling groove of the extension pipe of the electric vacuum cleaner of the eighth embodiment.

As shown in FIG. 34, which is a detail view of the portion R shown in FIG. 33, the locking grooves 56 have, as their circumferential wall surfaces, inclined surfaces 56*a*. As a result, simply by rotating the coupling member 2 relative to the extension pipe 6 without pressing the button 53, the second projection 58 runs on to the inclined surface 56*a* against the load with which it is loaded by the compression spring 54, allowing switching between the normal and 90° positions. This makes switching of the rotation position easy.

However, the locking grooves 56 at the 90° positions have, as their wall surface 56*b* farther from the normal position, non-inclined surfaces, so that these surfaces serve as stoppers that restrict the rotation range by being struck by the second projection 58 and thereby prevent the coupling member 2 from being rotated out of the rotation range. This makes switching to the 90° positions easier and thereby enhances user-friendliness.

Figure 35:
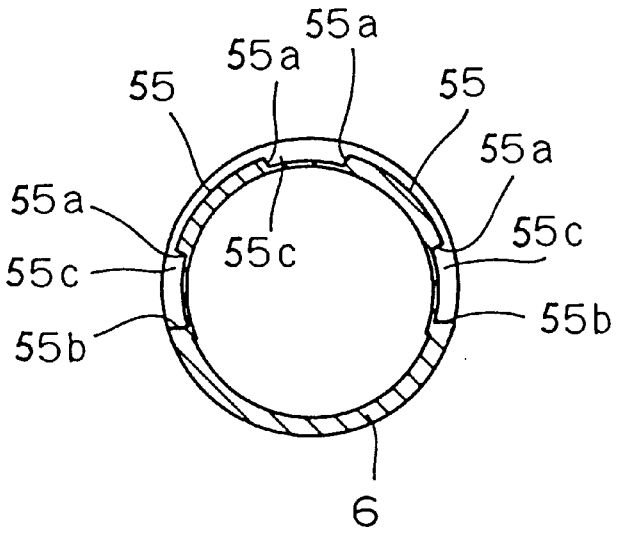
FIG. 35 is a sectional view showing the state of the coupling portion of the electric vacuum cleaner of the eighth embodiment when the first projection is disengaged.

FIG. 35 is a sectional view of the portion of the extension pipe 6 at which the coupling groove 55 is formed. At those locations of the bottom of the coupling groove 55 which correspond to the locking grooves 56, grooves 55*c* deeper than the coupling groove 55 are provided. By engaging the first projection 57 with one of these grooves 55*c*, it is possible to lock the coupling member 2 and the extension pipe 6 together more securely in the predetermined rotation positions (the normal and 90° positions). Moreover, in the same manner as described above, inclined surfaces 55*a* and stopper surfaces 55*b* are provided to allow easy switching of the rotation position. Furthermore, by forming the coupling groove 55 as shown in FIG. 35, it is possible to lock the coupling member 2 and the extension pipe 6 in the predetermined rotation positions by using the first projection 57, and thus omit the second projection 58. This helps simplify the structure.

Figure 36:
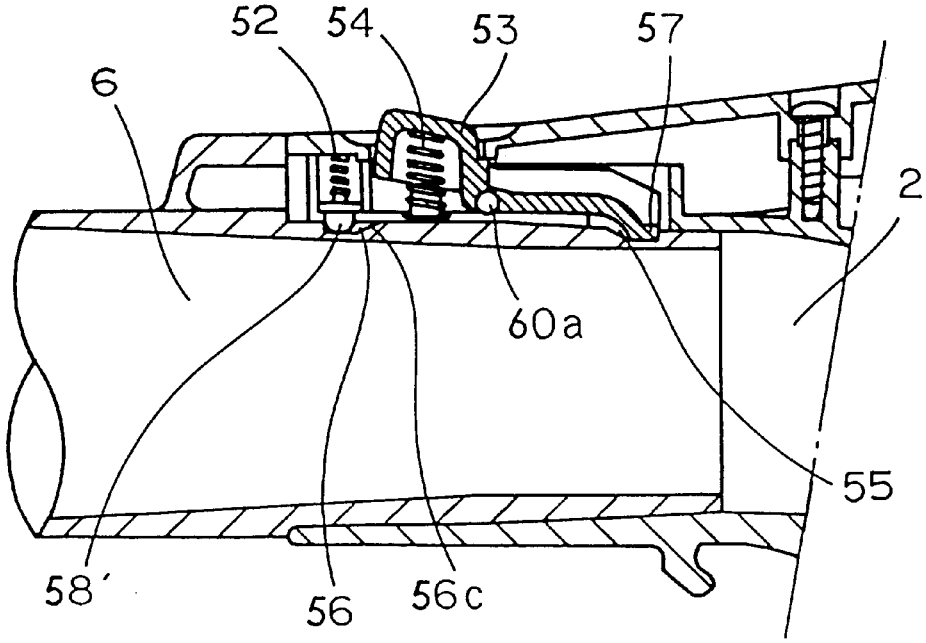
FIG. 36 is a sectional view of another example of the structure of the coupling portion of the electric vacuum cleaner of the eighth embodiment.
Figure 37:
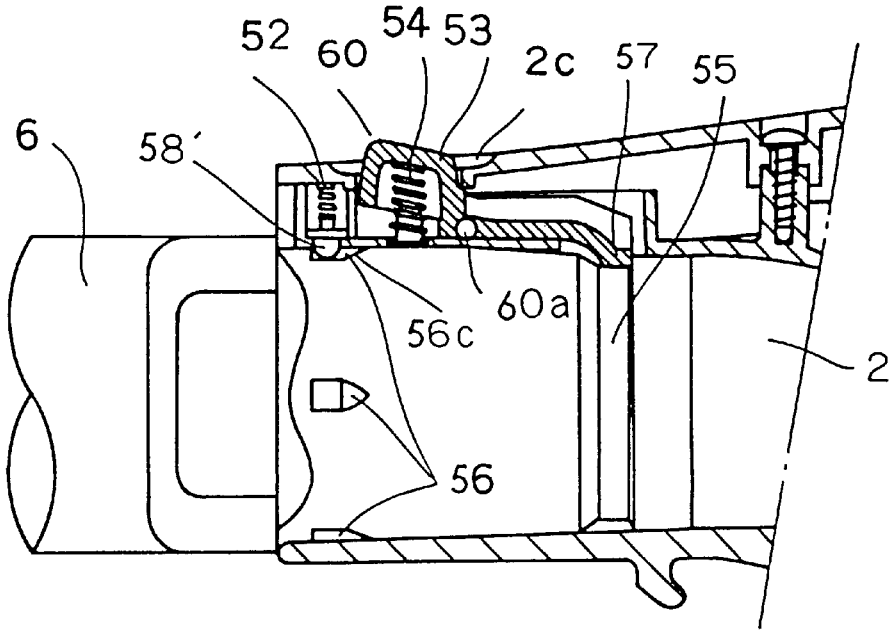
FIG. 37 is a partial sectional view of FIG. 36.

FIGS. 36 and 37 are a sectional view and a partial sectional view, respectively, of another example of the structure of the lock mechanism 60 for locking together the coupling member 2 and the extension pipe 6. This lock mechanism 60 is different from the lock mechanism 60 shown in FIG. 29 in that the second projection 58 is composed of a ball 58' loaded with a force by a compression spring 52 and is provided separately from the first projection 57.

When the coupling member 2 is rotated relative to the extension pipe 6, with the first projection 57 sliding along the coupling groove 55, the ball 58', which is loaded with a force, travels out of the locking groove 56, then travels along the inclined surface 56*a* (see FIG. 34), then runs on to the outer surface of the extension pipe 6, and then moves over to another locking groove 56. Thus, this structure serves the same purpose as the previously described structure does.

Figure 38:
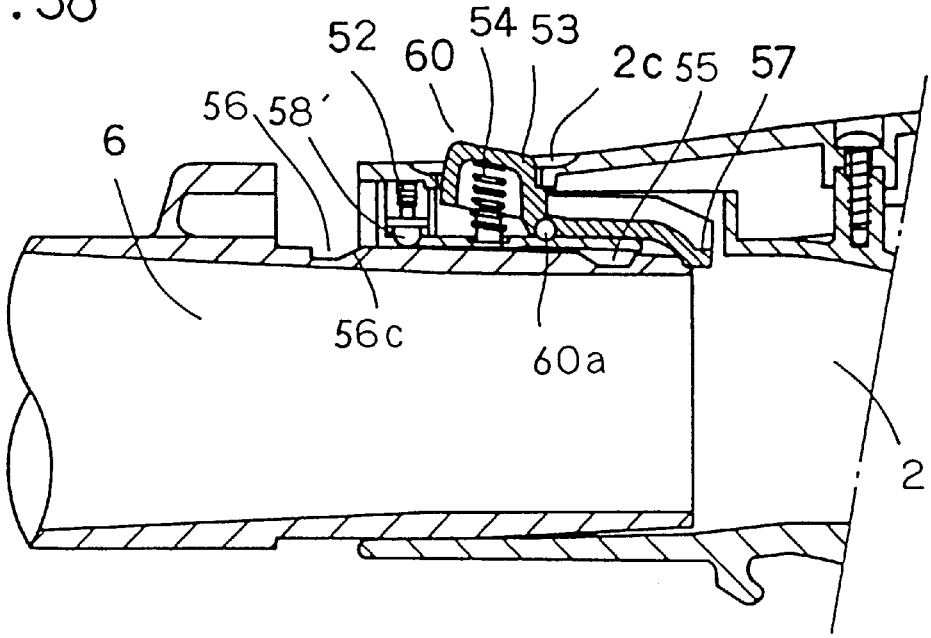
FIG. 38 is a sectional view showing the state when the extension pipe is removed from the state shown in FIG. 36.

By pressing the button 53 with a finger, the first projection 57 is disengaged from the coupling groove 55. In this state, when the extension pipe 6 is pulled out, the ball 58' runs on to the outer surface of the extension pipe 56 as shown in FIG. 38 so as to allow removal of the extension pipe 6 from the coupling member 2. Here, the locking groove 56 has an inclined surface 56*c* as its wall surface closer to the coupling member 2, i.e. the wall surface that lies in the direction in which the extension pipe 6 is pulled out (along the rotation axis). An inclined surface is preferable here because it ensures smooth movement of the ball 58' and thus easy removal of the extension pipe 6.

Coupling between the coupling member 2 and the extension pipe 6 does not necessarily have to be achieved by engaging a groove (the coupling groove 55 and the locking grooves 56) provided in the outer surface of the extension pipe 6 with an engagement member (the first and second projections 57 and 58 and the ball 58') provided on the coupling member 2, but may be achieved in any other manner. For example, it is possible to provide a groove in the coupling member 2 and provide an engagement member on the extension pipe 6; or it is possible to provide a groove in the inner surface of the extension pipe 6.

Figure 39:
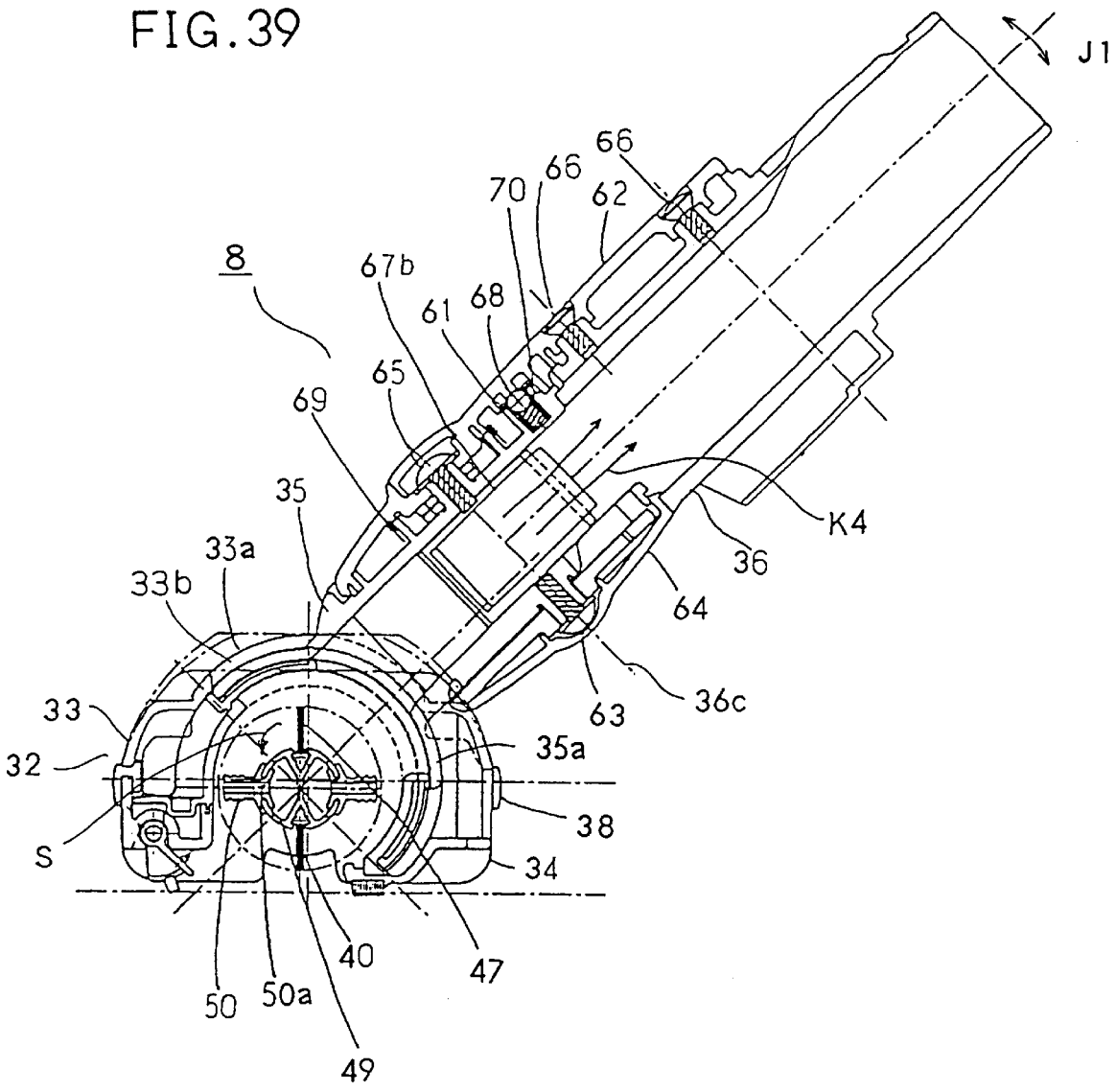
FIG. 39 is a sectional view, as seen from the side, of the nozzle unit of the electric vacuum cleaner of a ninth embodiment.

FIG. 39 is a sectional view, as seen from the side, of the nozzle unit 8 of the electric vacuum cleaner of a ninth embodiment of the invention. The nozzle unit 8 of this embodiment is intended to replace that of the eighth embodiment shown in FIG. 14, and therefore such components as are found also in the eighth embodiment are identified with the same reference numeral. The electric vacuum cleaner as a whole has the same structure as shown in FIG. 13. The nozzle unit 8 has a body case 32, which is composed of a lower case 34 having a nozzle (not shown) formed in its bottom surface, an upper case 33 to which a first pipe 35 is coupled, and a bumper 38 fitted between the upper and lower cases 33 and 34.

To the first pipe 35, a second pipe 36 is coupled. To the second pipe 36, an extension pipe 6 (see FIG. 13) is coupled, which is comparatively long. Through the first and second pipes 35 and 36, the sucked air flows toward a body 9 of the electric vacuum cleaner as indicated by the arrow K4. As in the eighth embodiment, the first pipe 35 has a sliding portion 35*a* having an arc-shaped cross section that slides along the inner surface of a guide portion 33*a* having an arc-shaped cross section of the upper case 33. Thus, the first pipe 35 is so supported as to be rotatable in the direction indicated by the arrow J1 within an opening 33*b*.

A bottom surface of the first pipe 35 is fitted to the second pipe 36 with a screw 63 so as to be rotatable about a rotation axis 36*c*, and is covered by a cover 64. A top surface of the first pipe 35 is fitted to a pipe cover 62 with a screw 65 so as to be rotatable about the rotation axis 36*c*. The pipe cover 62 is fixed to the second pipe 36 with screws 66.

Thus, as in the eighth embodiment, when the nozzle unit 8 is used in the lateral position, the elevation (depression) angle of the extension pipe 6 can be changed by means of the first pipe 35. In addition, as shown in FIG. 28 described earlier, when the nozzle unit 8 is used in the longitudinal position, the elevation (depression) angle of the extension pipe 6 can be changed by means of the second pipe 36.

Figure 40:
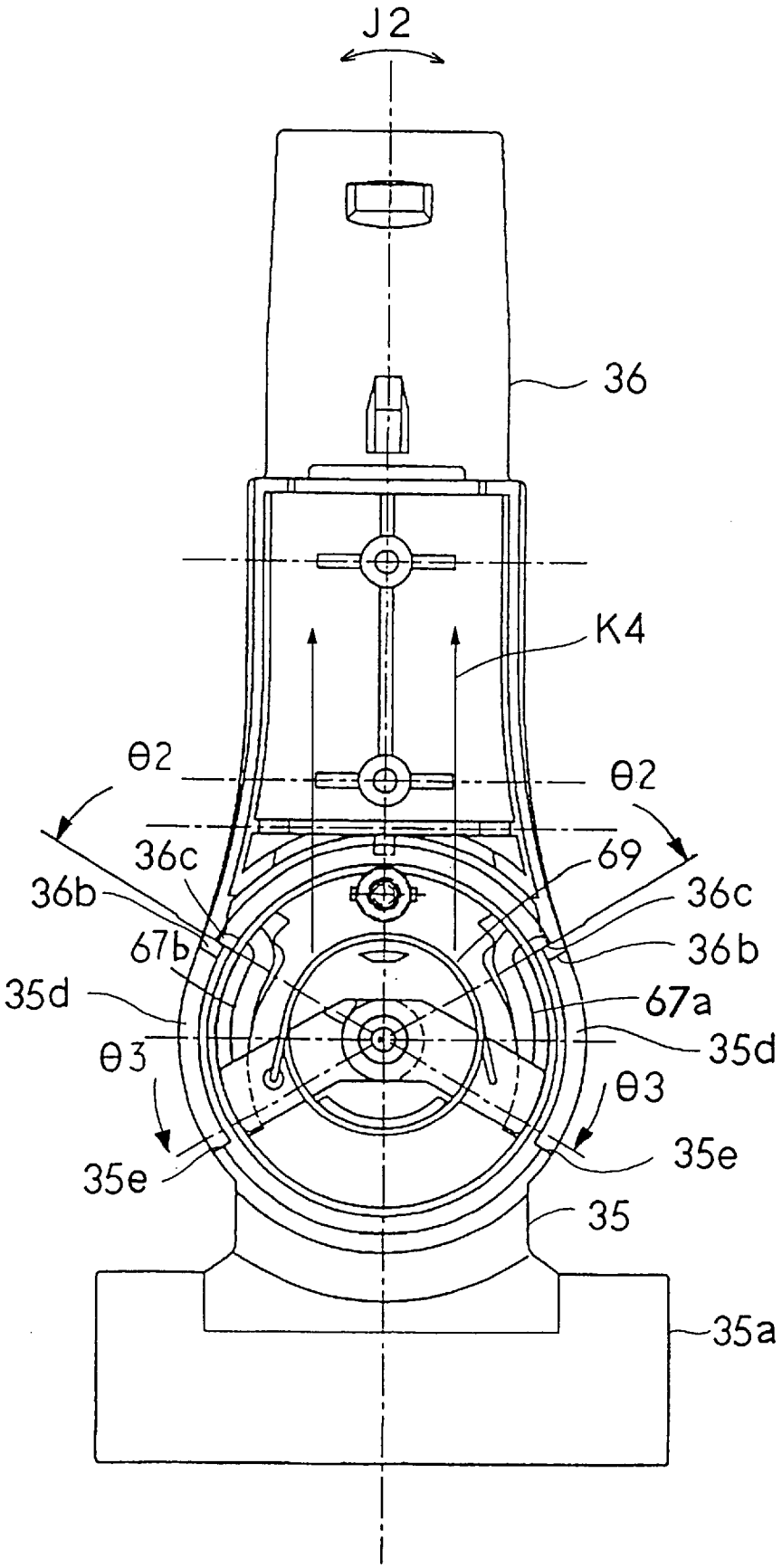
FIG. 40 is a front view showing the state of the nozzle unit of the electric vacuum cleaner of the ninth embodiment when the second pipe is in the upright position.

FIG. 40 shows how the first and second pipes 35 and 36 are coupled together. As shown in this figure, the first pipe 35 has an opening 35*d* formed so as to extend through a range of angles θ3. The flow of the sucked air flows through this opening 35*d* to the second pipe 36. An end surface 35*e* of the opening 35*d* is hit by a stopper portion 36*b* of the second pipe 36, and thereby the rotation range θ2 of the second pipe 36 in the direction J2 is restricted.

When the nozzle unit 8 is used in the lateral position, the second pipe is positioned substantially at the center of its rotation range θ2. To prevent inflow of the ambient air through the opening 35*d* at this time, shutters 67*a* and 67*b* are provided on the inner surface of the first pipe 35. The shutters 67*a* and 67*b* are loaded with forces that tend to move them clockwise and counter-clockwise, respectively, by a force-loading spring 69, and are so arranged as to be slidable along the inner surface of the first pipe 35.

Figure 41:
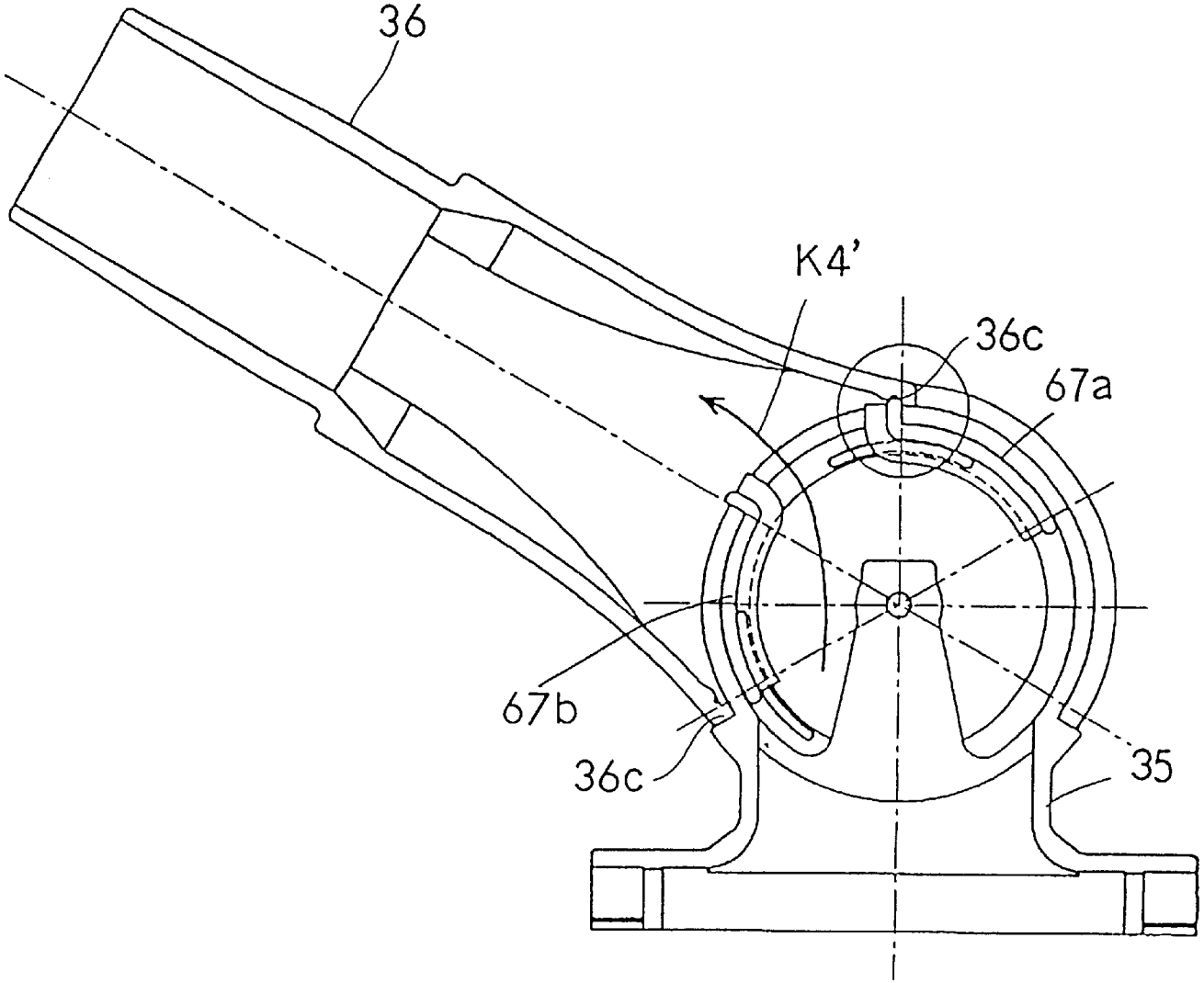
FIG. 41 is a front view showing the state of the nozzle unit of the electric vacuum cleaner of the ninth embodiment when the second pipe is in the fully inclined position.

When the nozzle unit 8 is used in the longitudinal position, by inclining the second pipe 36 as shown in FIG. 41, an engagement portion 36*c* of the second pipe 36 engages with the shutter 67*a*. Thus, the shutter 67*a* rotates together with the second pipe 36 so as to shield the opening 35*d*. By returning the second pipe 36 to the original position shown in FIG. 40, the shutter 67*a* returns to its original position by the action of the force-loading spring 69. Similarly, by inclining the second pipe 36 in the opposite direction, an engagement portion 36*d* engages with the shutter 67*b* so as to shield the opening 35*d*. This prevents influx of the ambient air and thereby prevents a drop in suction efficiency.

When the nozzle unit 8 is used in the lateral position, free rotation of the second pipe 36 from the position shown in FIG. 40 is prevented by a click mechanism (a restricting means). In FIG. 39 described previously, the click mechanism has a steel ball 68 and a locking plate 61 provided between the pipe cover 62 and the first pipe 35.

Figure 42:
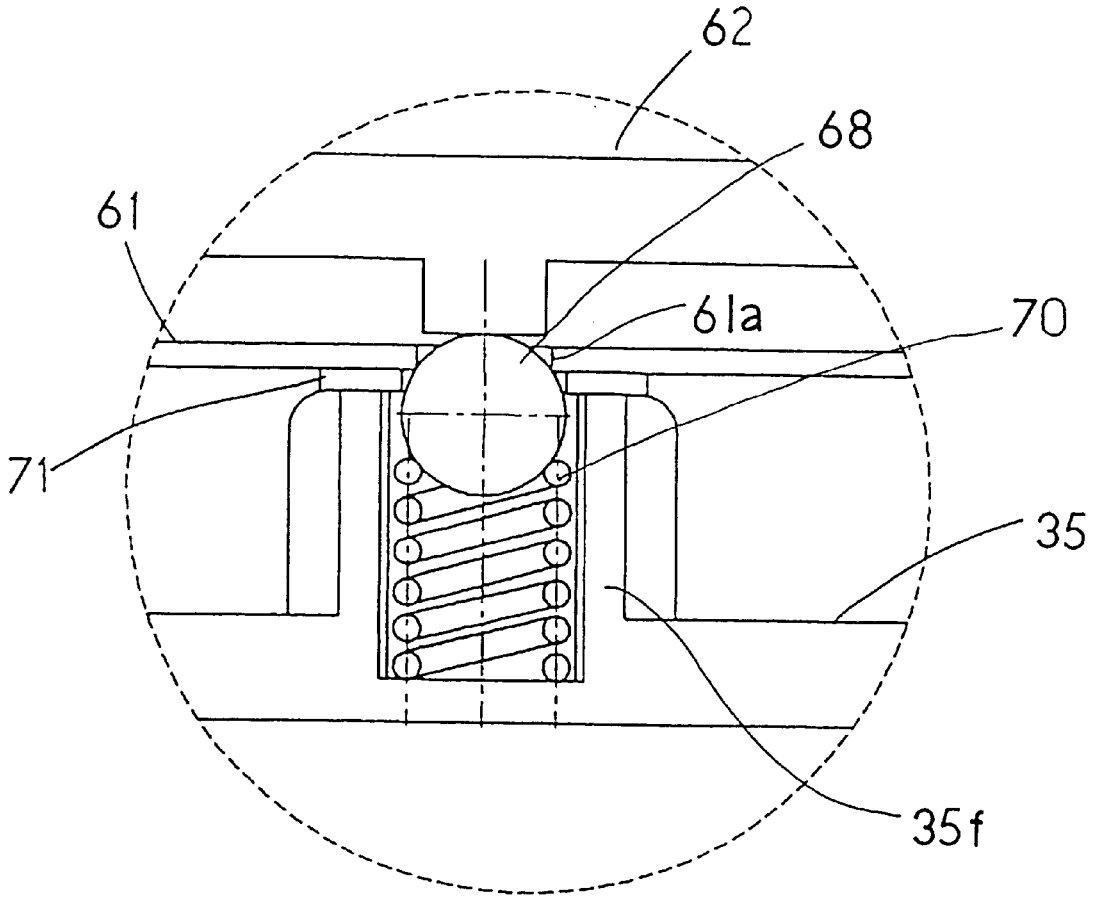
FIG. 42 is a detail view of the principal portion of the click mechanism of the nozzle unit of the electric vacuum cleaner of the ninth embodiment.

FIG. 42 shows the detail of the click mechanism. The first pipe 35 has a boss 35*f*, into which a compression spring 70 is fitted. On the inner surface of the pipe cover 62, a locking plate 61 having a hole 61*a* is fixed. Between the locking plate 61 and the compression spring 70 is arranged a steel ball 68. Engaging the steel ball 68 with the hole 61*a* produces a click.

Thus, a predetermined rotation force is required to rotate the second pipe 36, which is integral with the pipe cover 62. This prevents free rotation of the second pipe 36 and thereby prevents degradation of cleaning efficiency due to staggering motion of the body case 32. A felt ring 71 is fitted to the boss 35*f* to prevent entry of dust and thereby prevent variation over time of the clicking force produced by the steel ball 68.

Moreover, when the predetermined rotation force is applied to the second pipe 36 to rotate it relative to the first pipe 35, the steel ball 68 retracts against the force with which it is loaded by the compression spring 70. Then, the steel ball 68 rolls along the inner surface of the locking plate 61. Therefore, when the nozzle unit 8 is used in the longitudinal position, the second pipe 36 can rotate freely.

Figure 43:
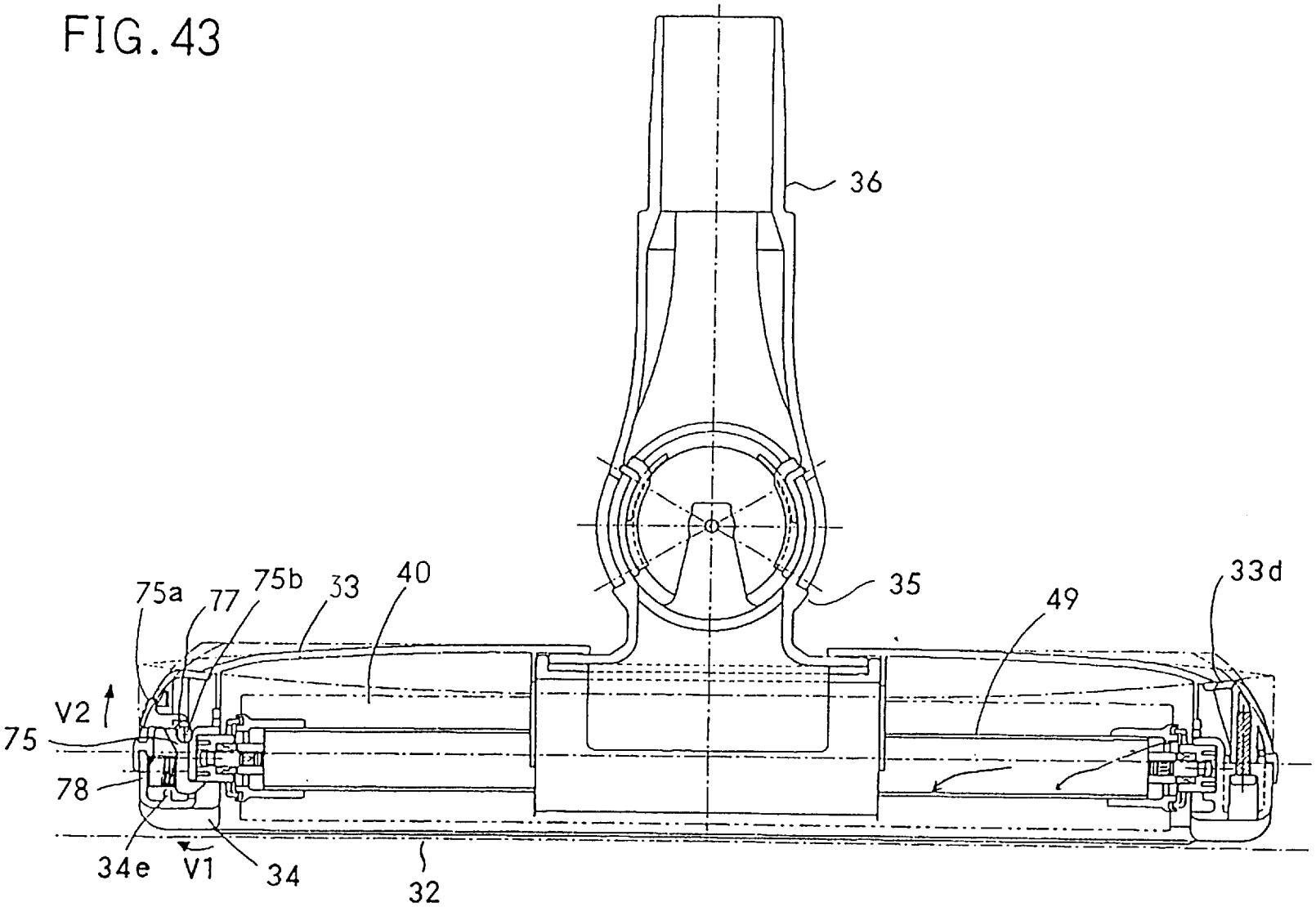
FIG. 43 is a sectional view, as seen from the front, of the nozzle unit of the electric vacuum cleaner of the ninth embodiment.

In FIG. 39 described previously, a rotary brush 40 has, on its shaft portion 49, blades 50 made of a flexible material such as rubber and brushes 47. The blades 50 each have a plurality of through holes 50*a* formed so as to extend in the direction of a radius of the rotary brush 40 and arranged in a line extending in the direction of the length of the rotary brush 40. As shown in FIG. 43, the air sucked through the air inlet 33*d* provided in the upper case 33 into the body case 32 flows into the shaft portion 49 from the side of the rotary brush 40. The air then flows through the shaft portion 49 and then blows out through the through holes 50*a*.

When the rotary brush 40 rotates in the direction indicated by the arrow S shown in FIG. 39, the brushes 47 and the blades 50 rake up dust from the floor surface such as a carpet. At this time, air blows out through the through holes 50*a* on the floor surface to help dust to be raked up. This leads to enhanced dust collecting performance.

In FIG. 43, the rotary brush 40 is fixed inside the body case 32 in such a way as to be loaded, at one end, with a force by a compression spring 78 through an attachment/detachment button 75. The attachment/detachment button 75 is, at its shaft portion 75*b*, pivoted on the body case 32 so as to be rotatable in the direction indicated by the arrow V1, with a certain amount of play 77 secured so as to permit the shaft portion 75*b* to move upward as seen in the figure within the body case 32. The lower case 34 has a projecting rib 34*e*.

When the nozzle unit 8 is subjected to a shock resulting from, for example, a drop from a higher position, the projecting rib 34*e* restricts rotation of the attachment/detachment button 75 and thereby prevents the rotary brush 40 from dropping out. When a button portion 75*a* of the attachment/detachment button 75 is pulled up in the direction indicated by the arrow V2, the shaft portion 75*b* moves as much as the play 77 permits. At this time, the attachment/detachment button 75 can be rotated without interference with the projecting rib 34*e*. This allows attachment and detachment of the rotary brush 40.

Figure 44:
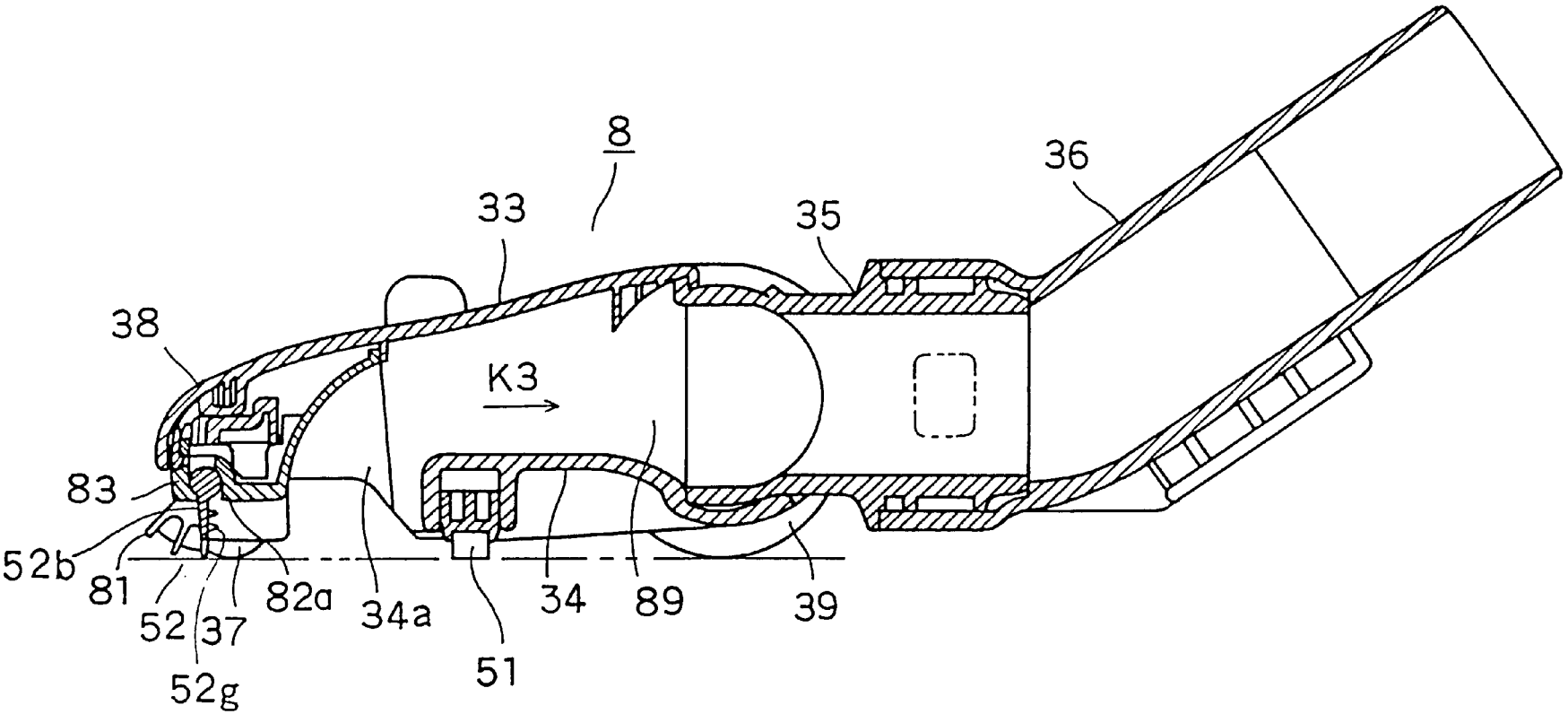
FIG. 44 is a sectional view, as seen from the side, of the nozzle unit of the electric vacuum cleaner of a tenth embodiment.
Figure 45:
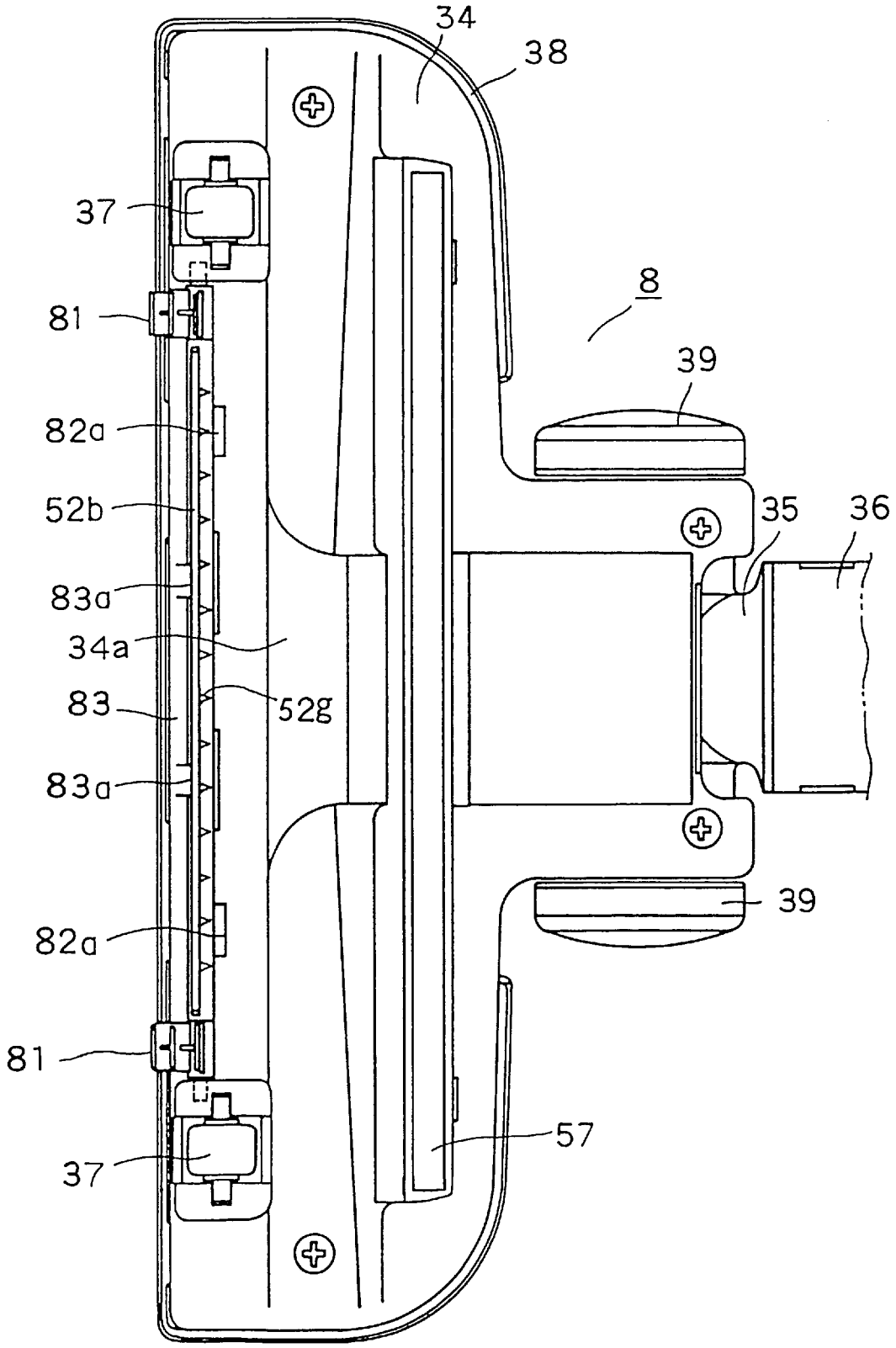
FIG. 45 is a bottom view of the nozzle unit of the electric vacuum cleaner of the tenth embodiment.
Figure 48:
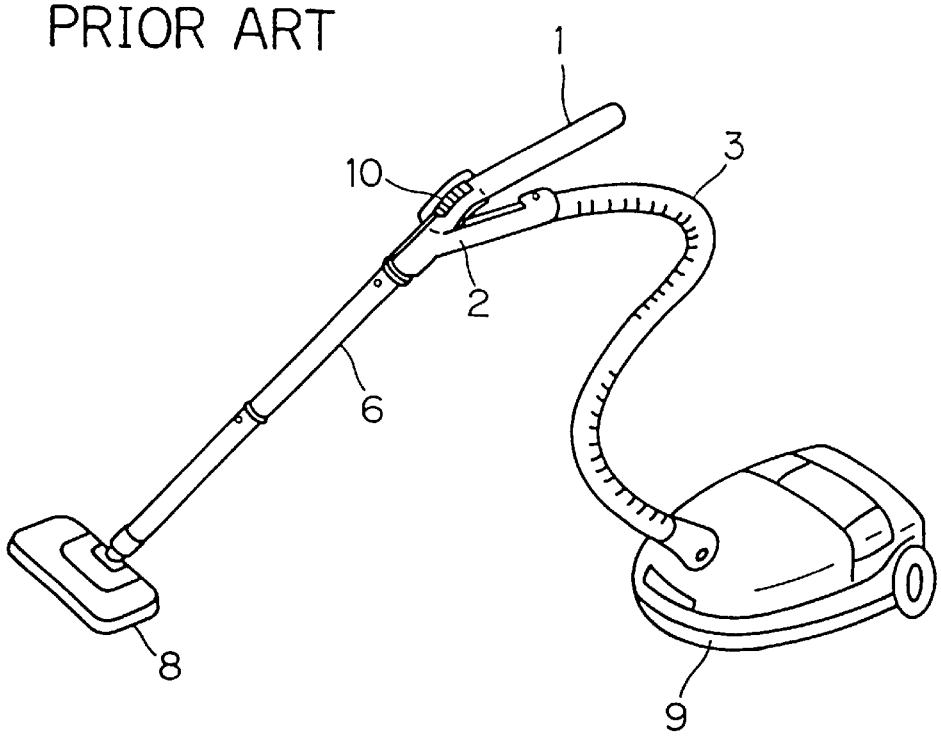
FIG.48 PRIOR ART
FIG. 48 is a perspective view of a conventional electric vacuum cleaner.

FIGS. 44 and 45 are a sectional view, as seen from the side, and a bottom view, respectively, of the nozzle unit of the electric vacuum cleaner of a tenth embodiment of the invention. For simplicity's sake, such components as are found also in the conventional example shown in FIG. 48 are identified with the same reference numerals. The electric vacuum cleaner as a whole has the same structure as the conventional example. The nozzle unit 8 has an outer casing composed of an upper case 33 and a lower case 34. To a body 9 of the electric vacuum cleaner, an extension pipe 6 (see FIG. 48) is connected. To the extension pipe 6, a second pipe 36 is connected. To the second pipe 36, a first pipe 35 is coupled. The first pipe 35 is held between the upper and lower cases 33 and 34. The elevation (depression) angle of the extension pipe 6 can be adjusted by means of the first pipe 35.

In the lower case 34, a nozzle 34*a* is formed so as to open toward the floor surface. The dust sucked in through the nozzle 34*a* flows, together with the flow of the sucked air, through the air flow passage 89 in the direction indicated by the arrow K3 to the body 9 of the electric vacuum cleaner, and thereby dust collection is achieved. In front of and behind the nozzle 34*a* are provided casters 37 and 39 that rotate while keeping the distance between the nozzle 34*a* and the floor surface constant, allowing movement of the nozzle unit 8.

At the front of the nozzle unit 8 is provided a bumper 38, which serves as a shock absorber when the nozzle unit 8 collides with a wall or the like. Behind the nozzle 34*a* is provided a brush member 51 for raking up dust clung to a carpet or the like. In front of the nozzle 34*a* is provided a flexible member 52. At both ends of the flexible member 52, aid pieces 81 are fitted so as to make contact with the floor surface. Thus, as the nozzle unit 8 moves back and forth, the flexible member 52 is made to rotate by the friction force between the aid pieces 81 and the floor surface.

Figure 46:
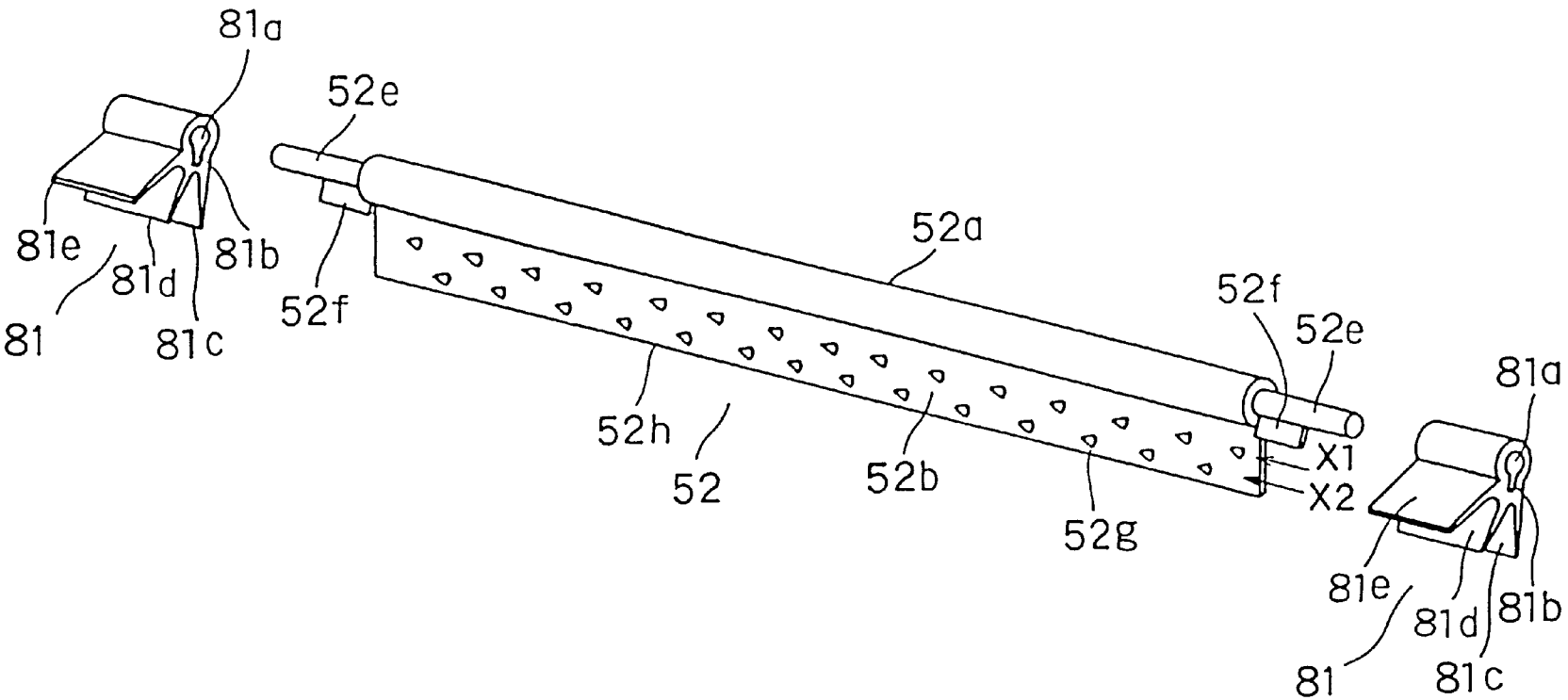
FIG. 46 is an exploded perspective view of the flexible member of the nozzle unit of the electric vacuum cleaner of the tenth embodiment.

FIG. 46 is an exploded perspective view showing the detail of the flexible member 52. On a supporting shaft 52*a*, a sealing piece 52*b* is provided so as to project therefrom. At both ends of the supporting shaft 52*a*, insertion shafts 52*e* are formed, which are fitted into insertion holes 81*a* of the aid pieces 81. On the sealing piece 52*b* are provided a plurality of conical projections 52*g*. The projections 52*g* are arranged in two rows X1 and X2 along the length of the sealing piece 52*b*. To allow the supporting shaft 52*a* and the aid pieces 81 to rotate together, engagement pieces 52*f* are provided on the insertion shafts 52*e*, and engagement grooves 81*b* into which the engagement pieces 52*f* are fitted are provided in the insertion holes 81*a* of the aid pieces 81.

The aid pieces 81 each have three fin-like portions 81*c*, 81*d*, and 81*e* formed so as to extend radially around the insertion holes 81*a*. The fin-like portions 81*c*, 81*d*, and 81*e* are made so long as to make contact with the floor surface. The supporting shaft 52*a*, the sealing piece 52*b*, and the projections 52*g* are formed integrally by molding out of a hard resin material such as ABS resin, polypropylene, or polyethylene. The aid pieces 81 are formed out of a soft material such as hard rubber.

Figure 47:
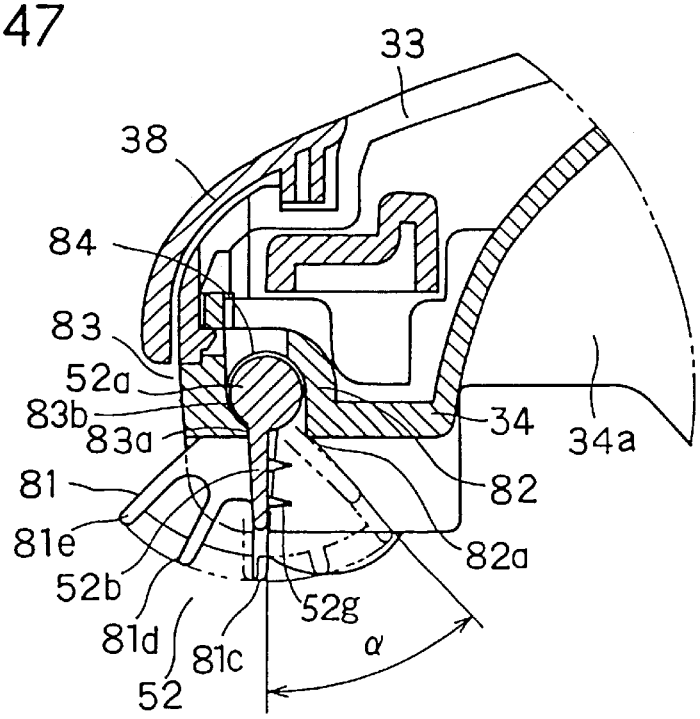
FIG. 47 is a detail view of the principal portion of the front portion of the nozzle unit of the electric vacuum cleaner of the tenth embodiment.

FIG. 47 is a detail sectional view showing the principal portion of the front portion of the nozzle unit 8, with the above-described flexible member 52 attached. The supporting shaft 52*a* is held by a groove 84 formed by a curved-surface plate 82 having a substantially J-like shape provided on the lower case 34 and a curved-surface portion 83*b* of a detachable engagement claw 83. The supporting shaft 52*a* of the flexible member 52 is fitted into this groove 84 and is held by the engagement claw 83 so as not to drop off. The sealing piece 52*b* strikes a front stopper portion 83*a* provided in the engagement claw 83 and a rear stopper portion 82*a* provided in the curved-surface plate 82, and thereby the rotation range $\alpha$ of the flexible member 52 is restricted.

When the nozzle unit 8 is moved forward, by the friction force between the fin-like portions 81*c* and 81*d* of the aid pieces 81, which are in contact with the floor surface, and the floor surface, the sealing piece 52*b* is rotated backward so as to strike the rear stopper portion 82*a*. At this time, the fin-like portion 81*e* makes contact with the floor surface, and thus an opening is formed in front of the nozzle 34*a* to allow easy suction of large-particle dust and dust by a wall.

When the nozzle unit 8 is moved backward, by the friction force between the fin-like portions 81*e* and 81*d*, which are in contact with the floor surface, and the floor surface, the sealing piece 52*b* is rotated forward so as to strike the front stopper portion 83*a*. At this time, the fin-like portion 81*c* makes contact with the floor surface. Thus, the sealing piece 52*b* ensures that no opening is left in front of the nozzle 34*a*, and thereby increases the degree of vacuum at the nozzle 34*a* and thus the suction power.

In cases where the surface to be cleaned is a carpet or the like, the casters 37 and 39 sink into the carpet or the like. As the nozzle unit 8 is moved backward, the projections 52*g* of the sealing piece 52*b* rake up fluffy dust, hair, and the like clung to the carpet or the like so as to allow such dust to be sucked through the nozzle 34*a*. Thus, it is possible to achieve raking of a carpet or the like with ease and thereby increase dust collection efficiency. Here, since the projections 52*g* are conical, the fluffy dust, hair, and the like raked up can be removed therefrom with ease by the suction force. This helps prevent clinging of raked-up dust.

In this embodiment, arranging the projections in a plurality of rows X1 and X2 (see FIG. 46) makes it possible to efficiently rake up fluffy dust, hair, and the like at different depths in a carpet or the like. Moreover, it is preferable to arrange the projections 52*g* in the row X1 and the projections 52*g* in the row X2 at different locations in the length direction, because this makes it possible to perform raking at shorter intervals and thereby increase dust collection efficiency. The projections may be arranged in more than two rows. Furthermore, by arranging the projections 52*g* near the lower edge 52h (see FIG. 46) of the sealing piece 52*b*, it is possible to rake deep into the surface to be cleaned and thereby further increase dust collection efficiency.

What is claimed is:

1. A nozzle unit for an electric vacuum cleaner, comprising:

a body case having a nozzle open toward a surface to be cleaned, the body case having a substantially rectangular shape;

a first pipe that has a first air flow passage for allowing passage of a flow of air sucked in through the nozzle and that is coupled to the body case so as to be rotatable about a rotation axis parallel to a direction of longer sides of the nozzle, the first pipe having a pivotally sliding portion that slides along the body case as the first pipe rotates, the pivotally sliding portion arranged inside the body case; and a second pipe rotatably coupled to the first pipe, the second pipe having a second air flow passage that communicates with the first air passage, wherein the first and second air flow passages are arranged substantially along a straight line, and the second pipe is rotatably mounted to said first pipe about a rotation axis substantially perpendicular to the first air flow passage.

2. A nozzle unit for an electric vacuum cleaner as claimed in claim 1, wherein the first air flow passage is rotatable between a substantially horizontal position and a substantially vertical position relative to the surface to be cleaned.

3. A nozzle unit for an electric vacuum cleaner as claimed in claim 2, wherein the rotation axis of the second pipe lies substantially at a center of the body case in a direction of longer sides of the body case, and the width of the first and second pipes in a direction of shorter sides of the body case is smaller than the width of the body case in the same direction when the first pipe is held perpendicularly to the surface to be cleaned.

4. A nozzle unit for an electric vacuum cleaner as claimed in claim 2, further including means for restricting rotation of the second pipe when the first air flow passage is substantially parallel to the surface to be cleaned.

5. A nozzle unit for an electric vacuum cleaner as claimed in claim 2, wherein the first air flow passage has a maximum cross-sectional area when its angle relative to the surface to be cleaned is in a predetermined range.

6. A nozzle unit for an electric vacuum cleaner as claimed in claim 5, further comprising:

an engagement member having an arc-shaped cross section and engaged with the first pipe so as to be interlocked therewith in accordance with a rotation angle of the first pipe; and an opening provided in the body case so as to allow rotation of the first pipe, the opening being closed by the pivotally sliding portion, which has an arc-shaped cross section and which slides along an inner surface of the body case, and by the engagement member.

7. A nozzle unit for an electric vacuum cleaner as claimed in claim 6, further comprising:

a locking member having an arc-shaped cross section and engaged with the engagement member in accordance with a rotation angle of the first pipe, the locking member being arranged inside the engagement member.

8. A nozzle unit for an electric vacuum cleaner as claimed in claim 7, further comprising:

a covering portion provided at a front end of the engagement member so as to close a gap between the engagement member and the body case.

9. A nozzle unit for an electric vacuum cleaner as claimed in claim 1, further comprising:

casters provided on a bottom surface of the body case so as to roll on the surface to be claimed, the casters being rotatable about an axis perpendicular to the surface to be claimed.

10. A nozzle unit for an electric vacuum cleaner as claimed in claim 9, wherein the casters can be moved translationally along the surface to be cleaned.

11. A nozzle unit for an electric vacuum cleaner as claimed in claim 9, wherein the casters are arranged inside the body case.

12. A nozzle unit for an electric vacuum cleaner as claimed in claim 9, further comprising:

recessed portions provided in the bottom surface of the body case so as to have openings in peripheral surfaces of the body case, the recessed portions being used to arrange the casters.

13. A nozzle unit for an electric vacuum cleaner as claimed in claim 9, further comprising:

supporting members, provided one pair for each of the casters, for supporting shafts of the casters on both sides of the casters; and reinforcing members for bridging between each pair of supporting members in front of and behind the casters.

14. A nozzle unit for an electric vacuum cleaner, comprising:

a body case having a nozzle open toward a surface to be cleaned, the body case having a substantially rectangular shape;

a first pipe that has a first air flow passage for allowing passage of a flow of air sucked in through the nozzle and that is coupled to the body case so as to be rotatable about a rotation axis parallel to a direction of longer sides of the nozzle, the first pipe having a pivotally sliding portion that slides along the body case as the first pipe rotates, the pivotally sliding portion arranged inside the body case; and a second pipe rotatably coupled to the first pipe, the second pipe having a second air flow passage that communicates with the first air passage, wherein the first pipe has an opening provided to allow rotation of the second pipe, and has a movable shutter for closing the opening.

15. A nozzle unit for an electric vacuum cleaner as claimed in claim 14, wherein the shutter is interlocked with the second pipe.

16. A nozzle unit for an electric vacuum cleaner as claimed in claim 14, further comprising:

a restricting member for restricting rotation of the second pipe relative to the first pipe.

17. A nozzle unit for an electric vacuum cleaner as claimed in claim 16, wherein the restricting member has a force-loading member and a ball.

18. A nozzle unit for an electric vacuum cleaner as claimed in claim 16, wherein the restricting member has a dust-proof member for preventing entry of dust.

19. A nozzle unit for an electric vacuum cleaner, comprising:

a body case having a nozzle open toward a surface to be cleaned, the body case having a substantially rectangular shape;

a first pipe that has a first air flow passage for allowing passage of a flow of air sucked in through the nozzle and that is coupled to the body case so as to be rotatable about a rotation axis parallel to a direction of longer sides of the nozzle, the first pipe having a pivotally sliding portion that slides along the body case as the first pipe rotates, the pivotally sliding portion arranged inside the body case;

a second pipe rotatably coupled to the first pipe, the second pipe having a second air flow passage that communicates with the first air passage; and a rotary brush rotatably arranged inside the body case, the rotary brush having a hollow shaft and blades provided so as to protrude from the shaft, the blades each having a plurality of through holes that communicate with an inside of the shaft.

20. A nozzle unit for an electric vacuum cleaner, comprising:

a body case having a nozzle open toward a surface to be cleaned;

a suction pipe rotatably coupled to the body case so as to allow passage of a flow of air sucked in through the nozzle, the suction pipe having a pivotally sliding portion that has an arc-shaped cross section and that slides along an inner surface of the body case; and a rotary brush rotatably arranged inside and substantially concentrically with the pivotally sliding portion.

21. A nozzle unit for an electric vacuum cleaner as claimed in claim 20, further comprising:

an air inlet provided on the body case, the air inlet allowing air to be sucked in to rotate the rotary brush;

an engagement member that has an arc-shaped cross section and that is engaged with the suction pipe so as to be interlocked therewith in accordance with a rotation angle of the suction pipe, the engagement member having a hole that communicates with the air inlet; and an opening provided in the body case so as to allow rotation of the suction pipe, the opening being closed by the sliding portion, which has an arc-shaped cross section and which slides along the inner surface of the body case, and by the engagement member.

* * * * *